US011027909B2

(12) United States Patent
Casper

(10) Patent No.: US 11,027,909 B2
(45) Date of Patent: Jun. 8, 2021

(54) AUTOMATED FLOWABLE MATERIAL DISPENSERS AND RELATED METHODS FOR DISPENSING FLOWABLE MATERIAL

(71) Applicant: GPCP IP HOLDINGS LLC, Atlanta, GA (US)

(72) Inventor: Ted Allen Casper, Menasha, WI (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 292 days.

(21) Appl. No.: 16/144,082

(22) Filed: Sep. 27, 2018

(65) Prior Publication Data

US 2020/0055658 A1 Feb. 20, 2020

Related U.S. Application Data

(63) Continuation of application No. 15/998,424, filed on Aug. 15, 2018, now abandoned.

(51) Int. Cl.
*B65D 83/00* (2006.01)
*B01F 15/04* (2006.01)
(Continued)

(52) U.S. Cl.
CPC ..... *B65D 83/0005* (2013.01); *B01F 15/0445* (2013.01); *A47K 5/12* (2013.01);
(Continued)

(58) Field of Classification Search
CPC ..... B65D 83/0005; B65D 83/384; B65D 83/262; B65D 83/207; B01F 15/0445;
(Continued)

(56) References Cited

U.S. PATENT DOCUMENTS 1,722,523 A 3/1903 Magidson
1,582,645 A 4/1926 Findley
(Continued)

FOREIGN PATENT DOCUMENTS

CN 2486091 4/2002
DE 202006002677 7/2006
(Continued)

OTHER PUBLICATIONS

"HYSO D3 Micro" dated Oct. 1, 2009.
"HYSO D3 Micro Automatic Door Handle Sanitizer" dated May 3, 2011.

*Primary Examiner* — Frederick C Nicolas
(74) *Attorney, Agent, or Firm* — Nelson Mullins Riley & Scarborough LLP

(57) ABSTRACT

An automated flowable material dispenser for dispensing flowable material from a flowable material container is provided. In one embodiment, the dispenser may include a dispenser housing configured to receive the flowable material container therein, a solenoid valve assembly positioned within the dispenser housing, and a biasing member configured to bias the flowable material container toward the solenoid valve assembly and to move the flowable material container from an unactuated configuration to an actuated configuration. The dispenser housing may define a dispensing opening along a bottom end of the dispenser housing and may be configured to move between an open configuration and a closed configuration. The solenoid valve assembly may be positioned above the dispensing opening and configured to control dispensing of the flowable material from the dispenser.

20 Claims, 26 Drawing Sheets

(51) Int. Cl.

| | |
|---|---|
| ***A47K 5/12*** | (2006.01) |
| *B65D 83/26* | (2006.01) |
| *A47K 10/38* | (2006.01) |
| *A47K 5/14* | (2006.01) |
| *B65D 83/38* | (2006.01) |
| *A47K 10/32* | (2006.01) |
| *B65D 83/20* | (2006.01) |

(52) U.S. Cl.
CPC ..... *A47K 5/1217* (2013.01); *A47K 5/14* (2013.01); *A47K 10/38* (2013.01); *A47K 2010/3273* (2013.01); *B65D 83/207* (2013.01); *B65D 83/262* (2013.01); *B65D 83/384* (2013.01)

(58) Field of Classification Search
CPC ..... A47K 5/1217; A47K 2010/3273; A47K 10/38; A47K 5/14; A47K 5/12
See application file for complete search history.

(56) References Cited

U.S. PATENT DOCUMENTS 1,856,083 A 5/1932 Sather
3,187,949 A 6/1965 Mangel
3,228,347 A 1/1966 Corsette
3,237,571 A 3/1966 Corsette
3,250,444 A 5/1966 Ward
3,351,240 A 11/1967 Gray
3,379,136 A 4/1968 Corsette
3,419,189 A 12/1968 Iketani
3,495,571 A 2/1970 Evans
3,627,176 A 12/1971 Sailors
3,632,020 A 1/1972 Nixon, Jr.
3,666,144 A 5/1972 Winder
3,796,185 A 3/1974 Boone
3,802,606 A 4/1974 Gust
3,865,271 A 2/1975 Gold
3,910,229 A 10/1975 Spencer
3,963,048 A 6/1976 Bowman
3,972,447 A * 8/1976 Fegley ..... B65D 83/267 222/5
4,018,419 A 4/1977 Monpetit
4,079,862 A * 3/1978 Fegley ..... B65D 83/267 222/162
4,144,987 A 3/1979 Kishi
4,185,661 A 1/1980 Gill et al.
4,245,671 A 1/1981 Kosugui
4,274,560 A 6/1981 Cater
4,277,001 A 7/1981 Nozawa
4,339,109 A 7/1982 Kawata et al.
4,389,003 A 6/1983 Meshberg
4,454,963 A * 6/1984 Fegley ..... B65D 83/267 222/160
4,531,547 A 7/1985 Hadden
4,552,179 A 11/1985 Tarusawa et al.
4,667,846 A 5/1987 Marceau
4,735,347 A 4/1988 Schultz et al.
4,798,312 A 1/1989 Scheiber
4,830,235 A 5/1989 Miller
4,882,875 A 11/1989 Green
4,884,720 A 12/1989 Whigham et al.
4,913,399 A 4/1990 Migliori
4,921,131 A 5/1990 Binderbauer et al.
4,964,543 A 10/1990 Scheiber
4,998,559 A 3/1991 McAuliffe, Jr.
5,029,729 A 7/1991 Madsen et al.
5,134,961 A 8/1992 Giles et al.
5,255,861 A 10/1993 Lemer
5,277,559 A 1/1994 Schultz
5,312,021 A 5/1994 Nelson
5,374,029 A 12/1994 Bailey
5,383,580 A 1/1995 Winder
5,417,258 A 5/1995 Privas
5,427,277 A 6/1995 Bierend et al.
5,443,084 A 8/1995 Saleur
5,445,189 A 8/1995 Yamamuro
5,456,626 A * 10/1995 Ming-Kang ..... A63H 3/003 222/160
5,464,125 A 11/1995 Daansen
5,465,878 A 11/1995 Armijo et al.
5,492,247 A 2/1996 Shu et al.
5,513,832 A 5/1996 Becker et al.
5,535,783 A 7/1996 Asou et al.
5,622,282 A * 4/1997 Yazawa ..... B65D 83/38 222/105
5,702,031 A 12/1997 Meshberg et al.
5,746,728 A 5/1998 Py
5,791,520 A 8/1998 Tichenor
5,887,759 A 3/1999 Ayigbe
5,918,778 A 7/1999 Schultz
5,996,628 A 12/1999 Najmolhoda et al.
6,039,212 A 3/2000 Singh
6,047,856 A 4/2000 Meshberg et al.
6,086,042 A 7/2000 Scott et al.
6,209,751 B1 4/2001 Goodin et al.
6,216,925 B1 4/2001 Garon
6,267,297 B1 7/2001 Contadini et al.
6,293,442 B1 9/2001 Mollayan
6,315,268 B1 11/2001 Cornea et al.
6,343,714 B1 2/2002 Tichenor
6,346,153 B1 2/2002 Lake et al.
6,349,851 B1 * 2/2002 Lu ..... B05B 11/0005 222/184
6,409,093 B2 6/2002 Ulczynski et al.
6,415,962 B1 7/2002 Bougamont et al.
6,419,122 B1 * 7/2002 Chown ..... A01M 1/2044 222/162
6,435,372 B1 * 8/2002 Blacker ..... A61M 15/009 128/200.23
6,450,198 B1 9/2002 Bouteille et al.
6,497,345 B1 12/2002 Wilker et al.
6,527,249 B2 3/2003 Niimi et al.
6,607,103 B2 8/2003 Gerenraich et al.
6,612,468 B2 9/2003 Pritchett et al.
6,619,616 B1 9/2003 Sudani et al.
6,669,166 B2 12/2003 Enomoto et al.
6,688,334 B2 2/2004 Kawamura et al.
6,739,578 B2 5/2004 Barton et al.
6,783,110 B2 8/2004 Hirota et al.
6,820,821 B2 11/2004 Linstedt et al.
6,877,636 B2 4/2005 Speckhart et al.
6,883,787 B2 4/2005 Allen
6,918,513 B1 7/2005 Downey
6,974,091 B2 12/2005 McLisky
7,101,441 B2 9/2006 Kennard
7,118,088 B2 10/2006 Hirota
7,168,597 B1 1/2007 Jones et al.
7,226,034 B2 6/2007 Stark et al.
7,303,099 B2 12/2007 Ophardt
7,320,418 B2 1/2008 Sassoon
7,374,066 B2 * 5/2008 Jackson ..... A47K 5/1217 222/52
7,407,065 B2 8/2008 Hooks et al.
7,497,214 B2 * 3/2009 Hodson ..... A61M 15/009 128/200.23
7,520,447 B2 4/2009 Engelen et al.
7,624,897 B2 12/2009 Bloc
7,641,077 B2 1/2010 Law et al.
7,669,735 B1 3/2010 Alleyne
7,681,765 B2 3/2010 Muderlak
7,708,166 B2 5/2010 Ophardt et al.
7,726,630 B2 6/2010 Cripps et al.
7,743,945 B2 * 6/2010 Lu ..... A61M 15/0065 222/36
7,757,899 B2 7/2010 Van der Heijden
7,770,874 B2 8/2010 Ophardt et al.
7,775,458 B2 8/2010 Linstedt et al.
7,779,839 B2 8/2010 Pocock et al.
7,878,371 B2 2/2011 Sassoon
7,938,340 B2 5/2011 Anderson et al.
7,954,674 B2 6/2011 Roy et al.

(56) References Cited

U.S. PATENT DOCUMENTS

| | | | | |
|---|---|---|---|---|
| 7,998,121 | B2 | 8/2011 | Stringham | |
| 8,002,150 | B2 | 8/2011 | Ophardt et al. | |
| 8,070,017 | B2 | 12/2011 | Green | |
| 8,079,498 | B2 | 12/2011 | Anderson et al. | |
| 8,091,738 | B2 | 1/2012 | Ciavarella | |
| 8,152,116 | B2 * | 4/2012 | Westberg | A61M 1/28 248/176.1 |
| 8,261,941 | B2 | 9/2012 | Woo et al. | |
| 8,261,942 | B2 | 9/2012 | Chen | |
| 8,261,950 | B2 | 9/2012 | Cittadino et al. | |
| 8,272,540 | B2 | 9/2012 | Ophardt et al. | |
| 8,308,027 | B2 | 11/2012 | Law et al. | |
| 8,336,740 | B1 | 12/2012 | Daansen | |
| 8,342,363 | B2 | 1/2013 | Carpenter et al. | |
| 8,365,965 | B2 | 2/2013 | Ophardt | |
| 8,371,479 | B2 | 2/2013 | Luft | |
| 8,387,827 | B2 | 3/2013 | Helf et al. | |
| 8,418,724 | B2 | 4/2013 | Suzuki et al. | |
| 8,418,889 | B2 | 4/2013 | Pritchett et al. | |
| 8,464,912 | B2 | 6/2013 | Ophardt et al. | |
| 8,464,914 | B2 | 6/2013 | Lulla et al. | |
| 8,474,664 | B2 | 7/2013 | Ophardt et al. | |
| 8,479,957 | B2 | 7/2013 | Ophardt | |
| 8,496,137 | B2 | 7/2013 | Alfaro et al. | |
| 8,556,122 | B2 | 10/2013 | Helf et al. | |
| 8,590,743 | B2 | 11/2013 | Beland et al. | |
| 8,590,750 | B2 * | 11/2013 | Warby | B05B 1/3436 222/162 |
| 8,668,116 | B2 | 3/2014 | Ciavarella et al. | |
| 8,734,392 | B2 | 5/2014 | Stadelhofer | |
| 8,740,015 | B2 | 6/2014 | McLisky | |
| 8,746,504 | B2 | 6/2014 | Beland et al. | |
| 8,746,510 | B2 | 6/2014 | Cittadino et al. | |
| 8,777,062 | B2 | 7/2014 | Ciavarella | |
| 8,777,065 | B2 * | 7/2014 | Knopow | B05B 7/2443 222/383.1 |
| 8,807,398 | B2 | 8/2014 | Sundberg et al. | |
| 8,814,008 | B2 * | 8/2014 | Anderson | B65D 83/75 222/402.1 |
| 8,815,171 | B2 | 8/2014 | Wagner | |
| 8,826,470 | B2 | 9/2014 | Helf et al. | |
| 8,844,766 | B2 | 9/2014 | Zaima et al. | |
| 8,870,030 | B2 | 10/2014 | Demarest et al. | |
| 8,881,945 | B2 | 11/2014 | Gasper et al. | |
| 8,887,954 | B2 | 11/2014 | Carpenter et al. | |
| 8,888,013 | B2 | 11/2014 | McLisky | |
| 8,899,449 | B2 | 12/2014 | Daansen | |
| 8,985,398 | B2 | 3/2015 | Demarest et al. | |
| 8,991,647 | B2 | 3/2015 | Meyers | |
| 9,061,821 | B2 | 6/2015 | Helf et al. | |
| 9,089,622 | B2 | 7/2015 | Helf et al. | |
| 9,132,954 | B2 | 9/2015 | Nilsson et al. | |
| 9,204,625 | B2 | 12/2015 | Furner | |
| 9,254,490 | B2 | 2/2016 | Daansen | |
| 9,254,954 | B2 | 2/2016 | Davideit et al. | |
| 9,353,881 | B2 | 5/2016 | Chang | |
| 9,375,745 | B2 | 6/2016 | Finch | |
| 9,394,096 | B2 | 7/2016 | Betts et al. | |
| 9,428,898 | B1 | 8/2016 | Clements | |
| 9,456,718 | B1 | 10/2016 | Myatt | |
| 9,457,951 | B2 | 10/2016 | Carpenter et al. | |
| D773,849 | S | 12/2016 | Criswell et al. | |
| 9,522,775 | B2 * | 12/2016 | Bellinger | B65D 83/26 |
| 9,527,656 | B2 | 12/2016 | Walters et al. | |
| 9,532,684 | B2 | 1/2017 | Hoefte et al. | |
| 9,541,213 | B2 | 1/2017 | Zieger | |
| 9,649,400 | B2 | 5/2017 | Furner et al. | |
| 9,694,199 | B2 | 7/2017 | Duquet et al. | |
| 2003/0052136 | A1 | 3/2003 | Weng | |
| 2003/0132254 | A1 | 7/2003 | Giangreco | |
| 2003/0205580 | A1 | 11/2003 | Yahav | |
| 2005/0039293 | A1 | 2/2005 | McReynolds et al. | |
| 2005/0133752 | A1 | 6/2005 | Purvines et al. | |
| 2005/0183194 | A1 | 8/2005 | Haile, Jr. | |
| 2006/0049208 | A1 | 3/2006 | Daansen | |
| 2006/0060615 | A1 | 3/2006 | McLisky | |
| 2007/0034149 | A1 | 2/2007 | Gonzalez Escobar | |
| 2007/0051742 | A1 | 3/2007 | Qiu | |
| 2008/0156896 | A1 | 7/2008 | Anderson et al. | |
| 2008/0272208 | A1 | 11/2008 | Anderson et al. | |
| 2008/0277501 | A1 | 11/2008 | Anderson et al. | |
| 2008/0290113 | A1 | 11/2008 | Helf et al. | |
| 2008/0290120 | A1 | 11/2008 | Helf et al. | |
| 2008/0309441 | A1 | 12/2008 | Anderson et al. | |
| 2009/0090737 | A1 | 4/2009 | Franco | |
| 2010/0155432 | A1 | 6/2010 | Christianson | |
| 2010/0275912 | A1 | 11/2010 | Lulla et al. | |
| 2010/0288851 | A1 | 11/2010 | Davies | |
| 2012/0043353 | A1 | 2/2012 | Davideit et al. | |
| 2012/0175540 | A1 | 7/2012 | Hase | |
| 2013/0112715 | A1 | 5/2013 | Ophardt | |
| 2013/0264507 | A1 | 10/2013 | Schnelker et al. | |
| 2014/0135245 | A1 | 5/2014 | Annaheim et al. | |
| 2014/0224893 | A1 | 8/2014 | Finch | |
| 2014/0252042 | A1 | 9/2014 | Cittadino | |
| 2015/0125343 | A1 | 5/2015 | Hall | |
| 2016/0121350 | A1 | 5/2016 | Yeung | |
| 2016/0131267 | A1 | 5/2016 | Daansen | |
| 2016/0193618 | A1 | 7/2016 | Sacchet | |
| 2016/0256020 | A1 | 9/2016 | Yasui | |
| 2016/0280422 | A1 | 9/2016 | Dorrance | |
| 2016/0309969 | A1 | 10/2016 | Brants | |
| 2016/0362051 | A1 | 12/2016 | Clair-Chalupka | |
| 2017/0008692 | A1 | 1/2017 | Davideit et al. | |
| 2017/0164793 | A1 | 6/2017 | Staub | |
| 2017/0251884 | A1 | 9/2017 | Carignan et al. | |
| 2017/0259292 | A1 | 9/2017 | Choi et al. | |
| 2017/0354984 | A1 | 12/2017 | Beal | |
| 2018/0106431 | A1 | 4/2018 | Timm et al. | |
| 2018/0127195 | A1 | 5/2018 | Ramsey | |
| 2019/0239701 | A1 | 8/2019 | Ray | |

FOREIGN PATENT DOCUMENTS

| | | |
|---|---|---|
| DE | 202013000668 | 3/2013 |
| FR | 2848590 | 6/2004 |
| GB | 618311 | 2/1949 |
| JP | 2002113398 | 4/2002 |
| JP | 2003246380 | 9/2003 |
| WO | 95/19304 | 7/1995 |
| WO | 01/41614 | 6/2001 |
| WO | 2008/115391 | 9/2008 |
| WO | 2009/117113 | 9/2009 |
| WO | 2011/083401 | 7/2011 |
| WO | 2016/094969 | 6/2016 |
| WO | 2016/124059 | 8/2016 |
| WO | 2016/152881 | 9/2016 |
| WO | 2016/162660 | 10/2016 |
| WO | 2016/169632 | 10/2016 |
| WO | 2017/025707 | 2/2017 |
| WO | 2018/052973 | 3/2018 |

* cited by examiner

AUTOMATED FLOWABLE MATERIAL DISPENSERS AND RELATED METHODS FOR DISPENSING FLOWABLE MATERIAL

CROSS-REFERENCE TO RELATED APPLICATIONS

This application is a continuation of U.S. application Ser. No. 15/998,424, filed on Aug. 15, 2018, which is incorporated herein by reference in its entirety.

FIELD OF THE DISCLOSURE

The present disclosure relates generally to product dispensers and more particularly to automated flowable material dispensers and related methods for dispensing flowable material from a dispenser.

BACKGROUND

Various types of product dispensers are known in the art, including mechanical and automated dispensers configured to dispense a product from a supply of product supported by the dispenser. For example, flowable material dispensers may be configured to allow a user to obtain a particular type of flowable material, such as a cleansing liquid, gel, or foam; a sanitizer liquid, gel, or foam; an antimicrobial liquid, gel, or foam; a liquid, gel, or foam lotion; a liquid, gel, or foam soap; or a liquid, gel, or foam detergent, from a supply of flowable material supported by the dispenser. The supply of flowable material may be provided in a container for storing the flowable material prior to dispensing from the dispenser. The container may be refilled upon depletion of the supply of flowable material, or the container may be replaced with a new prefilled container upon depletion of the supply of flowable material in the original container. Flowable material dispensers generally may be configured to dispense flowable material in a downward direction onto a user's hand or onto a substrate, such as a sheet product, held by the user's hand.

Automated flowable material dispensers generally may be configured to automatically dispense flowable material for a user upon user actuation of the dispenser or upon the dispenser sensing the presence of a user. Automated flowable material dispensers may include an automated dispensing mechanism configured to move a portion of the flowable material from the container to a dispensing nozzle during each dispense cycle. According to various configurations, the automated dispensing mechanism may include a motor, a drivetrain, a pump, a tube, and/or other components configured to move the flowable material from the container to the dispensing nozzle.

Although existing automated flowable material dispensers may be suitable for dispensing certain flowable materials in some applications, such dispensers may present one or more problems in other applications. First, certain automated flowable material dispensers may be relatively large and challenging to place in a convenient location for use, such as adjacent a supply of sheet product to which the flowable material is to be applied. Second, the automated dispensing mechanism of certain dispensers may be relatively complex and may include numerous components for moving the flowable material from the container to the dispensing nozzle, and such components, particularly pumps, may be prone to wear, degradation, or failure over time. Third, the automated dispensing mechanism of certain dispensers may not be able to ensure that a relatively consistent amount of the flowable material is dispensed during each dispense cycle, which may negatively affect user experience as well as user perception of the dispenser. Fourth, the automated dispensing mechanism of certain dispensers may not be able to dispense the entire supply of flowable material from the container, which may result in waste of the remaining flowable material when the container is replaced with a new prefilled container. Fifth, certain automated dispensing mechanisms may be configured such that a user must actuate the dispenser multiple times (i.e., carry out multiple dispense cycles) in order to obtain a desired amount of the flowable material, for example, to sufficiently moisten a substrate, such as a sheet product. Sixth, the dispensing nozzle of certain dispensers may not adequately control the dispensing pattern of the flowable material, which may be frustrating for a user who desires to have the flowable material evenly applied to a substrate, such as a sheet product. Seventh, in instances in which the flowable material is intended to be applied to a substrate, such as a sheet product, the dispenser, the flowable material, and/or the substrate may not be configured to ensure that the flowable material is absorbed by the substrate while maintaining a desired strength and durability of the substrate for use. Eighth, with certain dispensers, the process of replacing a depleted container with a new prefilled container may be cumbersome and time-consuming, and an improperly installed container may inhibit operation of the automated dispensing mechanism. Finally, certain automated flowable material dispensers may not provide a user with any indication regarding the operating status of the dispenser, which may result in user frustration.

There is thus a desire for improved automated flowable material dispensers and related methods for dispensing flowable material therewith.

SUMMARY

In one aspect, an automated flowable material dispenser for dispensing flowable material from a flowable material container is provided. According to one embodiment, the automated flowable material dispenser may include a dispenser housing, a solenoid valve assembly, and a biasing member. The dispenser housing may be configured to receive the flowable material container therein, and the dispenser housing may define a dispensing opening along a bottom end of the dispenser housing. The dispenser housing may be configured to move between an open configuration and a closed configuration. The solenoid valve assembly may be positioned within the dispenser housing above the dispensing opening and configured to control dispensing of the flowable material from the dispenser. The biasing member may be configured to bias the flowable material container toward the solenoid valve assembly and to move the flowable material container from an unactuated configuration to an actuated configuration.

In some embodiments, the biasing member may be attached to the dispenser housing. In some embodiments, the biasing member may be configured to bias the flowable material container toward the solenoid valve assembly when the dispenser housing is in the closed configuration. In some embodiments, the biasing member may be configured to move the flowable material container from the unactuated configuration to the actuated configuration when the dispenser housing is moved from the open configuration to the closed configuration. In some embodiments, the biasing member may include a compressible member. In some embodiments, the dispenser housing may include a top cover configured to pivot about a hinge to move the dispenser housing between the open configuration and the closed configuration, and the biasing member may be attached to the top cover. In some embodiments, the dispenser also may include a button releasably engaging the top cover, and the button may be configured to move from an extended position to a depressed position for allowing the top cover to pivot about the hinge. In some embodiments, the button may be positioned above the hinge.

In some embodiments, the solenoid valve assembly may include a solenoid housing configured to receive a portion of the flowable material container therein, a seal positioned within the solenoid housing and configured to engage the portion of the flowable material container, and a piston positioned within the solenoid housing and configured to translate between a deactivated position and an activated position. In some embodiments, the biasing member may be configured to bias the portion of the flowable material container against the seal. In some embodiments, the solenoid valve assembly may include a solenoid housing, an inlet stem extending from the solenoid housing and configured to be received within a portion of the flowable material container, and a piston positioned within the solenoid housing and configured to translate between a deactivated position and an activated position. In some embodiments, the biasing member may be configured to bias the portion of the flowable material container against the inlet stem.

In some embodiments, the dispenser also may include a dispensing nozzle attached to an outlet end of the solenoid valve assembly and positioned at least partially within the dispensing opening, and the dispensing nozzle may be configured to receive the flowable material from the solenoid valve assembly and direct the flowable material out of the dispenser. In some embodiments, the dispenser housing may be configured to receive the flowable material container in an inverted orientation such that an outlet end of the flowable material container faces toward the solenoid valve assembly. In some embodiments, the flowable material container may include a container body, a container reservoir positioned within the container body and containing the flowable material therein, a pressurized gas contained within the container body outside of the container reservoir, and a container valve assembly in fluid communication with the container reservoir and configured to engage the solenoid valve assembly.

In another aspect, an automated flowable material dispensing system for dispensing flowable material is provided. According to one embodiment, the dispensing system may include an automated flowable material dispenser and a flowable material container. The dispenser may include a dispenser housing, a solenoid valve assembly, and a biasing member. The dispenser housing may define a dispensing opening along a bottom end of the dispenser housing and be configured to move between an open configuration and a closed configuration. The solenoid valve assembly may be positioned within the dispenser housing above the dispensing opening. The flowable material container may be removably positioned within the dispenser housing and contain the flowable material therein. The biasing member may be configured to bias the flowable material container toward the solenoid valve assembly and to move the flowable material container from an unactuated configuration to an actuated configuration.

In some embodiments, the biasing member may be attached to the dispenser housing. In some embodiments, the biasing member may be configured to bias the flowable material container toward the solenoid valve assembly when the dispenser housing is in the closed configuration. In some embodiments, the biasing member may be configured to move the flowable material container from the unactuated configuration to the actuated configuration when the dispenser housing is moved from the open configuration to the closed configuration. In some embodiments, the biasing member may include a compressible member. In some embodiments, the dispenser housing may include a top cover configured to pivot about a hinge to move the dispenser housing between the open configuration and the closed configuration, and the biasing member may be attached to the top cover. In some embodiments, the dispenser also may include a button releasably engaging the top cover, and the button may be configured to move from an extended position to a depressed position for allowing the top cover to pivot about the hinge. In some embodiments, the button may be positioned above the hinge.

In some embodiments, the flowable material container may be positioned within the dispenser housing in an inverted orientation such that an outlet end of the flowable material container faces toward the solenoid valve assembly. In some embodiments, the flowable material container may be a pressurized container. In some embodiments, the flowable material container may include a container body, a container reservoir positioned within the container body and containing the flowable material therein, a pressurized gas contained within the container body outside of the container reservoir, and a container valve assembly in fluid communication with the container reservoir and configured to engage the solenoid valve assembly.

In still another aspect, a method of dispensing flowable material from a flowable material container using an automated flowable material dispenser is provided. According to one embodiment, the method may include receiving the flowable material container within a dispenser housing of the dispenser. The flowable material container may contain the flowable material therein, and the dispenser housing may define a dispensing opening along a bottom end of the dispenser housing. The method also may include moving the dispenser housing from an open configuration to a closed configuration. The method further may include biasing, via a biasing member of the dispenser, the flowable material container toward a solenoid valve assembly positioned within the dispenser housing above the dispensing opening. The method further may include moving, via the biasing member, the flowable material container from an unactuated configuration to an actuated configuration. The method further may include controlling dispensing of the flowable material from the dispenser via the solenoid valve assembly.

In some embodiments, the biasing member may be attached to the dispenser housing. In some embodiments, moving the dispenser housing from the open configuration to the closed configuration may cause the biasing member to bias the flowable material container toward the solenoid valve assembly and to move the flowable material container from the unactuated configuration to the actuated configuration. In some embodiments, the biasing member may include a compressible member. In some embodiments, moving the dispenser housing from the open configuration to the closed configuration may include pivoting a top cover of the dispenser housing, and the biasing member may be attached to the top cover. In some embodiments, the flowable material container may be positioned within the dispenser housing in an inverted orientation such that an outlet end of the flowable material container faces toward the solenoid valve assembly. In some embodiments, the flowable material container may be a pressurized container. In some embodiments, the flowable material container may include a container body, a container reservoir positioned within the container body and containing the flowable material therein, a pressurized gas contained within the container body outside of the container reservoir, and a container valve assembly in fluid communication with the container reservoir and configured to engage the solenoid valve assembly.

In another aspect, an automated flowable material dispenser for dispensing flowable material from a pressurized flowable material container is provided. According to one embodiment, the dispenser may include a dispenser housing, a solenoid valve assembly, and an electronic controller. The dispenser housing may be configured to receive the pressurized flowable material container therein. The solenoid valve assembly may be positioned within the dispenser housing and configured to control dispensing of the flowable material from the dispenser, and the solenoid valve assembly may be configured to move between a deactivated configuration and an activated configuration during a dispense cycle. The electronic controller may be positioned within the dispenser housing and in operable communication with the solenoid valve assembly. The electronic controller may be operable to vary an on time during which the solenoid valve assembly is in the activated configuration such that a volume of the flowable material dispensed from the dispenser during each dispense cycle is substantially constant throughout a life of the pressurized flowable material container.

In some embodiments, the dispenser also may include a capacitive sensor positioned within the dispenser housing and configured to detect a presence of the pressurized flowable material container within the dispenser housing. In some embodiments, the capacitive sensor may be configured to send a signal indicating the presence of the pressurized flowable material container within the dispenser housing to the electronic controller. In some embodiments, the electronic controller may be further operable to start a counter of a number of dispense cycles carried out using the pressurized flowable material container upon receiving the signal. In some embodiments, the electronic controller may be further operable to access a lookup table to determine the on time for each dispense cycle. In some embodiments, the electronic controller may be further operable to vary an off time during which the solenoid valve assembly is in the deactivated configuration. In some embodiments, the electronic controller may be further operable to vary the off time such that a sum of the on time and the off time for each dispense cycle is constant throughout the life of the pressurized flowable material container.

In some embodiments, the solenoid valve assembly may include a solenoid housing configured to receive a portion of the pressurized flowable material container therein, a winding positioned around the solenoid housing, and a piston positioned within the solenoid housing and configured to translate between a deactivated position and an activated position, and the electronic controller may be further operable to cause the winding to be energized by electric current during the on time of each dispense cycle. In some embodiments, the solenoid valve assembly may include a solenoid housing, a winding positioned around the solenoid housing, an inlet stem extending from the solenoid housing and configured to be received within a portion of the flowable material container, and a piston positioned within the solenoid housing and configured to translate between a deactivated position and an activated position, and the electronic controller may be further operable to cause the winding to be energized by electric current during the on time of each dispense cycle. In some embodiments, the pressurized flowable material container may include a container body, a container reservoir positioned within the container body and containing the flowable material therein, a pressurized gas contained within the container body outside of the container reservoir, and a container valve assembly in fluid communication with the container reservoir and configured to engage the solenoid valve assembly.

In still another aspect, an automated flowable material dispensing system for dispensing flowable material is provided. According to one embodiment, the dispensing system may include an automated flowable material dispenser and a pressurized flowable material container. The dispenser may include a dispenser housing, a solenoid valve assembly, and an electronic controller. The solenoid valve assembly may be positioned within the dispenser housing and configured to control dispensing of the flowable material from the dispenser, and the solenoid valve assembly may be configured to move between a deactivated configuration and an activated configuration during a dispense cycle. The electronic controller may be positioned within the dispenser housing and in operable communication with the solenoid valve assembly. The pressurized flowable material container may be removably positioned within the dispenser housing and contain the flowable material therein. The electronic controller may be operable to vary an on time during which the solenoid valve assembly is in the activated configuration such that a volume of the flowable material dispensed from the dispenser during each dispense cycle is substantially constant throughout a life of the pressurized flowable material container.

In some embodiments, the dispenser also may include a capacitive sensor positioned within the dispenser housing. In some embodiments, the capacitive sensor may be configured to detect a presence of the pressurized flowable material container within the dispenser housing and to send a signal indicating the presence of the pressurized flowable material container within the dispenser housing to the electronic controller. In some embodiments, the electronic controller may be further operable to start a counter of a number of dispense cycles carried out using the pressurized flowable material container upon receiving the signal. In some embodiments, the electronic controller may be further operable to vary an off time during which the solenoid valve assembly is in the deactivated configuration such that a sum of the on time and the off time for each dispense cycle is constant throughout the life of the pressurized flowable material container.

In some embodiments, the solenoid valve assembly may include a solenoid housing configured to receive a portion of the pressurized flowable material container therein, a winding positioned around the solenoid housing, and a piston positioned within the solenoid housing and configured to translate between a deactivated position and an activated position. In some embodiments, the electronic controller may be further operable to cause the winding to be energized by electric current during the on time of each dispense cycle. In some embodiments, the solenoid valve assembly may include a solenoid housing, a winding positioned around the solenoid housing, an inlet stem extending from the solenoid housing and configured to be received within a portion of the flowable material container, and a piston positioned within the solenoid housing and configured to translate between a deactivated position and an activated position. In some embodiments, the electronic controller may be further operable to cause the winding to be energized by electric current during the on time of each dispense cycle. In some embodiments, the pressurized flowable material container may include a container body, a container reservoir positioned within the container body and containing the flowable material therein, a pressurized gas contained within the container body outside of the container reservoir, and a container valve assembly in fluid communication with the container reservoir and configured to engage the solenoid valve assembly.

In another aspect, a method of dispensing flowable material from a pressurized flowable material container using an automated flowable material dispenser is provided. According to one embodiment, the method may include receiving the pressurized flowable material container within a dispenser housing of the dispenser. The flowable material container may contain the flowable material therein. The method also may include controlling dispensing of the flowable material from the dispenser via a solenoid valve assembly positioned within the dispenser housing. The solenoid valve assembly may be configured to move between a deactivated configuration and an activated configuration during a dispense cycle. The method further may include varying, via an electronic controller positioned within the dispenser housing and in operable communication with the solenoid valve assembly, an on time during which the solenoid valve assembly is in the activated configuration such that a volume of the flowable material dispensed from the dispenser during each dispense cycle is substantially constant throughout a life of the pressurized flowable material container.

In some embodiments, the method further may include detecting, via a capacitive sensor positioned within the dispenser housing, a presence of the pressurized flowable material container within the dispenser housing, sending, via the capacitive sensor, a signal indicating the presence of the pressurized flowable material container within the dispenser housing to the electronic controller, and starting, via the electronic controller, a counter of a number of dispense cycles carried out using the pressurized flowable material container upon receiving the signal. In some embodiments, the method further may include varying, via the electronic controller, an off time during which the solenoid valve assembly is in the deactivated configuration such that a sum of the on time and the off time for each dispense cycle is constant throughout the life of the pressurized flowable material container.

In some embodiments, the solenoid valve assembly may include a solenoid housing configured to receive a portion of the pressurized flowable material container therein, a winding positioned around the solenoid housing, and a piston positioned within the solenoid housing and configured to translate between a deactivated position and an activated position. In some embodiments, the method further may include causing, via the electronic controller, the winding to be energized by electric current during the on time of each dispense cycle. In some embodiments, the solenoid valve assembly may include a solenoid housing, a winding positioned around the solenoid housing, an inlet stem extending from the solenoid housing and configured to be received within a portion of the flowable material container, and a piston positioned within the solenoid housing and configured to translate between a deactivated position and an activated position. In some embodiments, the method further may include causing, via the electronic controller, the winding to be energized by electric current during the on time of each dispense cycle. In some embodiments, the pressurized flowable material container may include a container body, a container reservoir positioned within the container body and containing the flowable material therein, a pressurized gas contained within the container body outside of the container reservoir, and a container valve assembly in fluid communication with the container reservoir and configured to engage the solenoid valve assembly.

In still another aspect, a dispensing system is provided. According to one embodiment, the dispensing system may include a roll of sheet product, a sheet product holder, a pressurized flowable material container, and an automated flowable material dispenser. The sheet product holder may include a spindle configured to support the roll of sheet product thereon. The pressurized flowable material container may include a flowable material contained therein. The automated flowable material dispenser may include a dispenser housing and a solenoid valve assembly. The dispenser housing may be configured to receive the pressurized flowable material container therein, and the dispenser housing may define a dispensing opening along a bottom end of the dispenser housing. The solenoid valve assembly may be positioned within the dispenser housing above the dispensing opening and configured to control dispensing of the flowable material from the dispenser.

In some embodiments, the flowable material may be a liquid cleanser, and the sheet product may be a bath tissue configured to absorb and retain the flowable material. In some embodiments, the sheet product may have an absorbency between 350 $gm/m^2$ and 550 $gm/m^2$. In some embodiments, the sheet product may have an absorbency between 400 $gm/m^2$ and 500 $gm/m^2$.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Figure 1A:
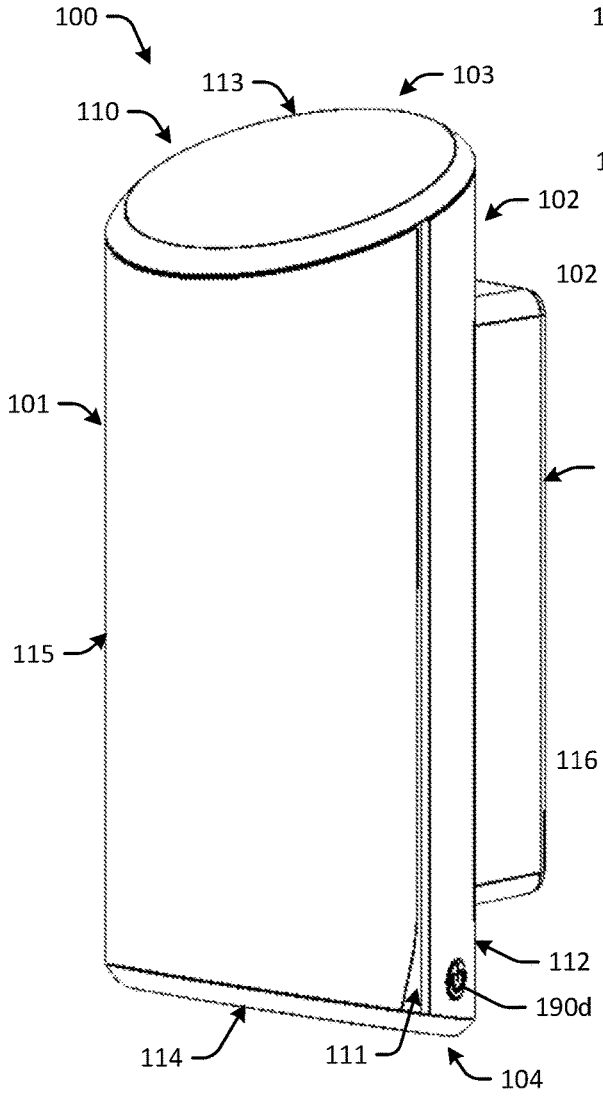
FIG. 1A is a front perspective view of an automated flowable material dispenser in accordance with one or more embodiments of the disclosure, showing a housing of the dispenser.
Figure 1B:
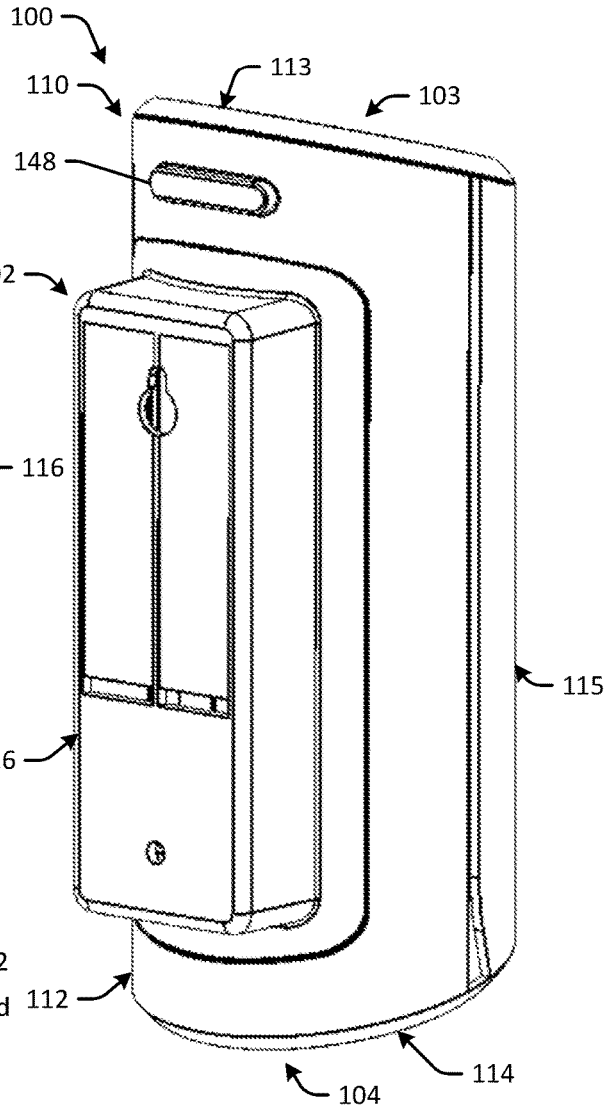
FIG. 1B is a back perspective view of the dispenser of FIG. 1A.
Figure 1C:
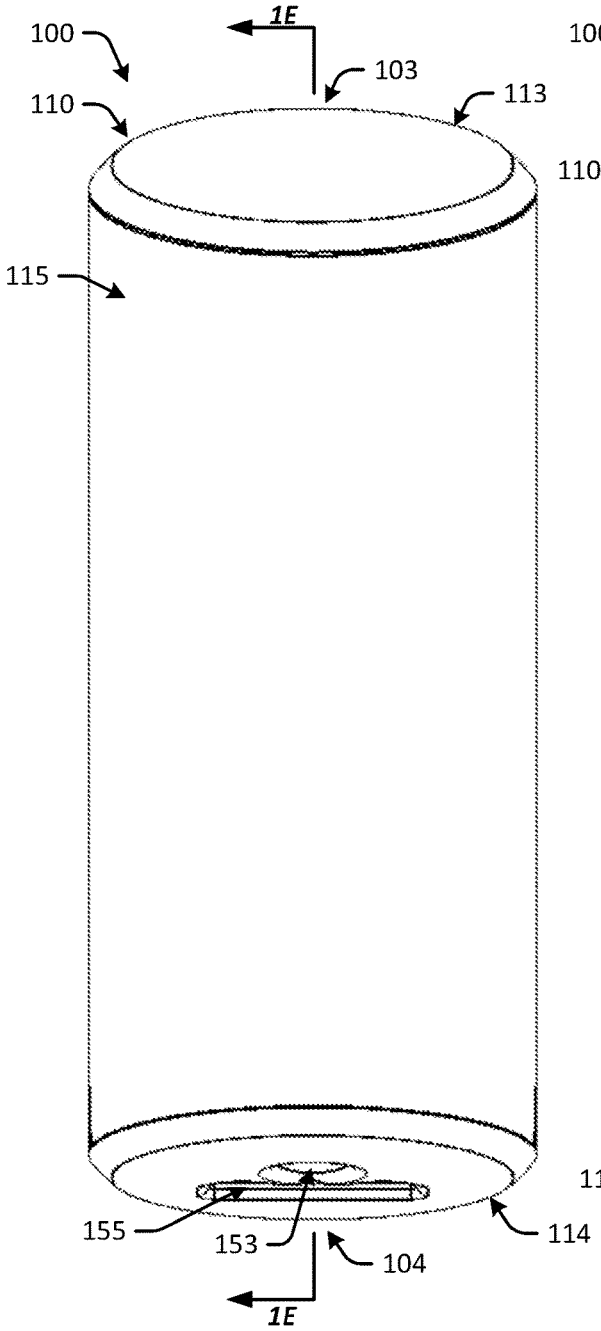
FIG. 1C is a front view of the dispenser of FIG. 1A.
Figure 1D:
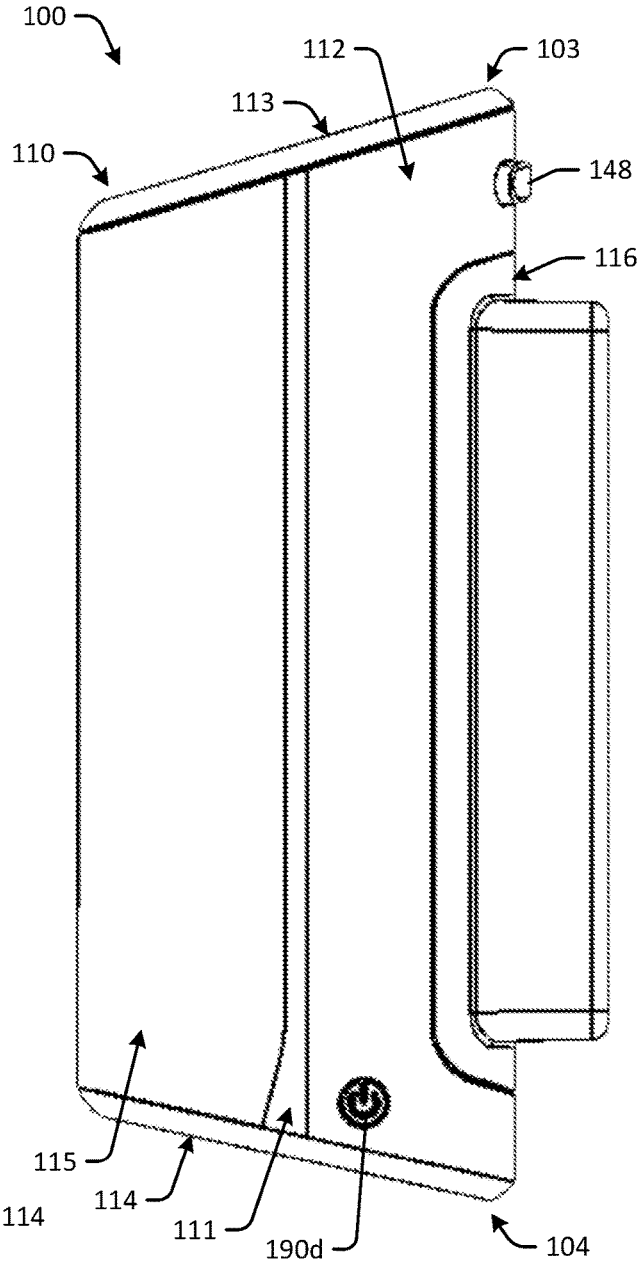
FIG. 1D is a side view of the dispenser of FIG. 1A.

The automated flowable material dispensers and related methods provided herein advantageously utilize an automated dispensing mechanism having a robust and relatively simple configuration that includes a limited number of components for dispensing flowable material from a replaceable flowable material container. As described in detail below, the flowable material container may be a pressurized container that includes a body for containing a pressurized gas therein, a cap for closing the body, a reservoir for containing the flowable material therein, and a valve assembly for controlling release of the flowable material from the container. The automated flowable material dispensers may include a housing for receiving the flowable material container therein, a biasing member for moving the container between an unactuated configuration and an actuated configuration, and a solenoid valve assembly for controlling dispensing of the flowable material from the container and out of the dispenser. As described below, the flowable material container may be received within the housing in an inverted orientation, and the biasing member may move the container from its unactuated configuration to its actuated configuration when the housing is moved from an open configuration to a closed configuration. When the flowable material container is in its actuated configuration, the flowable material may flow freely from the container into the solenoid valve assembly, and the solenoid valve assembly may control dispensing of the flowable material from the dispenser. During a dispense cycle, the solenoid valve assembly may move from a deactivated configuration to an activated configuration, allowing a portion of the flowable material to flow through a dispensing nozzle and out of the dispenser. As described below, the automated flowable material dispensers may be configured to allow a user to dispense the flowable material onto a substrate, such as a sheet product, for personal cleansing or other purposes.

The automated flowable material dispensers and related methods described herein may address one or more of the above-described problems associated with existing technology for dispensing flowable material. For example, the automated flowable material dispensers may have a compact configuration that allows the dispensers to be placed in a convenient location for use, such as adjacent a supply of sheet product to which the flowable material is to be applied. The automated flowable material dispensers and the flowable material container used therewith advantageously may ensure that a substantially consistent amount of the flowable material is dispensed during each dispense cycle and may be able to dispense the entire, or substantially the entire, supply of flowable material from the container. The automated flowable material dispensers and the flowable material container also may control the dispensing pattern of the flowable material such that a desired amount of the flowable material may be evenly applied to a substrate, such as a sheet product. As described below, the automated flowable material dispensers may be associated with a sheet product dispenser, such that a user may dispense a portion of sheet product and then dispense an amount of the flowable material onto the sheet product for subsequent use. In such instances, the dispensers and the flowable material may be configured for use with the particular sheet product, such that the flowable material may be absorbed by the sheet product while maintaining a desired strength and durability of the wetted sheet product for use. Additionally, the automated flowable material dispensers and the flowable material container may allow a depleted container to be quickly and easily replaced with a new prefilled container and may ensure that the container is properly installed to allow desired operation of the automated dispensing mechanism. Furthermore, the automated flowable material dispensers may provide a visual indication to inform a user of the operating status of the dispenser.

The present disclosure includes non-limiting embodiments of automated flowable material dispensers, flowable material containers, and related methods for dispensing flowable material. The embodiments are described in detail herein to enable one of ordinary skill in the art to practice the automated flowable material dispensers, flowable material containers, and related methods, although it is to be understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably.

As used herein, the term "flowable material" refers to any material, such as a liquid, gel, or foam material, that is able to move or be moved along in a flow. Examples of flowable materials include, but are not limited to, soap, sanitizer, cleanser, air freshener, shampoo, body wash, lotion, or other skincare or personal hygiene products, condiments or other foodservice products, or cleaning products, whether in the form of a liquid, gel, foam, or combinations thereof. In some embodiments, the flowable material may be stored in one form, such as a liquid, and dispensed in the same form. In some embodiments, the flowable material may be stored in one form, such as a liquid, and dispensed in another form, such as a foam.

As used herein, the term "sheet product" refers to a product that is relatively thin in comparison to its length and width and exhibits a relatively flat, planar configuration, yet is flexible or bendable to permit folding, rolling, stacking, or the like. Example sheet products include towel, bath tissue, facial tissue, napkin, wipe, or other sheet-like products. Sheet products may be made from paper, cloth, non-woven, metallic, polymer or other materials, and in some cases may include multiple layers or plies. In some embodiments, the sheet product may be a continuous sheet that is severable or separable into individual sheets using, for example, a tear bar or cutting blade, while in other cases the sheet product may include predefined areas of weakness, such as lines of perforations, that extend along the width of the sheet product to define individual sheets and facilitate separation or tearing.

As used herein, the term "substantially rigid," as used with respect to a component or an assembly, means that the component or the assembly does not deform during its normal intended use as described herein.

As used herein in reference to a dispensed volume of flowable material, the term "substantially constant" means that the volume varies by no more than ten percent (10%) from a mean value.

The meanings of other terms used herein will be apparent to one of ordinary skill in the art or will become apparent to one of ordinary skill in the art upon review of the detailed description when taken in conjunction with the several drawings and the appended claims.

Figure 1E:
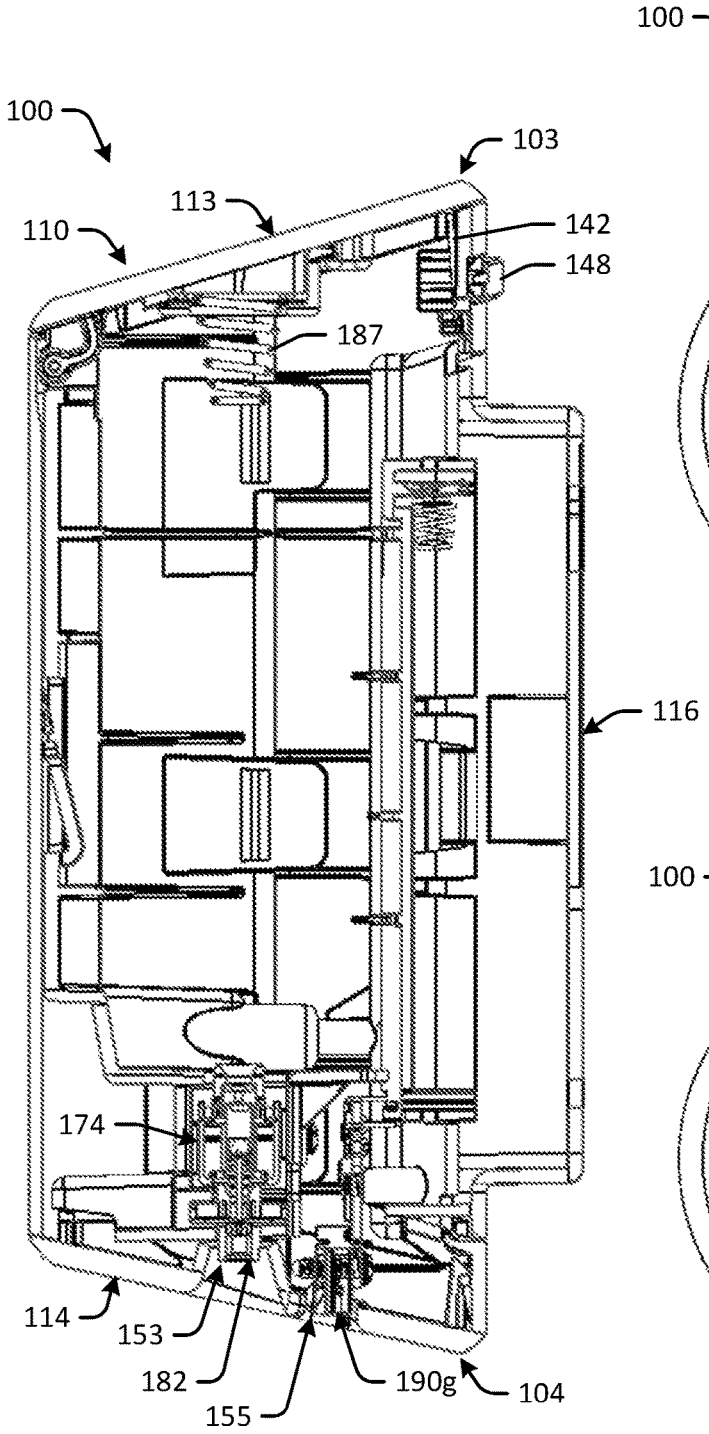
FIG. 1E is a cross-sectional side view of the dispenser of FIG. 1A, taken along line 1E-1E of FIG. 1C.
Figure 1F:
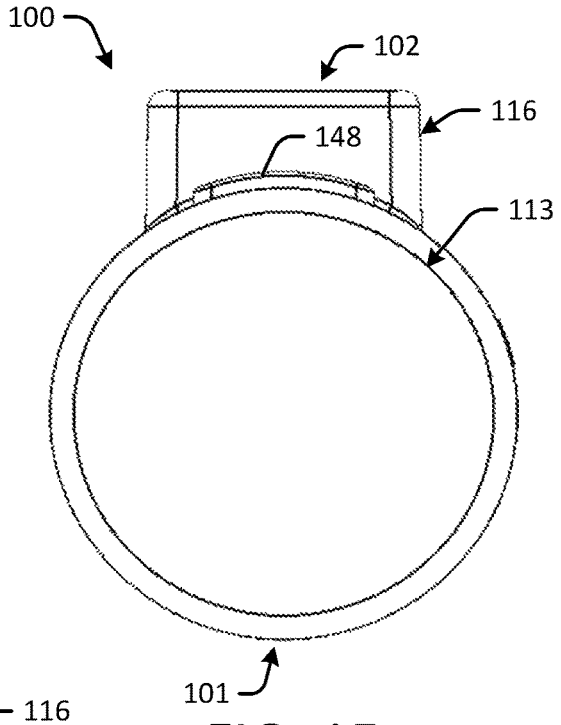
FIG. 1F is a top view of the dispenser of FIG. 1A.
Figure 1G:
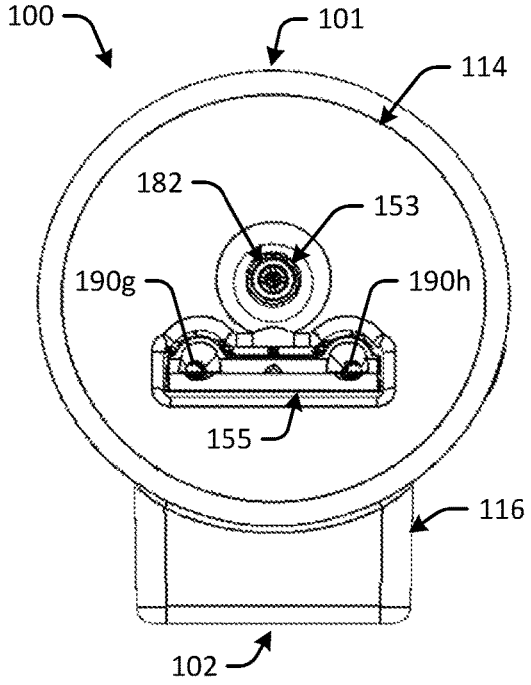
FIG. 1G is a bottom view of the dispenser of FIG. 1A.
Figure 1H:
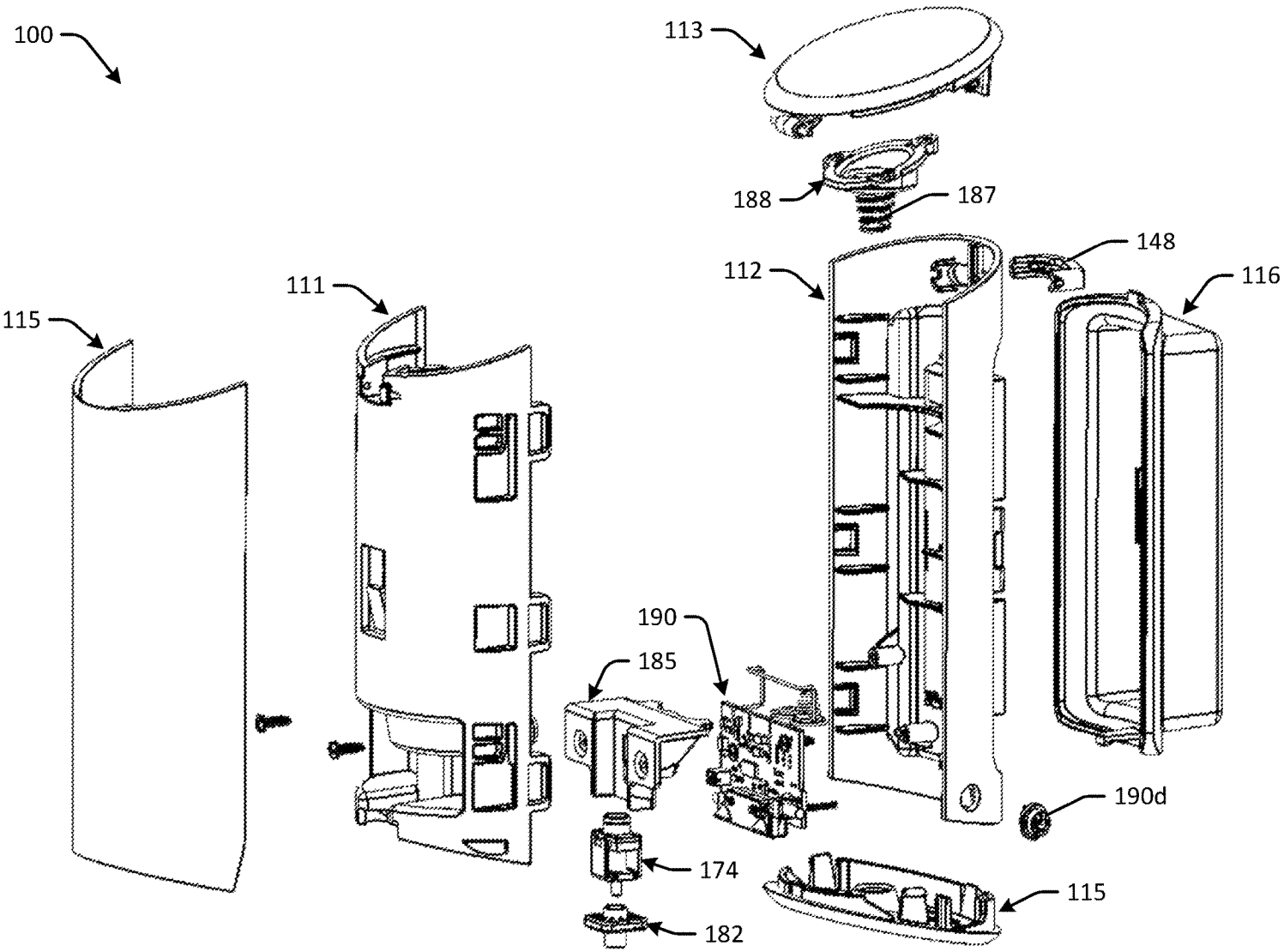
FIG. 1H is an exploded front perspective view of the dispenser of FIG. 1A.
Figure 1I:
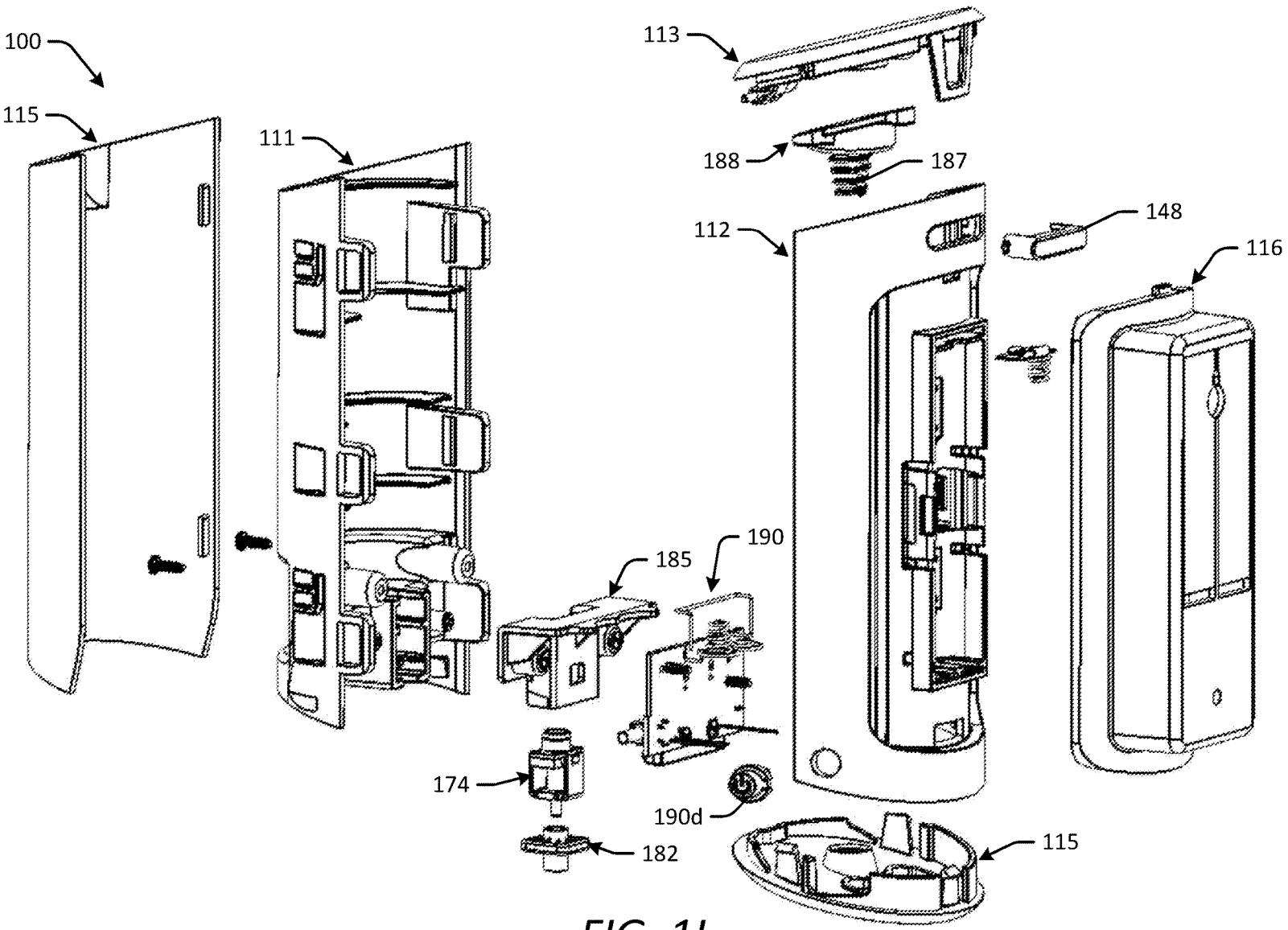
FIG. 1I is an exploded back perspective view of the dispenser of FIG. 1A.
Figure 1J:
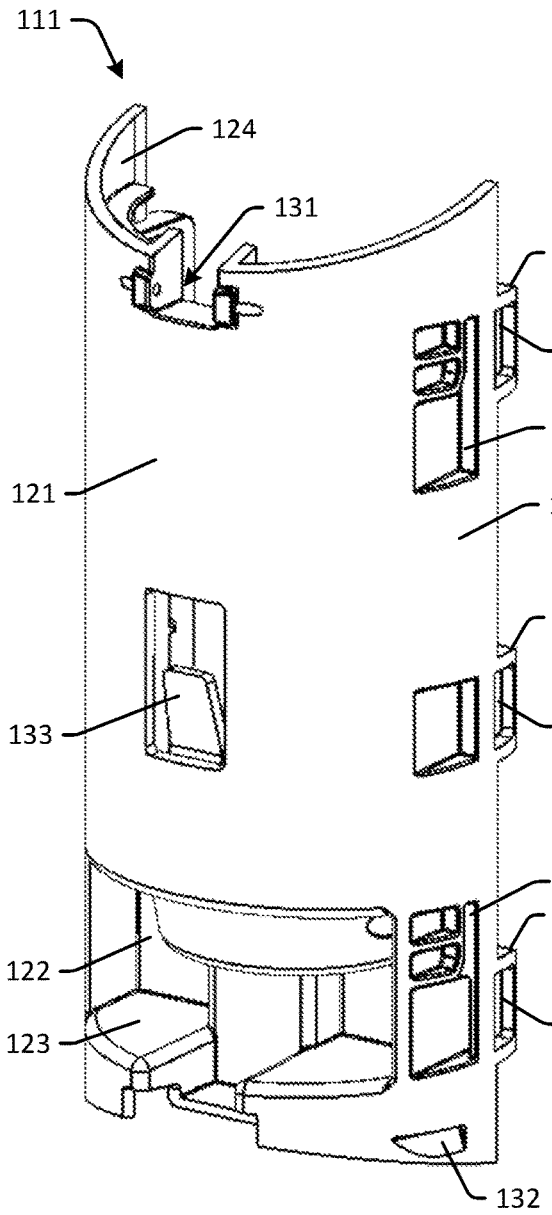
FIG. 1J is a front perspective view of a first housing portion of the dispenser of FIG. 1A.
Figure 1K:
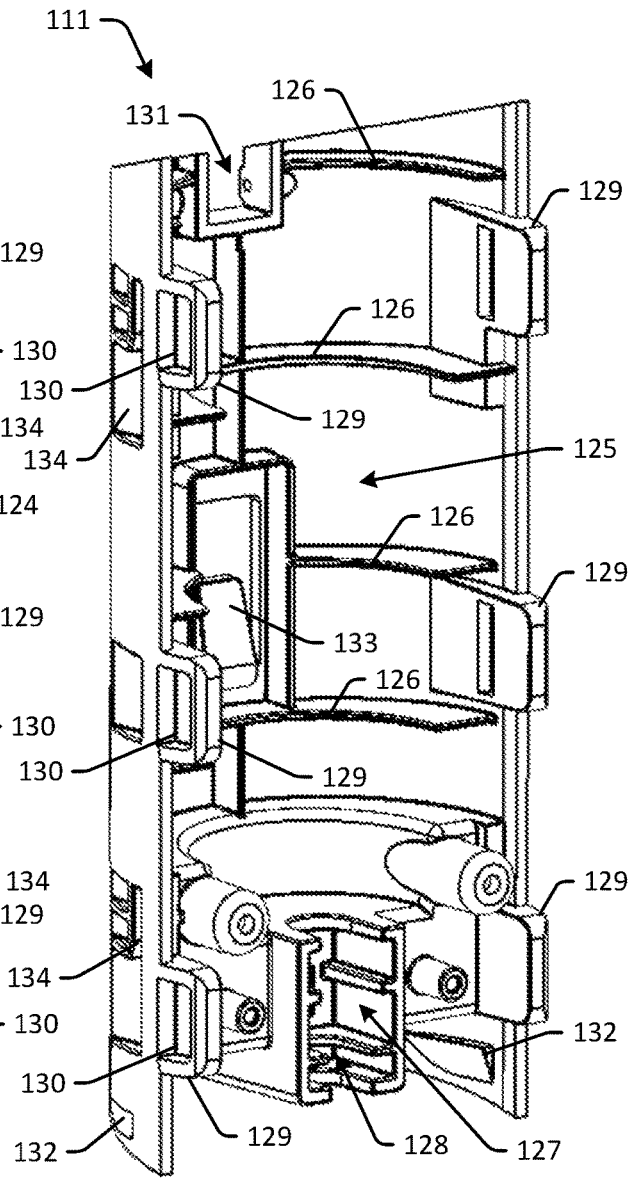
FIG. 1K is a back perspective view of the first housing portion of the dispenser of FIG. 1A.
Figure 1L:
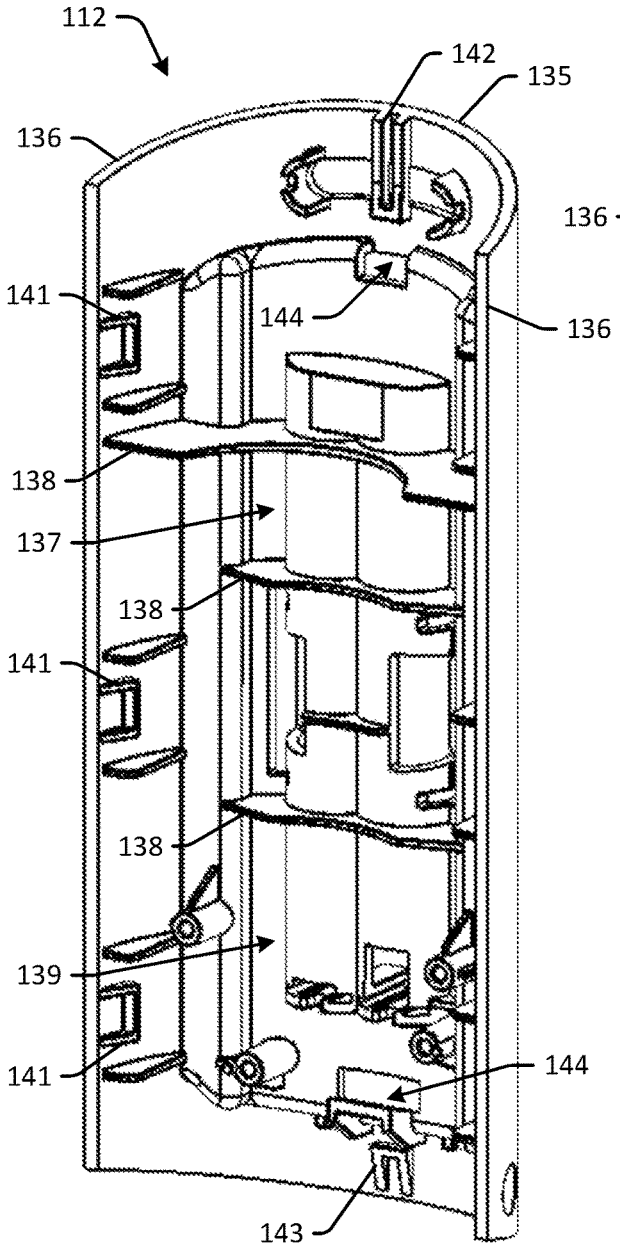
FIG. 1L is a front perspective view of a second housing portion of the dispenser of FIG. 1A.
Figure 1M:
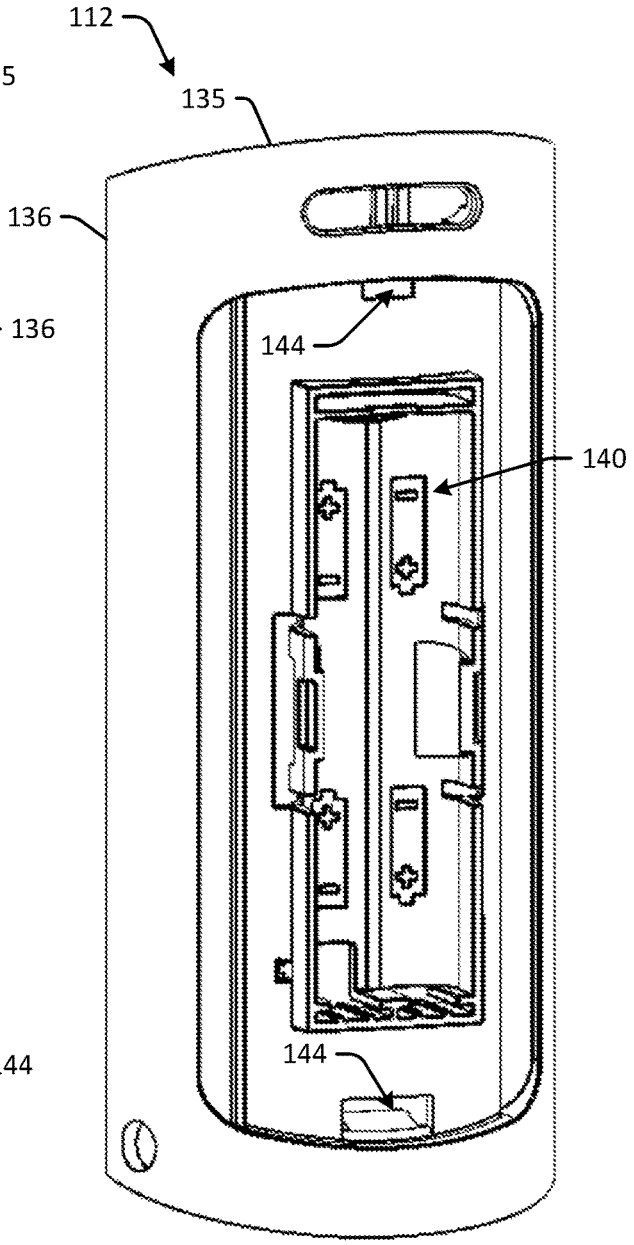
FIG. 1M is a back perspective view of the second housing portion of the dispenser of FIG. 1A.
Figure 1N:
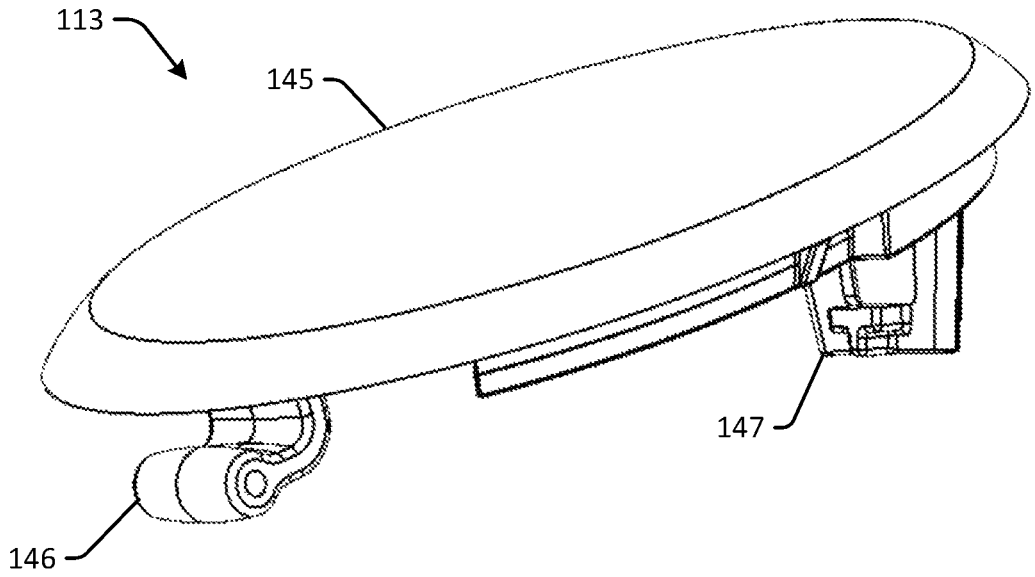
FIG. 1N is a top perspective view of a third housing portion of the dispenser of FIG. 1A.
Figure 1O:
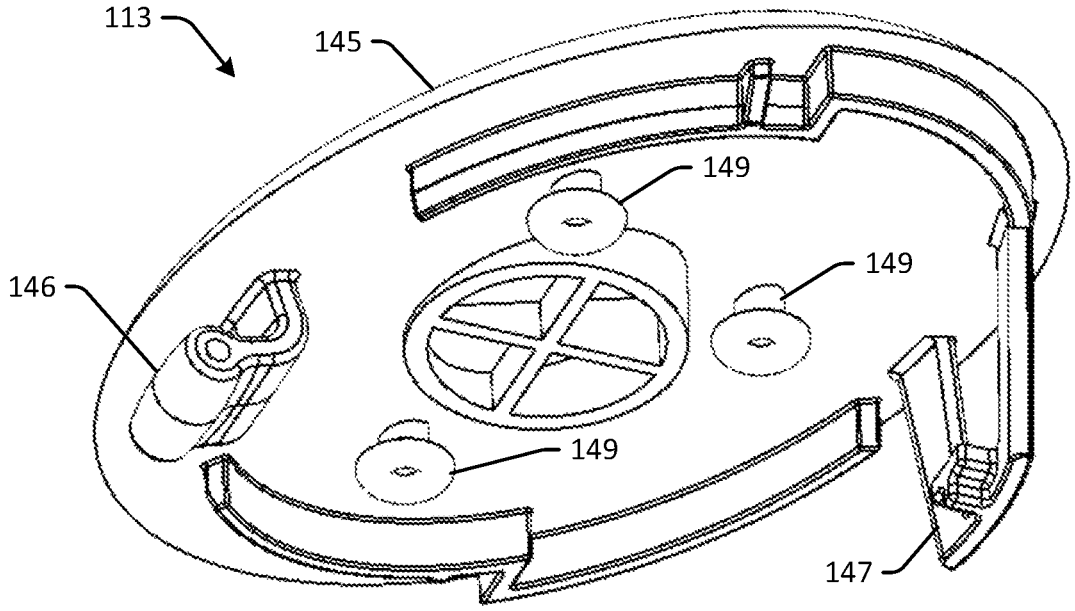
FIG. 1O is a bottom perspective view of the third housing portion of the dispenser of FIG. 1A.
Figure 1P:
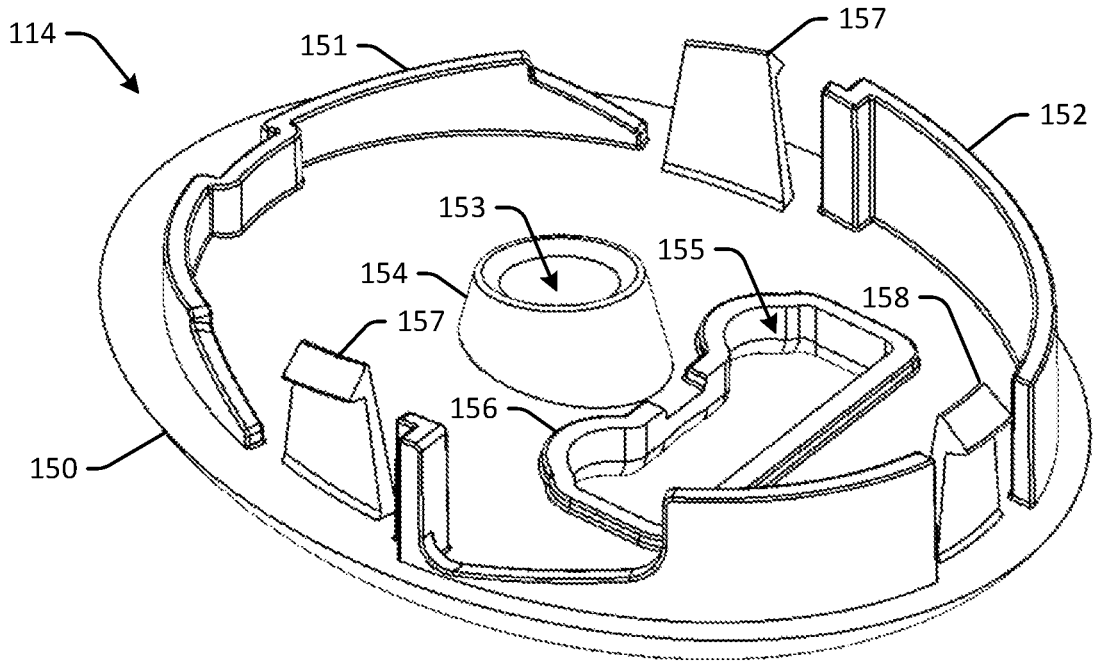
FIG. 1P is a top perspective view of a fourth housing portion of the dispenser of FIG. 1A.
Figure 1Q:
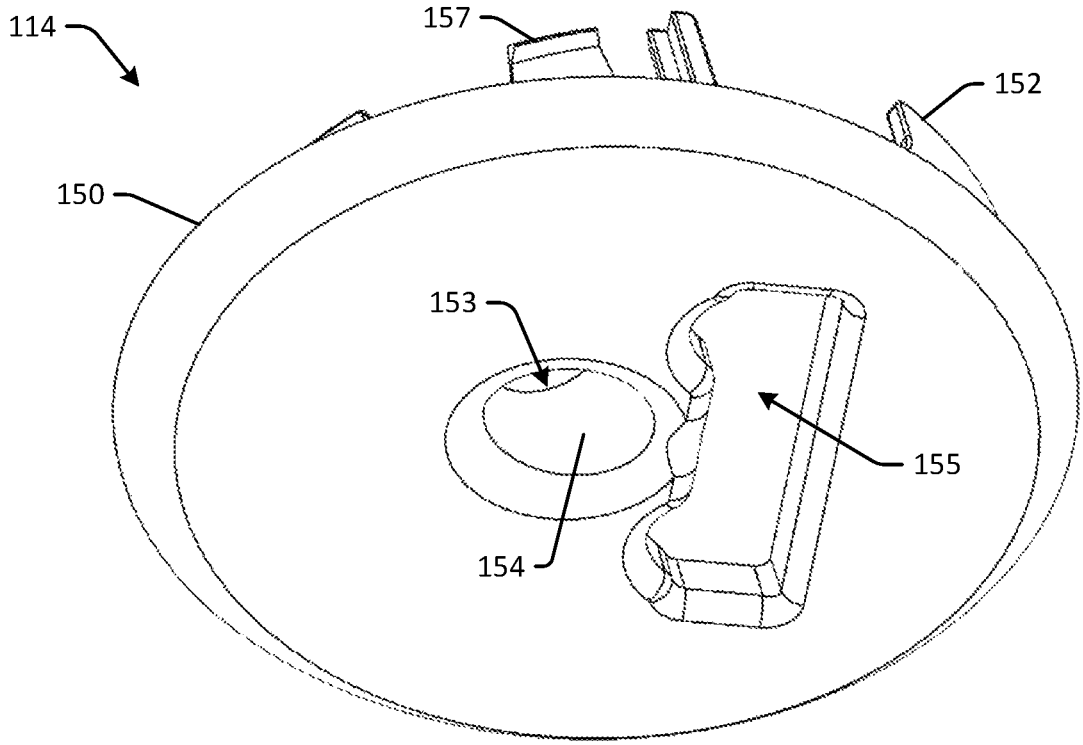
FIG. 1Q is a bottom perspective view of the fourth housing portion of the dispenser of FIG. 1A.
Figure 1R:
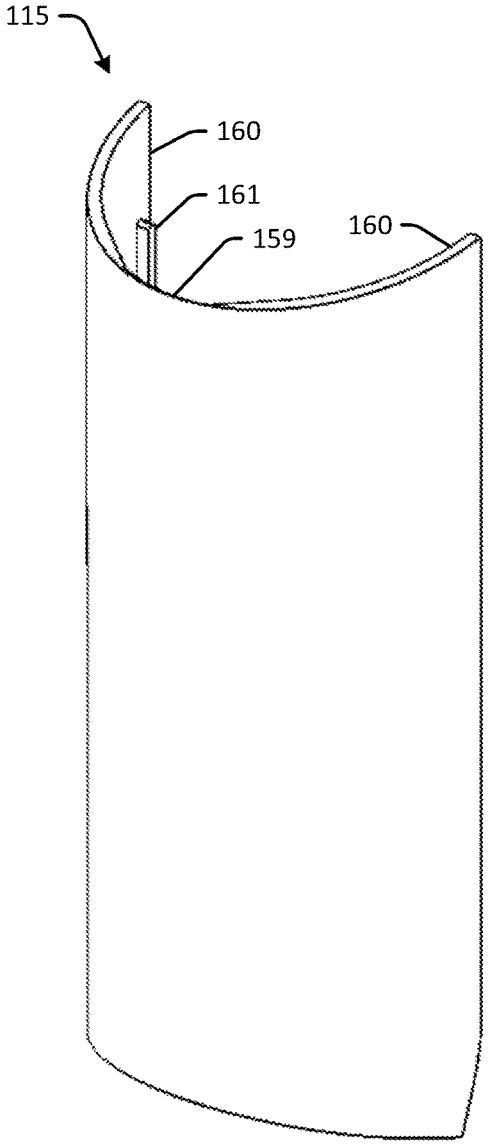
FIG. 1R is a front perspective view of a fifth housing portion of the dispenser of FIG. 1A.
Figure 1S:
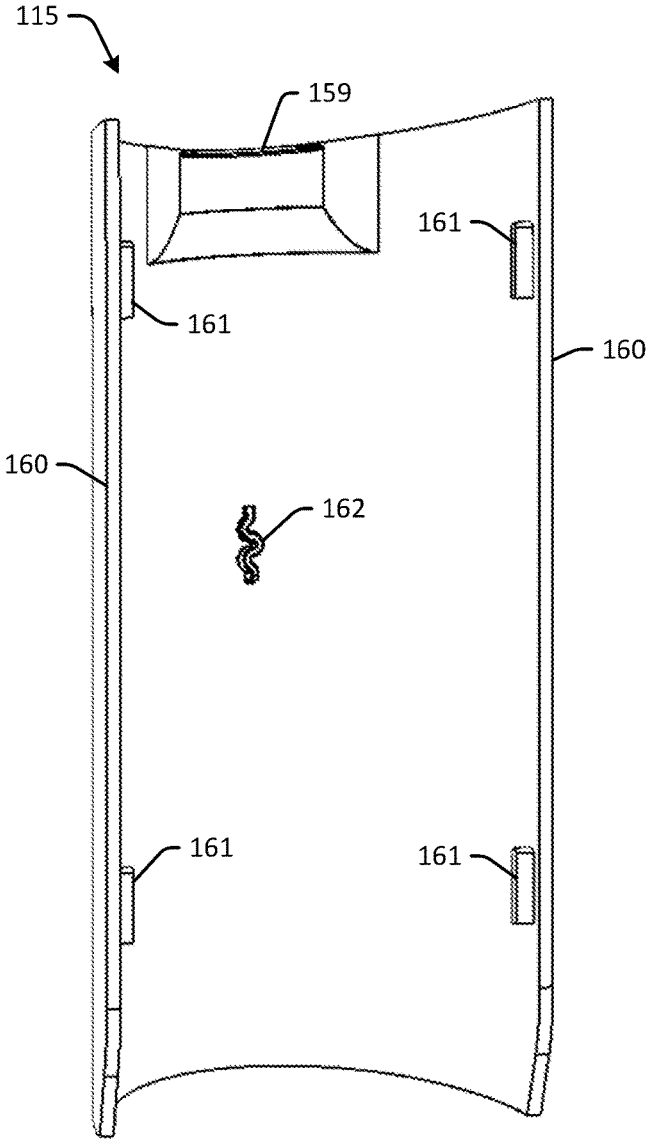
FIG. 1S is a back perspective view of the fifth housing portion of the dispenser of FIG. 1A.
Figure 1T:
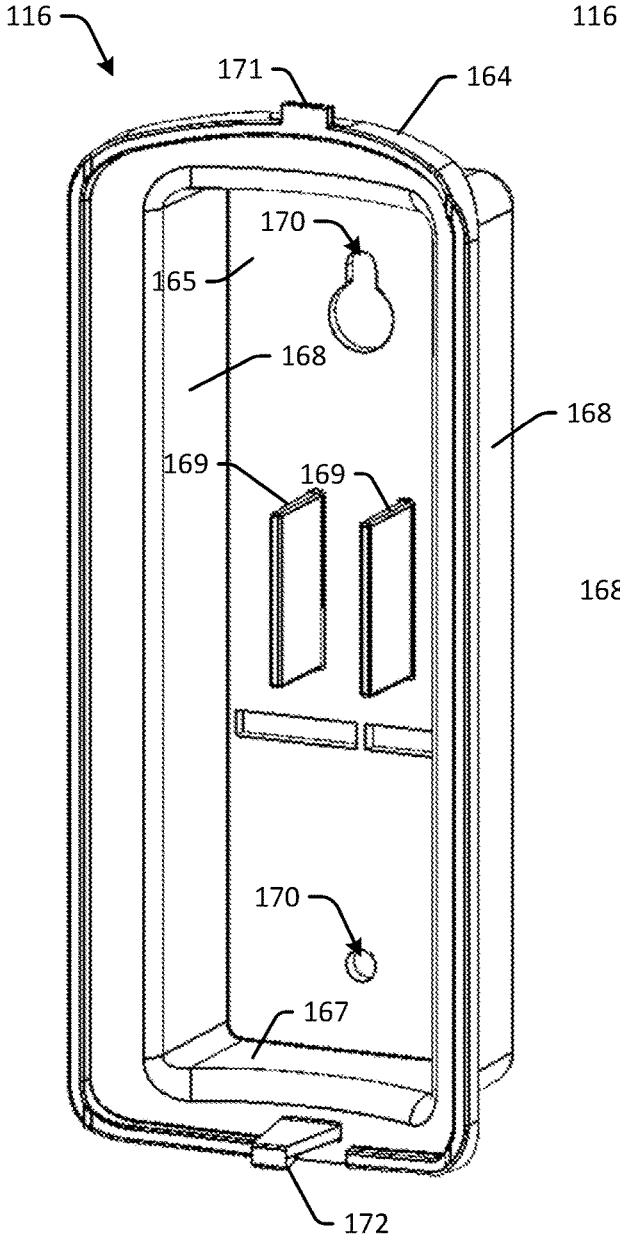
FIG. 1T is a front perspective view of a sixth housing portion of the dispenser of FIG. 1A.
Figure 1U:
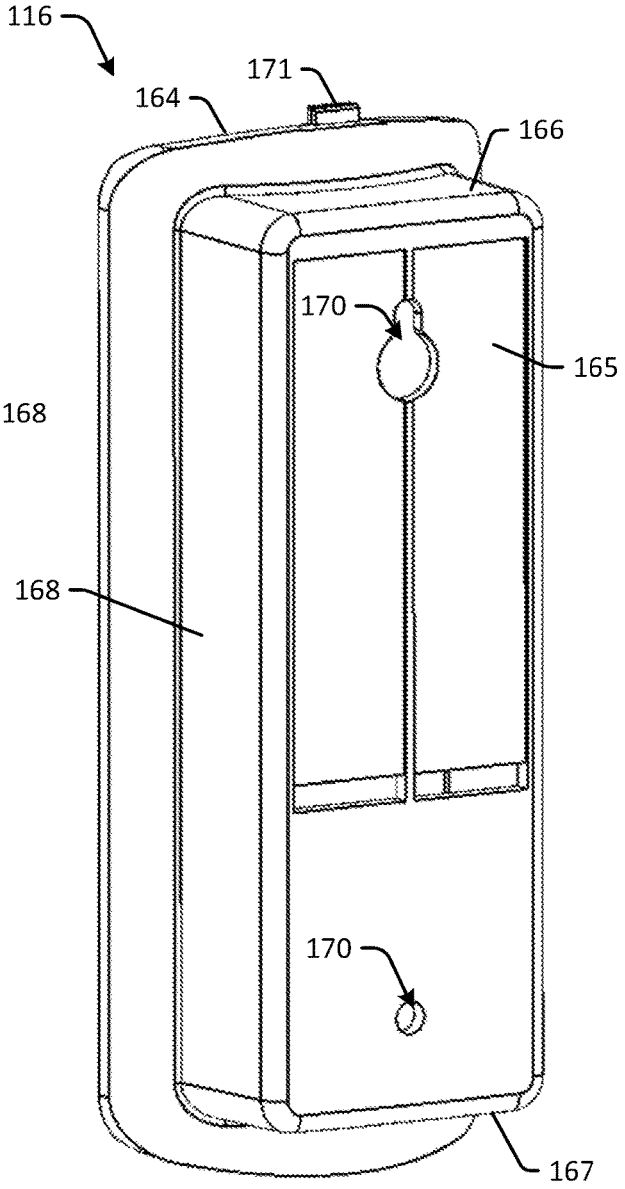
FIG. 1U is a back perspective view of the sixth housing portion of the dispenser of FIG. 1A.
Figure 1V:
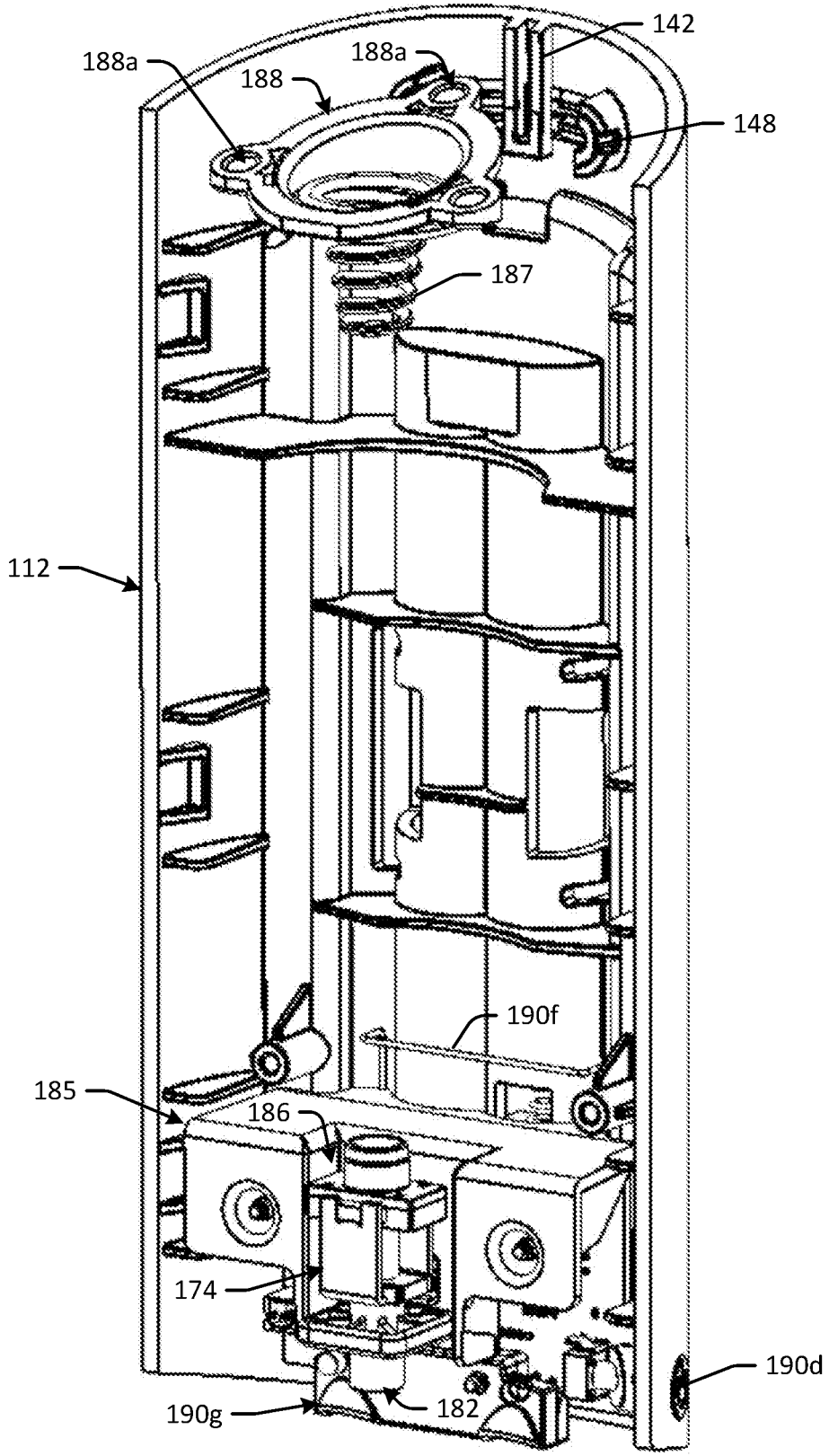
FIG. 1V is a front perspective view of a portion of the dispenser of FIG. 1A, showing the second housing portion, a biasing member, a solenoid valve assembly, a dispensing nozzle, an electronics module, and a sensor module of the dispenser.
Figure 1W:
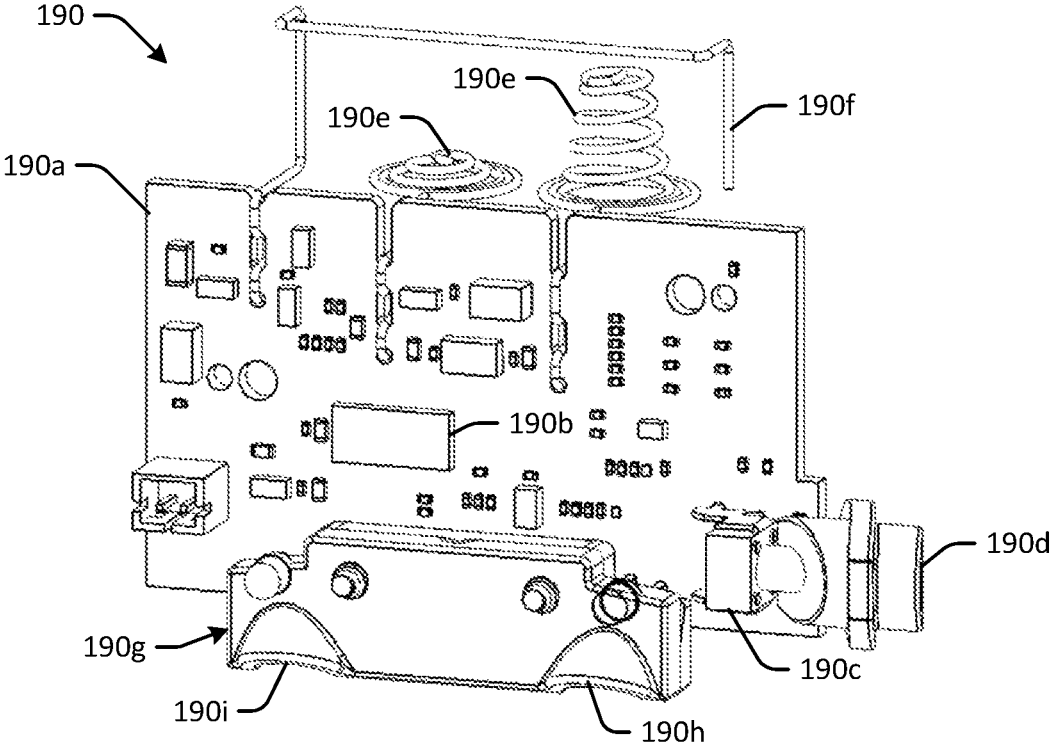
FIG. 1W is a front perspective view of the electronics module and the sensor module of the dispenser of FIG. 1A.
Figure 1X:
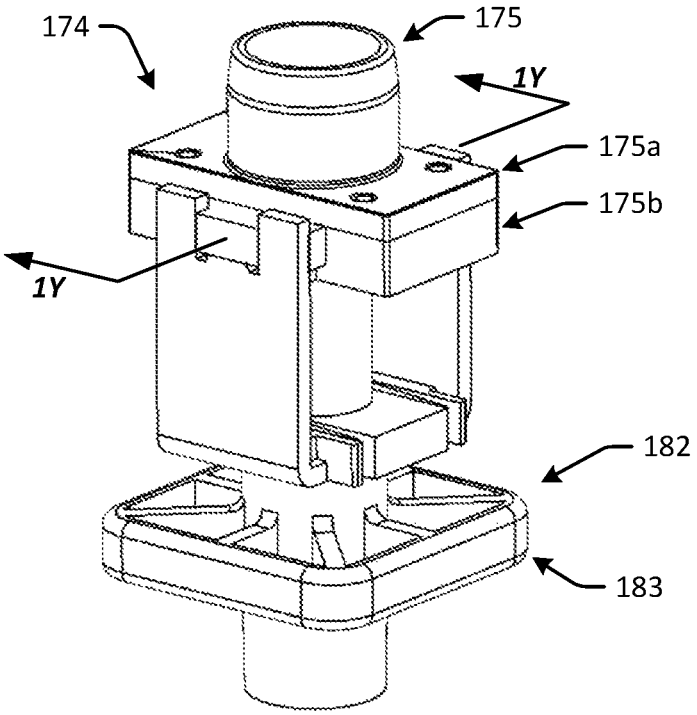
FIG. 1X is a front perspective view of the solenoid valve assembly and the dispensing nozzle of the dispenser of FIG. 1A.
Figure 1Y:
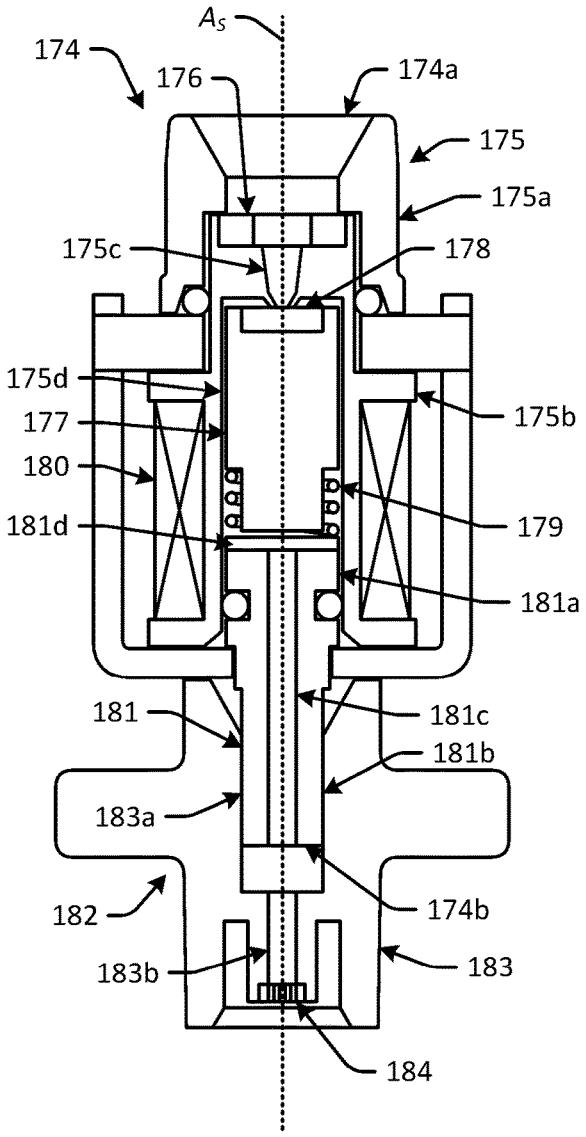
FIG. 1Y is a cross-sectional side view of the solenoid valve assembly and the dispensing nozzle of the dispenser of FIG. 1A, taken along line 1Y-1Y of FIG. 1X, showing the solenoid valve assembly in a deactivated configuration.
Figure 1Z:
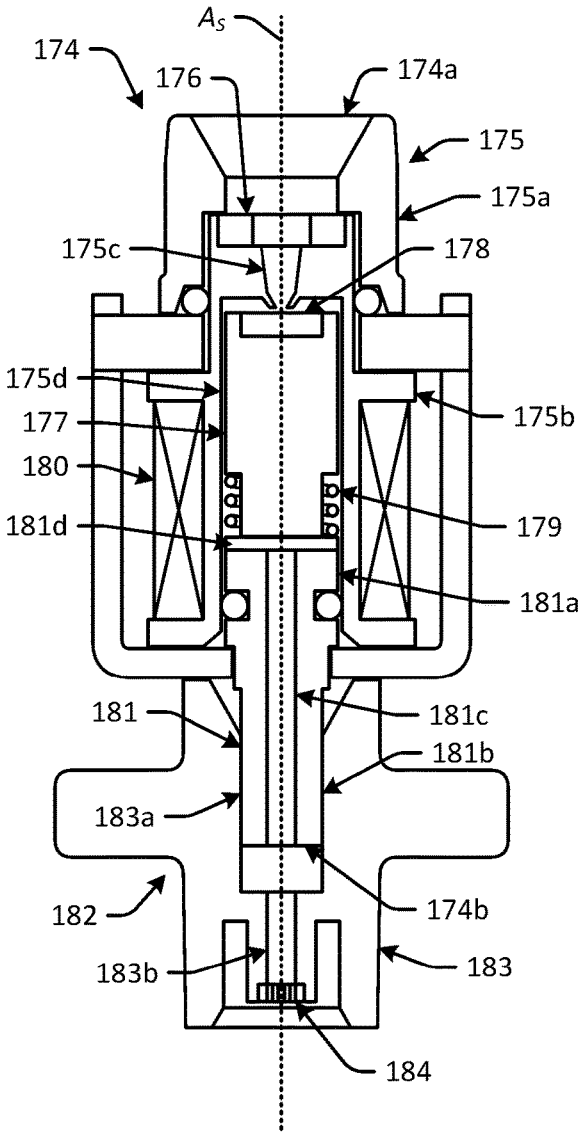
FIG. 1Z is a cross-sectional side view of the solenoid valve assembly and the dispensing nozzle of the dispenser of FIG. 1A, taken along line 1Y-1Y of FIG. 1X, showing the solenoid valve assembly in an activated configuration.

FIGS. 1A-1Z illustrate an automated flowable material dispenser 100 (which also may be referred to as a "flowable material dispenser," an "automated dispenser," or a "dispenser") according to one or more embodiments of the disclosure. The automated flowable material dispenser 100 is configured to dispense flowable material from a supply of flowable material supported thereby. For example, the dispenser 100 may be configured to dispense flowable material from a flowable material container 200, as described below with respect to FIGS. 2A-3D. In certain applications, the dispenser 100 may be associated with a sheet product dispenser in a particular operating environment, such as a bathroom, a wash station, or other environment used for personal hygiene or cleaning purposes. The dispenser 100 may be mounted to, positioned adjacent to, or positioned near the sheet product dispenser, such that a user may dispense a portion of sheet product from the sheet product dispenser and then dispense an amount of flowable material from the dispenser 100 onto the sheet product for subsequent use. In this manner, the dispenser 100 may allow the user to moisten the sheet product with the flowable material for improved personal hygiene or cleaning use. As described below, the dispenser 100 may include an automated dispensing mechanism having a robust and relatively simple configuration that includes a limited number of components for dispensing the flowable material from the replaceable flowable material container 200, may ensure that a substantially consistent amount of the flowable material is dispensed during each dispense cycle, may be able to dispense the entire, or substantially the entire, supply of flowable material from the container 200, may control the dispensing pattern of the flowable material such that the flowable material may be evenly applied to the sheet product or other substrate, may allow the depleted container 200 to be quickly and easily replaced with a new prefilled container 200, and/or may ensure that the container 200 is properly installed to allow desired operation of the automated dispensing mechanism.

Figure 2A:
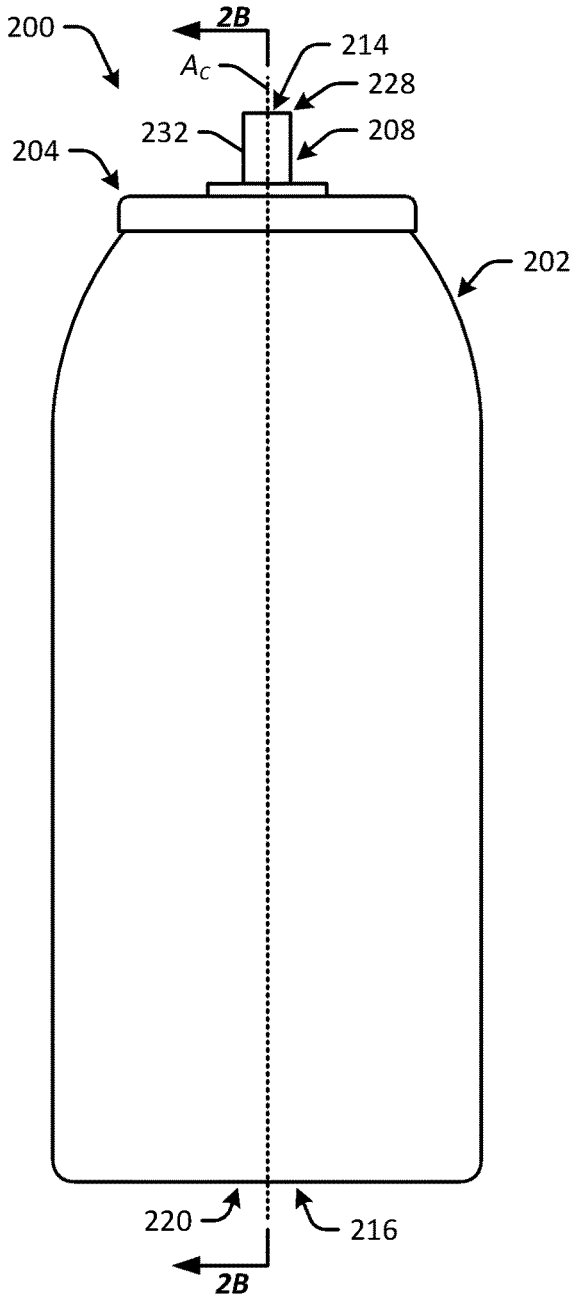
FIG. 2A is a front view of a flowable material container in accordance with one or more embodiments of the disclosure, showing a container body, a container cap, and a valve assembly of the container.
Figure 2B:
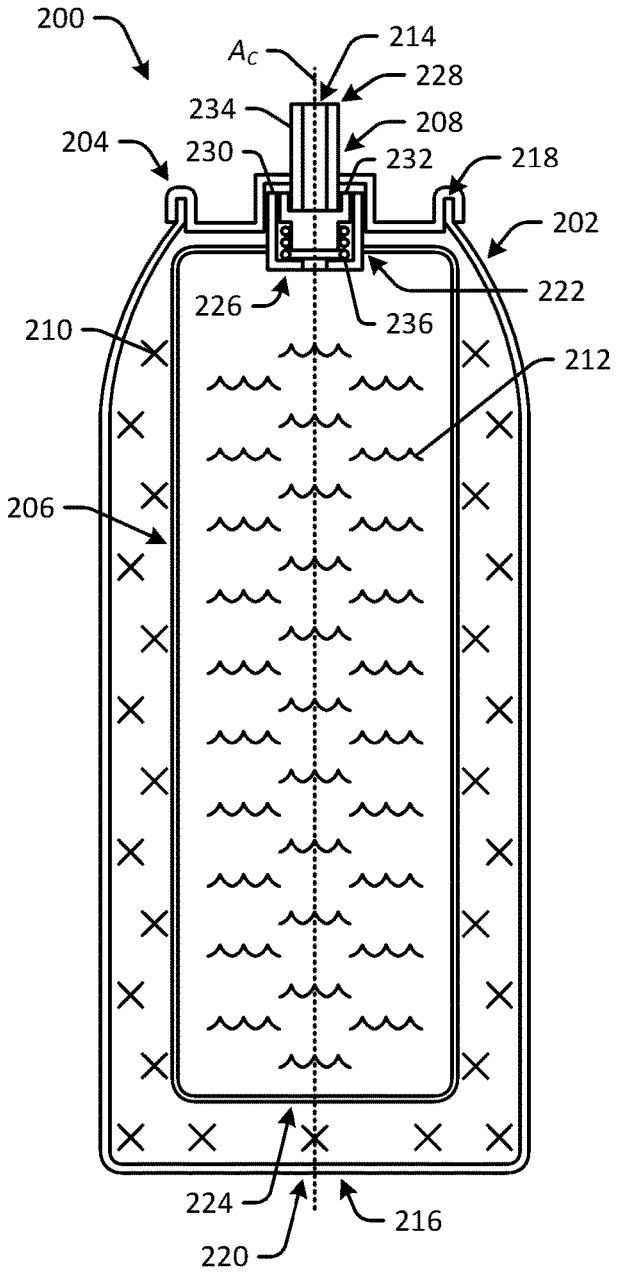
FIG. 2B is a cross-sectional side view of the flowable material container of FIG. 2A, taken along line 2B-2B of FIG. 2A, showing the container body, the container cap, the valve assembly, and a container reservoir of the container.

FIGS. 2A and 2B illustrate a flowable material container 200 (which also may be referred to as a "refill container," a "refill," a "pressurized container," or a "container") according to one or more embodiments of the disclosure. The flowable material container 200 is configured to contain a flowable material and to allow the flowable material to be dispensed therefrom. In particular, the container 200 may be used with the automated flowable material dispenser 100 to dispense the flowable material therefrom, as described below. The container 200 may be a pressurized container. For example, the container 200 may be a bag-on-valve container or an aerosol container. As shown, the container 200 may include a body 202 (which also may be referred to as a "container body" or a "can"), a cap 204 (which also may be referred to as an "container cap" or a "cover"), a reservoir 206 (which also may be referred to as a "container reservoir" or a "bag"), a valve assembly 208 (which also may be referred to as a "container valve assembly"), a pressurized gas 210, and a flowable material 212. The container 200 may have an elongated shape defining a longitudinal axis $A_C$ extending between a first end 214 (which also may be referred to as an "outlet end") and a second end 216 (which also may be referred to as a "base end") of the container 200.

As shown, the body 202 may be formed as an elongated, hollow member having a substantially cylindrical shape, with an open end 218 and a closed end 220. In this manner, the body 202 may define an interior space for containing other components of the container 200. In certain embodiments, the body 202 may be rigid or substantially rigid. In certain embodiments, the body 202 may be formed of a metal. As shown, the pressurized gas 210 may be contained within the body 202 outside of the reservoir 206. In other words, the pressurized gas 210 may surround the reservoir 206. As described below, the pressurized gas 210 may facilitate release of the flowable material 212 from the container 200. In certain embodiments, the pressurized gas 210 may be air, although other types of gases may be used.

The cap 204 may be positioned over the open end 218 of the body 202 to substantially enclose the interior space of the body 202 and other components positioned therein. As shown, the cap 204 may be formed as a contoured, substantially disc-shaped member. The cap 204 may be attached, either fixedly or removably, to the body 202. In certain embodiments, as shown, the cap 204 may be fixedly crimped onto the open end 218 of the body 202. In certain embodiments, the cap 204 may be rigid or substantially rigid. In certain embodiments, the cap 204 may be formed of a metal.

The reservoir 206 may be positioned within the body 202, and the flowable material 212 may be contained within the reservoir 206. As shown, the reservoir 206 may be formed as an elongated, hollow member having an open end 222 and a closed end 224. In this manner, the reservoir 206 may define an interior space for containing the flowable material 212 therein. In certain embodiments, the reservoir 206 may be flexible. In this manner, the shape of the reservoir 206 may change depending on a volume of the flowable material 212 contained therein. For example, the reservoir 206 may be formed as a flexible bag. In certain embodiments, the reservoir 206 may be formed of a plastic. In certain embodiments, the reservoir 206 may be impermeable to the pressurized gas 210 and the flowable material 212. In this manner, the reservoir 206 may provide a barrier between the pressurized gas 210 and the flowable material 212. In certain embodiments, the flowable material 212 may be a liquid, such as a cleansing liquid, although other types of flowable materials may be used. In certain embodiments, a volume of the flowable material 212 contained within the reservoir 206 (prior to use of the container 200) may be approximately 3.0 ounces, although other volumes of the flowable material 212 may be used.

In certain embodiments, as shown, the valve assembly 208 may be positioned at least partially within the body 202 and at least partially outside of the body 202. As shown, the valve assembly 208 may be formed as an elongated structure having an inlet end 226 and an outlet end 228, with the inlet end 226 being positioned within the body 202 and the outlet end 228 being positioned outside of the body 202. In other embodiments, the valve assembly 208 may be positioned entirely within the body 202, with the inlet end 226 and the outlet end 228 both being positioned within the body 202. The valve assembly 208 may be in fluid communication with the reservoir 206 and configured to receive the flowable material 212 therefrom. For example, the valve assembly 208 may be attached to the open end 222 of the reservoir 206, with the inlet end 226 of the valve assembly 208 being positioned within the reservoir 206. The valve assembly 208 may be configured to control release of the flowable material 212 from the container 200. In certain embodiments, as shown, the valve assembly 208 may have a male configuration. As shown, the valve assembly 208 may include a valve body 230 (which also may be referred to as a "valve housing"), a female valve stem 232 (which also may be referred to as a "first valve stem"), a male valve stem 234 (which also may be referred to as a "second valve stem"), and a biasing member 236 (which also may be referred to as a "spring"). The female valve stem 232 and the male valve stem 234 may be configured to translate relative to the valve body 230 between an extended position, as shown in FIGS. 2A and 2B, and a retracted position in which the female valve stem 232 and the male valve stem 234 are depressed relative to the cap 204 and positioned closer to the reservoir 206. Movement of the female valve stem 232 and the male valve stem 234 from the extended position to the retracted position may result in actuation of the valve assembly 208 (i.e., release of the flowable material 212 from the reservoir 206 and through the valve assembly 208). In this manner, the container 200 may be moved from an unactuated configuration (which also may be referred to as a "closed configuration") to an actuated configuration (which also may be referred to as an "open configuration") by moving the female valve stem 232 and the male valve stem 234 relative to the valve body 230. In certain embodiments, the biasing member 234, which may be formed as a spring, may be configured to engage the female valve stem 232 and to bias the female valve stem 232 and the male valve stem 234 toward the extended position. In this manner, the container 200 may assume the unactuated configuration absent external forces moving the female valve stem 232 and the male valve stem 234 toward the retracted position. When the container 200 is moved from the unactuated configuration to the actuated configuration, the pressurized gas 210 may apply pressure to the reservoir 206, which may drive the flowable material 212 out of the reservoir 206 and through the valve assembly 208. In certain embodiments, the valve assembly 208 may have a female configuration in which the male valve stem 234 is omitted. In such embodiments, the valve assembly 208 may be actuated by movement of the female valve stem 232 from the extended position to the retracted position.

Other features and attributes of the flowable material container 200 and its components will be appreciated from the corresponding drawings and the functional description of the container provided herein. Further, it will be appreciated that the flowable material container 200 described above and depicted in FIGS. 2A and 2B is merely one example of a container suitable for use with the automated flowable material dispenser 100, and that other types of pressurized containers may be used with the dispenser 100. For example, although the illustrated flowable material container 200 is formed as a bag-on-valve container, the flowable material container 200 alternatively may be formed as an aerosol container.

Returning to FIGS. 1A-1Z, the automated flowable material dispenser 100 may have an elongated shape, with a front side 101, a back side 102, a top end 103, and a bottom end 104. The dispenser 100 may include a housing 110 configured to contain the flowable material container 200 and various components of the dispenser 100 therein. As shown, the housing 100 may include a first housing portion 111 ("which also may be referred to as a "front interior housing portion"), a second housing portion 112 ("which also may be referred to as a "back interior housing portion"), a third housing portion 113 ("which also may be referred to as a "top exterior housing portion" or a "top cover"), a fourth housing portion 114 ("which also may be referred to as a "bottom exterior housing portion" or a "bottom cover"), a fifth housing portion 115 ("which also may be referred to as a "front exterior housing portion" or a "front cover"), and a sixth housing portion 116 ("which also may be referred to as a "back exterior housing portion" or a "back cover"). The housing portions 111, 112, 113, 114, 115, 116 may be rigid or substantially rigid and may be formed of a plastic material, although other suitable materials may be used. As shown, the housing portions 111, 112, 113, 114, 115, 116 may be separately formed and attached to one another, as described below.

The first housing portion 111, as shown in detail in FIGS. 1J and 1K, may be formed as an elongated member including various features for supporting the flowable material container 200 and engaging other portions of the housing 110. The first housing portion 111 may include a front wall 121, a back wall 122, a bottom wall 123, and a pair of side walls 124. As shown, the first housing portion 111 may include a container receptacle 125 defined along the interior side thereof and configured to receive a portion of the flowable material container 200 therein. In certain embodiments, as shown, a plurality of support ribs 126 may extend along the container receptacle 125 and be configured to support the flowable material container 200, such as the body 202 thereof, in a vertical orientation. The support ribs 126 may have a curved shape for accommodating the curvature of the container 200. The first housing portion 111 also may include a solenoid receptacle 127 defined along the interior side thereof and configured to receive a portion of a solenoid valve assembly of the dispenser 100 and a nozzle receptacle 128 defined along the interior side thereof and configured to receive a portion of a dispensing nozzle of the dispenser 100, as described further below.

As shown, the first housing portion 111 may be attached to the second housing portion 112, the third housing portion 113, the fourth housing portion 114, and the fifth housing portion 115. The first housing portion 111 may include a plurality of first tabs 129 extending from the side walls 124 and configured to engage mating protrusions of the second housing portion 112. As shown, each of the first tabs 129 may include a recess 130 defined therein and configured to receive a portion of the mating protrusion. The first housing portion 111 may include an aperture 131 extending through the front wall 121 at or near the top end thereof and configured to receive a mating arm of the third housing portion 113, as described below. The first housing portion 111 also may include a plurality of protrusions 132 extending from the interior sides of the side walls 124 near the bottom ends thereof and configured to engage mating tabs of the fourth housing portion 114. As shown, the protrusions 132 may have a ramped shape to facilitate a snap-fit connection. The first housing portion 111 may further include one or more second tabs 133 positioned along the front wall 121 and configured to engage a mating protrusion of the fifth housing portion 115, and a plurality of slots 134 defined in the side walls 124 and configured to engage mating tabs of the fifth housing portion 115. The second tab 133 may be a spring tab, as shown, to facilitate a snap-fit connection. In this manner, the first housing portion 111 may be removably attached to the second housing portion 112, the third housing portion 113, the fourth housing portion 114, and the fifth housing portion 115, as shown. Other features and attributes of the first housing portion 111 will be appreciated from the corresponding drawings and the functional description of the first housing portion 111 provided herein.

The second housing portion 112, as shown in detail in FIGS. 1L and 1M, may be formed as an elongated member including various features for supporting the flowable material container 200 as well as the solenoid valve assembly and electronic components of the dispenser 100 and engaging other portions of the housing 110. The second housing portion 112 may include a back wall 135 and a pair of side walls 136. As shown, the second housing portion 112 may include a container receptacle 137 defined along the interior side thereof and configured to receive a portion of the flowable material container 200 therein. In certain embodiments, as shown, a plurality of support ribs 138 may extend along the container receptacle 137 and be configured to support the flowable material container 200, such as the body 202 thereof, in a vertical orientation. The support ribs 138 may have a curved shape for accommodating the curvature of the container 200. The second housing portion 112 also may include an electronics receptacle 139 defined along the interior side thereof and configured to receive an electronics module of the dispenser 100, as described further below. The second housing portion 112 further may include a battery receptacle 140 defined along the exterior side of the back wall 135 and configured to receive a plurality of batteries therein for powering the dispenser 100. In certain embodiments, the battery receptacle 140 may be configured to receive four (4) AA cell Alkaline batteries therein for powering the dispenser 100.

As shown, the second housing portion 112 may be attached to the first housing portion 111, the third housing portion 113, the fourth housing portion 114, and the sixth housing portion 116. The second housing portion 112 may include a plurality of first protrusions 141 extending from the side walls 136 and configured to engage the first tabs 129 of the first housing portion 111 and be received within the respective recesses 130 of the first tabs 129. As shown, the first protrusions 141 may have a ramped shape to facilitate a snap-fit connection. The second housing portion 112 may include one or more second protrusions 142 extending from the interior side of the back wall 135 near the top end thereof and configured to engage a mating tab of the third housing portion 113. The second housing portion 112 also may include one or more third protrusions 143 extending from the interior side of the back wall 135 near the bottom end thereof and configured to engage a mating tab of the fourth housing portion 114. The second housing portion 112 further may include a plurality of openings 144 defined in the back wall 135 and configured to engage mating tabs of the sixth housing portion 116. As shown, one of the openings 144 may be positioned near the top end of the back wall 135 and one of the openings 144 may be positioned near the bottom end of the back wall 135. In this manner, the second housing portion 112 may be removably attached to the first housing portion 111, the third housing portion 113, the fourth housing portion 114, and the sixth housing portion 116, as shown. Other features and attributes of the second housing portion 112 will be appreciated from the corresponding drawings and the functional description of the second housing portion 112 provided herein.

The third housing portion 113, as shown in detail in FIGS. 1N and 1O, may be formed as a generally circular member including various features for engaging other portions of the housing 110. The third housing portion 113 may include a top wall 145. As shown, the third housing portion 113 may be attached to the first housing portion 111 and the second housing portion 112. In certain embodiments, as shown, the third housing portion 113 may be pivotably attached to the first housing portion 111. For example, the third housing portion 113 may include a pivot arm 146 that extends from the interior side of the top wall 145 and is received within the aperture 131 of the first housing portion 111. The pivot arm 146 may be coupled to the first housing portion 111 via a pin, thereby forming a hinge, such that the third housing portion 113 may be moved between a closed position and an open position. In this manner, the housing 110 may be moved between a closed configuration (i.e., when the third housing portion 113 is in the closed position) for use of the dispenser 100 and an open configuration (i.e., when the third housing portion 113 is in the open position) for loading the flowable material container 200 into the housing 110.

The third housing portion 113 also may include a tab 147 extending from the interior side of the top wall 145 and configured to engage the second protrusion 142 of the second housing portion 112. As shown, the tab 147 may be a deflectable spring tab to facilitate a snap-fit connection. In certain embodiments, as shown, the tab 147 may engage the second protrusion 142 when the third housing portion 113 is in the closed position. In this manner, the engagement between the tab 147 and the second protrusion 142 may maintain the third housing portion 113 in the closed position. In certain embodiments, as shown, the dispenser 100 may include a release button 148 configured to disengage the tab 147 from the second protrusion 142. The release button 148 may be configured to move between an extended position, as shown in FIG. 1E, and a depressed position in which the button 148 is moved further into the housing 100. When the release button 148 is moved from the extended position to the depressed position, the button 148 may move the tab 147 out of engagement with the second protrusion 142, thereby allowing the third housing portion 113 to move from the closed position to the open position. In certain embodiments, as shown, the release button 148 may be positioned above the hinge formed between the pivot arm 146 and the first housing portion 111. The third housing portion 113 further may include a plurality of posts 149 extending from the interior side of the top wall 145 and configured for attaching a biasing member of the dispenser 100 to the third housing portion 113, as described below. Other features and attributes of the third housing portion 113 will be appreciated from the corresponding drawings and the functional description of the third housing portion 113 provided herein.

The fourth housing portion 114, as shown in detail in FIGS. 1P and 1Q, may be formed as a generally circular member including various features for facilitating dispensing of the flowable material from the dispenser 100 and engaging other portions of the housing 110. The fourth housing portion 114 may include a bottom wall 150, a front wall 151, and a back wall 152. As shown, the fourth housing portion 114 may include a dispensing opening 153 extending through the bottom wall 150 and configured to allow the flowable material to be dispensed therethrough from the container 200. A dispensing guide 154 may extend around the dispensing opening 153 and be configured to control the dispensing pattern of the flowable material passing therethrough. As shown, the dispensing guide 154 may have a frustoconical shape to facilitate a conical spray pattern of the flowable material. The fourth housing portion 114 also may include a sensor opening 155 extending through the bottom wall 150 and configured to allow a sensor module positioned within the housing 110 to detect the presence of a user's hand, or a substrate such as a sheet product held by a user's hand, positioned below the dispenser 100. A sensor support 156 may extend around the sensor opening 155 and be configured to support the sensor module thereon.

As shown, the fourth housing portion 114 may be attached to the first housing portion 111 and the second housing portion 112. The fourth housing portion 114 may include a plurality of first tabs 157 extending from interior surface of the bottom wall 150 and configured to engage the protrusions 132 of the first housing portion 111. As shown, the first tabs 157 may be deflectable spring tabs to facilitate a snap-fit connection. The fourth housing portion 114 also may include one or more second tabs 158 extending from the interior surface of the bottom wall 150 and configured to engage the third protrusion 143 of the second housing portion 112. As shown, the second tab 158 may be a deflectable spring tab to facilitate a snap-fit connection. In this manner, the fourth housing portion 114 may be removably attached to the first housing portion 111 and the second housing portion 112, as shown. When attached, the front wall 151 and the back wall 152 may be positioned between the first housing portion 111 and the second housing portion 112, and the bottom wall 150 may abut the bottom ends of the first housing portion 111 and the second housing portion 112, as shown. Other features and attributes of the fourth housing portion 114 will be appreciated from the corresponding drawings and the functional description of the fourth housing portion 114 provided herein.

The fifth housing portion 115, as shown in detail in FIGS. 1R and 1S, may be formed as an elongated member including various features for engaging other portions of the housing 110. The fifth housing portion 115 may include a front wall 159 and a pair of side walls 160. As shown, the fifth housing portion 115 may be attached to the first housing portion 111. The fifth housing portion 115 may include a plurality of tabs 161 extending from the interior surfaces of the side walls 160 and configured to engage and be received within the respective slots 134 of the first housing portion 111. The fifth housing portion 115 also may include one or more protrusions 162 extending from the interior surface of the front wall 159 and configured to engage the second tab 133 of the first housing portion 111. In this manner, the fifth housing portion 115 may be removably attached to the first housing portion 111, as shown. Other features and attributes of the fifth housing portion 115 will be appreciated from the corresponding drawings and the functional description of the fifth housing portion 115 provided herein.

The sixth housing portion 116, as shown in detail in FIGS. 1T and 1U, may be formed as an elongated member including various features for cooperating with the batteries, engaging other portions of the housing 110, and mounting the dispenser 100 to a support structure. The sixth housing portion 116 may include a front wall 164, a back wall 165, a top wall 166, a bottom wall 167, and a pair of side walls 168. As shown, the sixth housing portion 116 may include a plurality of support ribs 169 extending vertically along the interior surface of the back wall 165 and configured to engage and support the batteries positioned within the battery receptacle 140 of the second housing portion 112. In this manner, the support ribs 169 may ensure that the batteries remain properly positioned within the dispenser 100. The sixth housing portion 116 also may include a plurality of openings 170 extending through the back wall 165 and configured to facilitate attachment of the sixth housing portion 116 to a support structure, such as a vertical wall of a building. The openings 170 each may be configured to allow a fastener, such as a screw, to extend therethrough and engage the support structure for securely mounting the dispenser 100 thereto.

As shown, the sixth housing portion 116 may be attached to the second housing portion 112. The sixth housing portion 116 may include a first tab 171 extending from the top end of the front wall 164, and a second tab 172 extending from the interior surface of the front wall 164 near the bottom end thereof. The first tab 171 may be configured to engage and be received within the top opening 144 of the second housing portion 112, and the second tab 172 may be configured to engage and be received within the bottom opening 144 of the second housing portion 112. As shown, the second tab 172 may be a deflectable spring tab to facilitate a snap-fit connection. In this manner, the sixth housing portion 116 may be removably attached to the second housing portion 112, as shown. Other features and attributes of the sixth housing portion 116 will be appreciated from the corresponding drawings and the functional description of the sixth housing portion 116 provided herein.

As shown in FIGS. 1E, 1H, 1I, 1V, and 1X-1Z, the dispenser 100 may include a solenoid valve assembly 174 configured to engage the flowable material container 200 and facilitate dispensing of the flowable material 212 therefrom. As described below, the solenoid valve assembly 174 may be configured to move between a deactivated configuration and an activated configuration in order to dispense the flowable material 212 from the dispenser 100 during a dispense cycle. As shown, the solenoid valve assembly 174 may have an elongated shape defining a longitudinal axis $A_S$ extending between a first end 174*a* (which also may be referred to as an "inlet end") and a second end 174*b* (which also may be referred to as an "outlet end"). The solenoid valve assembly 174 may include a solenoid housing 175, an inlet seal 176, a piston 177, a piston seal 178, a biasing member 179, a winding 180, and an outlet stem 181.

As shown, the solenoid housing 175 may include a first portion 175*a* and a second portion 175*b* attached to one another and configured to contain other components of the solenoid valve assembly 174 therein. The first portion 175*a* may be positioned about the first end 174*a* of the solenoid valve assembly 174 and configured to receive a portion of the flowable material container 200 therein. In particular, the first portion 175*a* may be configured to receive an end portion of the male valve stem 234 therein. The inlet seal 176 may be positioned within the solenoid housing 175 and retained between the first portion 175*a* and the second portion 175*b*. In certain embodiments, the inlet seal 176 may be a ring-shaped gasket formed of an elastomeric material. The inlet seal 176 may be configured to engage the end of the male valve stem 234 and form a face seal therewith. When the flowable material container 200 is in the actuated configuration, the flowable material 212 may flow from the male valve stem 234, through the inlet seal 176, and into an inlet passage 175*c* of the solenoid housing 175.

The piston 177 may be formed as a cylindrical member positioned within a bore 175*d* of the solenoid housing 175. As shown, the piston 177 may be configured to translate within the bore 175*d* between a deactivated position (which also may be referred to as a "closed position"), as shown in FIG. 1Y, and an activated position (which also may be referred to as an "open position"), as shown in FIG. 1Z. The piston seal 178 may be a disc-shaped member formed of an elastomeric material. As shown, the piston seal 178 may be attached to the piston 177 and configured to close fluid communication between the inlet passage 175*c* and the bore 175*d* when the piston 177 is in the deactivated position. In particular, when the piston 177 is in the deactivated position, the piston seal 178 may engage a portion of the solenoid housing 175 surrounding the inlet passage 175*c* and form a face seal therewith. When the piston 177 is in the activated position, the piston seal 178 may be spaced apart from the inlet passage 175*c*, such that the flowable material 212 may flow from the inlet passage 175*c*, into the bore 175*d*, and around the piston 177. The biasing member 179 may be positioned within the bore 175*d* and retained between the piston 177 and the outlet stem 181. As shown, the biasing member 179 may be configured to bias the piston 177 toward the deactivated position. In certain embodiments, the biasing member 179 may be formed as a helical compression spring. The winding 180 may be wrapped around the solenoid housing 175 and configured to be energized by electrical current provided by the batteries of the dispenser 100. When electrical current is applied to the winding 180, magnetic induction may cause the piston 177 to overcome the biasing force provided by the biasing member 179 and move from the deactivated position to the activated position.

The outlet stem 181 may be formed as an elongated tubular member having a first portion 181*a* positioned within the bore 175*d* of the solenoid housing 175 and a second portion 181*b* positioned outside of the solenoid housing 175. As shown, the outlet stem 181 may include an outlet passage 181*c* extending therethrough. When the piston 177 is in the activated position, the flowable material 212 may flow from the bore 175*d* and through the outlet passage 181*c*. In certain embodiments, when the piston 177 is in the activated position, the bottom end of the piston 177 may engage the top end of the outlet stem 181, as shown in FIG. 1Z. In such embodiments, the outlet stem 181 may include a channel 181*d* extending along the top end of the outlet stem 181 and in fluid communication with the outlet passage 181*c*. In this manner, if the piston 177 is maintained in the activated position for an extended period of time, the flowable material 212 still may flow continuously from the bore 175*c* and through the outlet passage 181*c*. In other embodiments, the biasing member 179 may be configured such that the bottom end of the piston 177 may be spaced apart from the top end of the outlet stem 181 when the piston 177 is in the activated position. In this manner, if the piston 177 is maintained in the activated position for an extended period of time, the flowable material 212 still may flow continuously from the bore 175*c* and through the outlet passage 181*c*.

As shown in FIGS. 1E, 1G-1I, 1V, and 1X-1Z, the dispenser 100 also may include a dispensing nozzle 182 configured to dispense the flowable material 212 in a desired spray pattern. The dispensing nozzle 182 may be attached to the second end 174*b* of the solenoid valve assembly 174. As shown, the dispensing nozzle 182 may include a nozzle body 183 and a nozzle insert 184 attached to the nozzle body 183. The nozzle body 183 may include an inlet passage 183*a* defined therein, and the second portion 181*b* of the outlet stem 181 may be positioned at least partially within the inlet passage 183*a*. In this manner, the flowable material 212 may flow from the outlet passage 181*c* of the outlet stem 181 and into the inlet passage 183*a* of the nozzle body 183. The nozzle body 183 also may include an outlet passage 183*b* in communication with the inlet passage 183*a*, and the nozzle insert 184 may be positioned adjacent the outlet passage 183*b*. In this manner, the flowable material 212 may flow through the outlet passage 183*b* to the nozzle insert 184. The nozzle insert 184 may include a plurality of apertures defined therethrough and configured to emit the flowable material 212 in a desired spray pattern. In certain embodiments, each aperture of the nozzle insert 184 may have a diameter of approximately 0.3 mm, although other sizes of the apertures may be used. In certain embodiments, the solenoid valve assembly 174 and the dispensing nozzle 182 may be configured to produce a circular spray pattern of the flowable material 212 onto a substrate held by a user's hand underneath the dispensing opening 153 of the dispenser 100. In certain embodiments, the circular spray pattern may have a diameter of between approximately 2.5 inches and approximately 3.5 inches, or approximately 3.0 inches, when the substrate is positioned 4 inches below the dispensing opening 153.

Positioning of the solenoid valve assembly 174 and the dispensing nozzle 182 within the housing 110 may be facilitated by the first housing portion 111 and a solenoid support 185. As described above, the first housing portion 111 may include the solenoid receptacle 127 for receiving a portion of the solenoid valve assembly 174 therein and the nozzle receptacle 128 for receiving a portion of the dispensing nozzle 182 therein. In particular, a portion of the solenoid housing 175 may be securely received within the solenoid receptacle 127 between adjacent horizontal ribs thereof, and a portion of the nozzle body 183 may be securely received within the nozzle receptacle 128 between adjacent horizontal ribs thereof. In this manner, the solenoid receptacle 127 and the nozzle receptacle 128 may inhibit vertical movement of the solenoid valve assembly 174 and the dispensing nozzle 182 relative to the housing 110. As shown in FIG. 1V, the solenoid support 185 may be positioned behind the solenoid valve assembly 174 and the dispensing nozzle 182 opposite the first housing portion 111. The solenoid support 185 may include a mating receptacle 186 for receiving respective portions of the solenoid valve assembly 174 and the dispensing nozzle 182 therein. As shown, the solenoid support 185 may be fixedly attached to the first housing portion 111, for example, by one or more fasteners. In this manner, the solenoid valve assembly 174 and the dispensing nozzle 182 may be captured between the first housing portion 111 and the solenoid support 185 to inhibit horizontal movement of the solenoid valve assembly 174 and the dispensing nozzle 182 relative to the housing 110, as shown in FIG. 1E.

As shown in FIGS. 1E, 1H, 1I, and 1V, the dispenser 100 may include a biasing member 187 (which also may be referred to as a "container biasing member," a "container actuator member," or an "actuator member") that is configured to engage the flowable material container 200 when the container 200 is positioned within the housing 110. The biasing member 187 may be attached to the housing 110. In some embodiments, the biasing member 187 may be indirectly attached to the housing 110 by an intermediate component. For example, the biasing member 187 may be attached to the third housing portion 113 by a biasing member support 188, as shown. The biasing member 187 may be fixedly attached to the support 188, for example, by welding or by one or more fasteners, and may extend downwardly therefrom. The biasing member support 188 may include a plurality of apertures 188*a* configured to receive the respective posts 149 of the third housing portion 113, and the free ends of the posts 149 may be deformed, as shown in FIG. 1O, such that the support 188 is fixedly attached to the third housing portion 113 by the posts 149. In this manner, the biasing member 187 may move along with third housing portion 113 when the housing 110 is moved between the closed configuration and the open configuration. In other embodiments, the biasing member 187 may be directly attached to the housing 110, such as the third housing portion 113, for example, by welding or by one or more fasteners. In some embodiments, for example, the biasing member 187 may be attached to a portion of the housing 110 other than the third housing portion 113.

In certain embodiments, the biasing member 187 may be a compressible member that is configured to be compressed and store energy when an external force is applied to the compressible member. For example, the biasing member 187 may be a helical compression spring, such as a conical compression spring, as shown. As another example, the biasing member 187 may be an elastomeric member or a foam member that is configured to be compressed or resiliently deformed from a natural state to a compressed or deformed state. In other embodiments, the biasing member 187 may be a spring arm that is configured to be deflected and store energy when an external force is applied to the spring arm to move the spring arm from a natural state to a deflected state. In still other embodiments, the biasing member 187 may be a lever that is configured to be moved from a first position to a second position when an external force is applied to the lever. Various other configurations of the biasing member 187 or other types of members for biasing the flowable material container 200 toward the solenoid valve assembly 174 and moving the flowable material container 200 from the unactuated configuration to the actuated configuration may be used.

As explained further below with respect to FIGS. 3B and 3C, the biasing member 187 may be configured to engage the flowable material container 200 when the container 200 is positioned within the housing 110. In certain embodiments, as shown, the biasing member 187 may be configured to engage the flowable material container 200 when the container 200 is positioned within the housing 110 and the housing 110 is in the closed configuration. In particular, the biasing member 187 may be configured to bias the flowable material container 200 toward the solenoid valve assembly 174 when the housing 110 is in the closed configuration. In this manner, the biasing force provided by the biasing member 187 may cause the flowable material container 200 to move from the unactuated configuration to the actuated configuration when the housing 110 is moved from the open configuration to the closed configuration. In other embodiments, the biasing member 187 may be configured to engage the flowable material container 200 when the container 200 is positioned within the housing 110, regardless of whether the housing 110 is in the open configuration or the closed configuration. For example, the biasing member 187 may be configured to bias the flowable material container 200 toward the solenoid valve assembly 174 when container 200 is positioned within the housing 110 and the biasing member 187 engages the container. In this manner, the biasing force provided by the biasing member 187 may cause the flowable material container 200 to move from the unactuated configuration to the actuated configuration when container 200 is positioned within the housing 110 and the biasing member 187 engages the container. In some embodiments, as shown, the biasing member 187 also may be configured to facilitate movement of the housing 110 from the closed configuration to the open configuration when the flowable material container 200 is positioned within the housing 110. In particular, when the release button 148 is moved to the depressed position such that the tab 147 of the third housing portion 113 disengages the second protrusion 142 of the second housing portion 112, energy stored by the biasing member 187 (i.e., energy stored due to compression, deflection, or movement of the biasing member 187) may cause the third housing portion 113 to automatically move from its closed position to its open position. The resulting disengagement of the biasing member 187 from the flowable material container 200 also may cause the container 200 to move from its actuated configuration to its unactuated configuration.

As shown in FIGS. 1H, 1I, 1V, and 1W, the dispenser 100 also may include an electronics module 190 positioned within the housing 110. In certain embodiments, the electronics module 190 may be attached to the second housing portion 112, for example, by one or more fasteners. As shown in detail in FIG. 1W, the electronics module 190 may include a printed circuit board (PCB) 190*a* having a number of electronic components mounted thereon and in operable communication with one another via the PCB 190*a*. For example, an electronic controller 190*b* may be mounted to the PCB 190*a* and operable to control operation of the dispenser 100 and the electronic components thereof. The PCB 190*a* may include at least one memory that stores computer-executable instructions for carrying out the various functions and operations of the electronics module 190 described herein. The electronic controller 190*b* may include at least one processor that is configured to access the at least one memory and to execute the computer-executable instructions to carry out the various functions and operations of the electronics module 190 described herein. A switch 190*c* (which also may be referred to as an "on-off switch") also may be mounted to the PCB 190*a* and operable to control an operating state (i.e., between an "on state" and an "off state") of the dispenser 100. Power may be supplied from the batteries to components of the electronics module 190 when the switch 190*c* is in an on position, and power from the batteries to the components of the electronics module 190 may be discontinued when the switch 190*c* is moved from the on position to an off position. A power button 190*d* may be coupled to the switch 190*c* and configured to move the switch 190*c* between the on position and the off position. As shown in FIG. 1V, the power button 190*d* may extend at least partially through a mating opening defined in the housing 110 and be accessible for actuation by a user. In certain embodiments, the power button 190*d* may provide a visual indication corresponding to the operating state of the dispenser 100. For example, the power button 190*d* may include a light-emitting diode (LED) and a translucent cover positioned over the LED. The LED may emit a first color of light, such as blue light, when the dispenser 100 is in the on state, and the LED may emit a second color of light, such as red light, when the dispenser 100 is in the off state. In certain embodiments, upon a user depressing the power button 190*d*, the LED may flash the first color of light a first number of times, such as three times, when the dispenser 100 is in the on state, and the LED may flash the second color of light a second number of times, such as two times, when the dispenser 100 is in the off state. In other embodiments, the LED may periodically flash the color of light corresponding to the respective state of the dispenser 100, without any interaction between a user and the power button 190*d*.

As shown in FIG. 1W, a plurality of battery contacts 190*e* also may be mounted to the PCB 190*a* and configured to supply power from the batteries to the components of the electronics module 190. Respective portions of the battery contacts 190*e* may extend from the PCB 190*a* to the battery receptacle 140 of the second housing portion 112 for engaging the batteries therein. As shown, the electronics module 190 also may include a capacitive sensor 190*f* configured to detect the presence of the flowable material container 200 within the housing 110. In certain embodiments, as shown, the capacitive sensor 190*f* may be a capacitive antenna extending from the PCB 190*a* to a location adjacent the container receptacle 137 of the second housing portion. The capacitive sensor 190*f* may detect the presence of a newly-loaded flowable material container 200 and send a signal indicating the presence of the newly-loaded container 200 to the electronic controller 190*b*. As described further below, upon receiving the signal, the electronic controller 190*b* may control operation of the solenoid valve assembly 174 to ensure that a substantially constant volume of the flowable material 212 is dispensed during each dispense cycle of the dispenser 100. Although the illustrated embodiment includes the capacitive sensor 190*f* for detecting the presence of the flowable material container 200, in other embodiments, alternative types of sensors or other means for detecting the presence of the flowable material container 200 within the housing 110 may be used as a part of the electronics module 190. In some embodiments, a tactile or mechanical switch may be positioned within the housing 110 and configured to engage the flowable material container 200 when the container 200 is loaded within the housing 110 or when the container 200 is loaded within the housing 110 and the housing 110 is in the closed configuration. For example, the flowable material container 200 may engage the switch when the container 200 is positioned within the housing 110 or when the container 200 has been moved from the unactuated configuration to the actuated configuration by the biasing member 187. Upon engaging the container 200, the switch may detect the presence of a newly-loaded flowable material container 200 and send a signal indicating the presence of the newly-loaded container 200 to the electronic controller 190*b*. Still other types of sensors, switches, or other mechanisms may be used to detect the presence of the flowable material container 200 within the housing 110.

As shown in FIG. 1W, the electronics module 190 further may include an infrared (IR) sensor 190*g* mounted to the PCB 190*a*. The IR sensor 190*g* may be configured to detect the presence of a user's hand, or a substrate such as a sheet product held by a user's hand, positioned below the dispenser 100. In certain embodiments, as shown, the IR sensor 190*g* may be an active infrared sensor. As shown, the IR sensor 190*g* may include an IR emitter 190*h* and an IR receiver 190*i*. The IR emitter 190*h* may be configured to pulse so as to determine if the feedback from the IR receiver 190*i* is being washed out by ambient light. The IR sensor 190*g* may be positioned above the sensor opening 155 of the fourth housing portion 114 and may rest on the sensor support 156. In certain embodiments, the IR sensor 190*g* may have a detectable range of between approximately 1.5 inches and approximately 5.0 inches. In certain embodiments, the IR sensor 190*g* may be configured to avoid "ghosting" or becoming non-responsive when exposed to external interference, such as direct sunlight, sound infrared beacons, or electromagnetic interference.

When the dispenser 100 is in the on state and the IR sensor 190*g* detects the presence of a user's hand or a substrate held by a user's hand, the electronic controller 190*b* may be operable to direct the solenoid valve assembly 174 to carry out one or more dispense cycles. In certain embodiments, the electronic controller 190*b* may be operable to direct the solenoid valve assembly 174 to carry out multiple dispense cycles, one after another, until the IR sensor 190*g* no longer detects the user's hand or the substrate held by the user's hand or until a predetermined maximum number of consecutive dispense cycles has been reached. In this manner, the user may continuously dispense the flowable material 212 to obtain a desired amount. In certain embodiments, the predetermined maximum number of consecutive dispense cycles may be five (5), although other numbers may be used. If the predetermined maximum number of consecutive dispense cycles is met, the electronic controller 190*b* may cause the solenoid valve assembly 174 to remain in the deactivated configuration until the IR sensor 190*g* is cleared. If the user desires to obtain additional flowable material 212, the user's hand or the substrate held by the user's hand must be removed from the detectable range of the IR sensor 190*g* and reinserted within the detectable range, thereby causing the dispenser 100 to resume dispensing of the flowable material 212.

Each dispense cycle of the dispenser 100 may include an on time (which also may be referred to as an "open time," an "activated time," or a "dispense time"), during which the solenoid valve assembly 174 is in the activated configuration, and an off time (which also may be referred to as a "closed time," a "deactivated time," or a "dwell time"), during which the solenoid valve assembly 174 is in the deactivated configuration. In this manner, the flowable material 212 may be dispensed from the dispenser 100 during the on-time portion of the dispense cycle, and dispensing of the flowable material 212 may be discontinued for the off-time portion of the dispense cycle. The electronic controller 190*b* may be operable to control the dispense cycles such that each dispense cycle has a common duration, although respective durations of the on-time portion and the off-time portion of the dispense cycle may be varied by the controller 190*b*, as described below. In certain embodiments, the duration of each dispense cycle may be one (1) second, although other durations may be used. Other features and attributes of the electronics module 190 and the components thereof will be appreciated from the corresponding drawings and the functional description of these components provided herein.

It will be appreciated that the volume of flowable material 212 dispensed from the dispenser 100 during a particular dispense cycle may depend on the duration of the on time as well as the pressure within the flowable material container 200 (i.e., the pressure of the pressurized gas 210 contained within the body 202). Throughout a life of the flowable material container 200, the pressure within the container 200 may decrease in a linear manner with respect to the number of dispense cycles completed. In particular, as the volume of the body 202 occupied by the flowable material 212 decreases due to dispensing of the material 212, the pressure of the pressurized gas 210 may decrease as the volume of the body 202 occupied by the gas 210 increases. Accordingly, if the duration of the on time was kept constant for all dispense cycles, the volume of the flowable material 212 dispensed would continuously decrease, from one dispense cycle to a subsequent dispense cycle, throughout the life of the flowable material container 200. Such variability of the dispensed volume may result in user frustration as one dispense cycle early in the life of the container 200 may provide the user with a desired amount of the flowable material 212, while another dispense cycle later in the life of the container 200 may provide less than the desired amount.

The dispenser 100 advantageously may dispense a substantially constant volume of the flowable material 212 during each dispense cycle throughout the life, or at least a majority of the life, of a particular flowable material container 200. In particular, the electronic controller 190*b* may be operable to automatically adjust the duration of the on time for dispense cycles throughout the life of a particular flowable material container 200. The electronic controller 190*b* also may be operable to automatically adjust the duration of the off time for dispense cycles throughout the life of the flowable material container 200, such that the overall duration of each dispense cycle remains constant throughout the life of the container 200. In this manner, the electronic controller 190*b* may accommodate the decrease in pressure within the flowable material container 200 and dispense a substantially constant volume of the flowable material 212 during each dispense cycle throughout the life of the container. In certain embodiments, the pressure within the container 200 may range from approximately 100 psi at the beginning of the life of the container 200 (i.e., prior to dispensing any of the flowable material 212 therefrom) to approximately 30 psi at the end of the life of the container 200 (i.e., after all or substantially all of the flowable material 212 has been dispensed therefrom). In certain embodiments, the volume of the flowable material 212 dispensed from the dispenser 100 per dispense cycle may range from approximately 0.30 ml to approximately 0.35 ml throughout the life of the container 200.

As described above, the capacitive sensor 190*f* may be configured to detect the presence of a new flowable material container 200 loaded into the dispenser 100. In particular, upon insertion of the flowable material container 200 into the housing 110, the capacitive sensor 190*f* may detect the container 200 and send a signal indicating the presence of the container 200 to the electronic controller 190*b*. Upon receiving the signal from the capacitive sensor 190*f*, the electronic controller 190*b* may start a counter of a number of dispense cycles carried out using the flowable material container 200. In other words, after each dispense cycle completed with the flowable material container 200, the electronic controller 190*b* may increase the counter by an increment of one (1) such that the counter corresponds to the number of completed dispense cycles for the container 200.

The electronic controller 190*b* may access a lookup table stored at the at least one memory of the PCB 190*a* or at a data storage otherwise accessible to the electronic controller 190*b*. The lookup table may include a plurality of entries, with each entry including a dispense cycle value, an on-time value, and an off-time value. The dispense cycle value may be a numerical integer value corresponding to a particular dispense cycle during the life of the container 200. The on-time value may be a numerical value corresponding to an on time for the respective dispense cycle value. The off-time value may be a numerical value corresponding to an off time for the respective dispense cycle value. For example, a first entry of the lookup table may include a dispense cycle value of one (1), an on-time value of 0.248 seconds, and an off-time value of 0.752 seconds. As another example, a final entry of the lookup table may include a dispense cycle value of two-hundred and fifty-two (252), an on-time value of 0.457 seconds, and an off-time value of 0.543 seconds. In certain embodiments, one or more groups of successive entries of the lookup table may have the same on-time values and the same off-time values. For example, each entry of a first group of entries may have an on-time value of 0.248 seconds and an off-time value of 0.752 seconds, and each entry of a subsequent second group of entries may have an on-time value of 0.249 seconds, and an off-time value of 0.751 seconds. In other embodiments, each entry of the lookup table may have a different on-time value and a different off-time value as compared to the values of the other entries.

For each dispense cycle carried out with the flowable material container 200, the electronic controller 190*b* may access the lookup table to determine the on time and the off time for the dispense cycle. For example, for the first dispense cycle, the electronic controller 190*b* may use the first entry of the lookup table to determine the on time of 0.248 seconds and the off time of 0.752 seconds. The electronic controller 190*b* then may cause the solenoid valve assembly 174 to move to the activated configuration and remain in the activated configuration for 0.248 seconds to dispense a volume of the flowable material 212 from the dispenser 100 for the first dispense cycle. In particular, the electronic controller 190*b* may cause the winding 180 of the solenoid valve assembly 174 to be energized by current provided from the batteries such that the piston 177 moves from the deactivated position to the activated position for dispensing. In certain embodiments, the dispensed volume of the flowable material 212 may be between approximately 0.30 ml and approximately 0.35 ml. After the on time has elapsed, the electronic controller 190*b* may cause the solenoid valve assembly 174 to move to the deactivated configuration and remain in the deactivated configuration for 0.752 seconds for the first dispense cycle. In particular, the electronic controller 190*b* may cause the current provided to the winding 180 to be discontinued such that the piston 177 moves from the activated position to the deactivated position via the biasing force provided by the biasing member 179. During the off time of the dispense cycle, the solenoid valve assembly 174 may remain in the deactivated position even if the user's hand or a substrate held by the user's hand remains within the detectable range of the IR sensor 190*g*. After the off time has elapsed, a second dispense cycle may be carried out if the user's hand or a substrate held by the user's hand remains within the detectable range of the IR sensor 190*g*. The electronic controller 190*b* may control the second dispense cycle, and subsequent dispense cycles, in a manner similar to that described above by using the lookup table to determine respective on times and off times to ensure that a substantially constant volume of the flowable material 212 is dispensed during each dispense cycle throughout the life of the container 200.

At the end of the life of the flowable material container 200, the container 200 may be removed from the dispenser 100, and a new flowable material container 200 may be loaded therein. As described above, the capacitive sensor 190*f* may detect the new container 200 and send a signal indicating the presence of the container 200 to the electronic controller 190*b*. Upon receiving the signal from the capacitive sensor 190*f*, the electronic controller 190*b* may reset the dispense cycle counter and control subsequent dispense cycles for the new container 200 using the lookup table. In certain instances, if the capacitive sensor 190*f* does not detect the new container 200 and/or the dispense cycle counter is not reset, the electronic controller 190*b* may revert to default parameters, including a default on time and a default off time, for subsequent dispense cycles. For example, if the dispense cycle counter reaches a predetermined maximum value, the electronic controller 190*b* may control subsequent dispense cycles using the default on time and the default off time. In certain embodiments, the predetermined maximum value may be three hundred and fifty (350), although other values may be used. In certain embodiments, the default on time may be 0.350 seconds, and the default off time may be 0.650 seconds, although other values may be used.

Figure 3A:
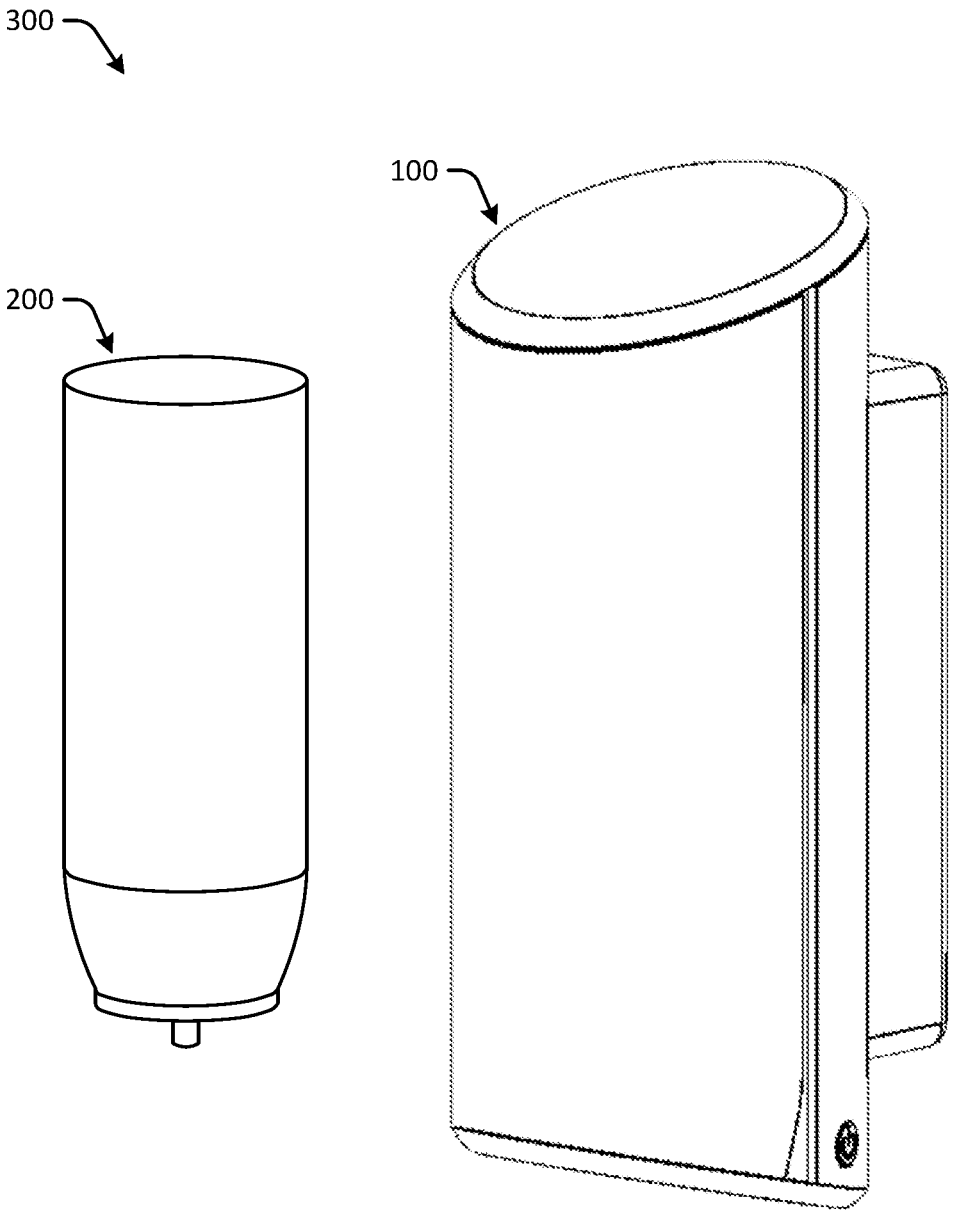
FIG. 3A is a front perspective view of an automated flowable material dispenser system in accordance with one or more embodiments of the disclosure, the system including the automated flowable material dispenser of FIG. 1A and the flowable material container of FIG. 2A.
Figure 3B:
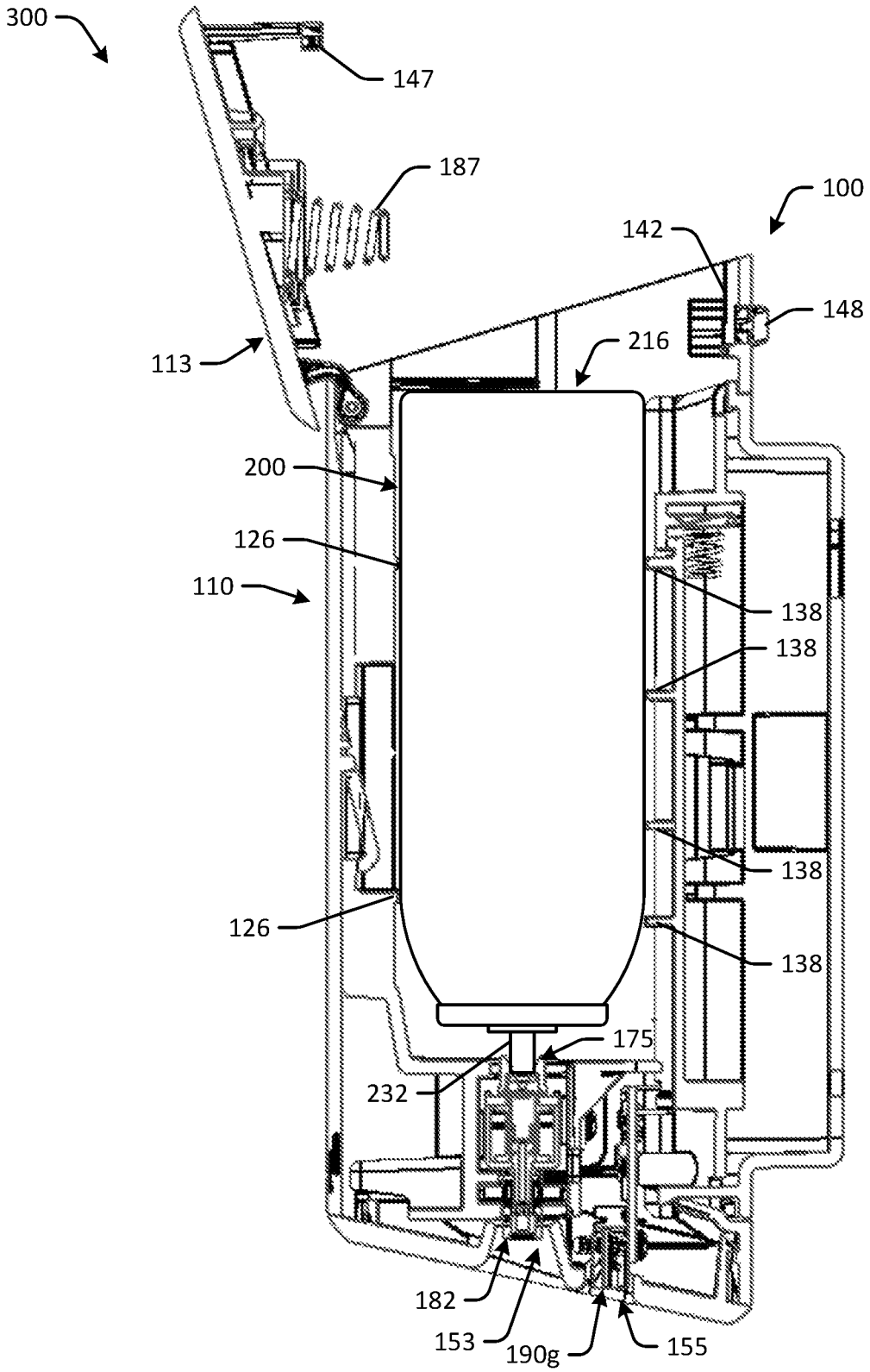
FIG. 3B is a partial cross-sectional side view of the system of FIG. 3A, showing the housing of the dispenser in an open configuration and the flowable material container in an unactuated configuration within the housing.
Figure 3C:
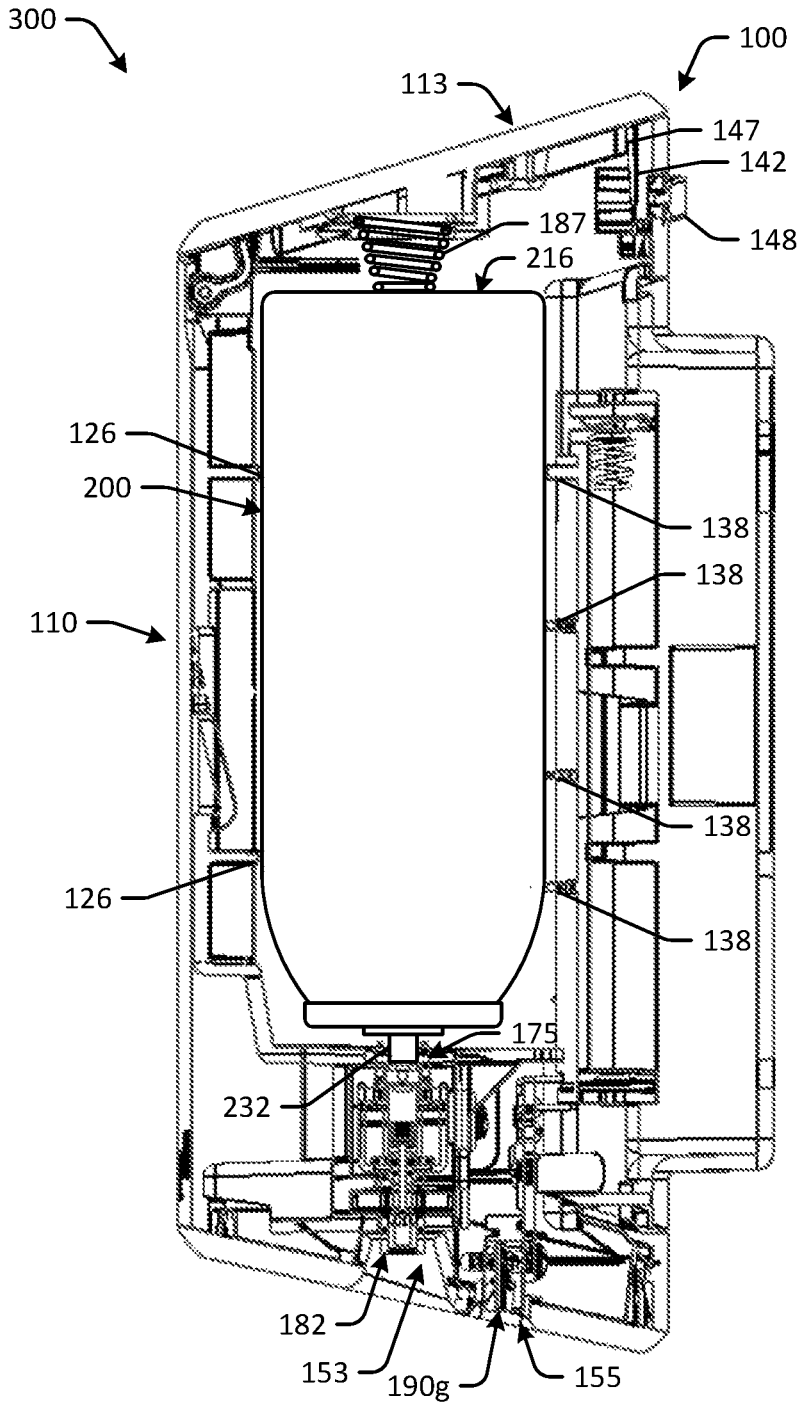
FIG. 3C is a partial cross-sectional side view of the system of FIG. 3A, showing the housing of the dispenser in a closed configuration and the flowable material container in an actuated configuration within the housing.

FIGS. 3A-3C illustrate an automated flowable material dispenser system 300 (which also may be referred to as a "dispenser system" or a "system") according to one or more embodiments of the disclosure. As shown, the automated flowable material dispenser system 300 may include the automated flowable material dispenser 100 and the flowable material container 200 described above. The container 200 may be prefilled with the flowable material 212, such as a liquid cleanser or an air freshener, although other types of flowable materials may be used. The container 200 may be loaded into the dispenser 100 by moving the housing 110 from the closed configuration, as shown in FIG. 3A, to the open configuration, as shown in FIG. 3B, and inserting the container 200 into the housing 110. As described above, the housing 110 may be moved from the closed configuration to the open configuration by moving the release button 148 from the extended position to the depressed position such that the tab 147 of the third housing portion 113 disengages the second protrusion 142 of the second housing portion 112. If an existing container 200 is present in the housing 110, energy stored by the compressed biasing member 187 may cause the third housing portion 113 to automatically move from its closed position to its open position. The existing container 200 may be removed from the housing 110, and the new container 200 may be inserted into the housing 110 in an inverted orientation, as shown in FIG. 3B. Proper positioning of the container 200 within the housing 110 may be facilitated by the container receptacles 125, 137 of the first and second housing portions 111, 112 and the support ribs 126, 138 thereof. As shown, an end portion of the male valve stem 234 of the container 200 may be received within the solenoid housing 175, and the end of the male valve stem 234 may engage the inlet seal 176 of the solenoid valve assembly 174. However, the container 200 may remain in the unactuated configuration upon insertion of the container 200 into the housing 110, while the housing 110 remains in the open configuration. The housing 110 then may be moved from the open configuration to the closed configuration, as shown in FIG. 3C. As the housing 110 is moved to the closed configuration, the biasing member 187 may engage the second end 216 of the container 200 and bias the container 200 toward the solenoid valve assembly 174. The biasing force provided by the biasing member 187 may move the container 200 from the unactuated configuration to the actuated configuration, as shown. In particular, while the male valve stem 234 remains positioned against the inlet seal 176 and the female valve stem 232 rests against the male valve stem 234, the remainder of the container 200 may move downward toward the solenoid valve assembly 174. As a result, the valve assembly 208 may be actuated and the flowable material 212 may flow out of the container 200 and into the solenoid valve assembly 174. The movement of the housing 110 to the closed configuration also may cause the tab 147 of the third housing portion 113 to engage the second protrusion 142 of the second housing portion 112, such that the housing 110 is maintained in the closed configuration.

During operation of the dispenser 100, the solenoid valve assembly 174 may move between the deactivated configuration and the activated configuration to carry out a dispense cycle. When the solenoid valve assembly 174 is in the activated configuration, a portion of the flowable material 212, under pressure by the pressurized gas 210 within the container, may flow through the solenoid valve assembly 174 and into the dispensing nozzle 182, as described above. The dispensing nozzle 182 may direct the portion of the flowable material 212 downward through the dispensing opening 153 of the housing 110 and out of the dispenser 100. As described above, the electronic controller 190*b* may initiate a dispense cycle upon receiving a signal from the IR sensor 190*g* indicating the presence of a user's hand or a substrate held by the user's hand within the detectable range of the IR sensor 190*g*. In this manner, the container 200 may remain in the actuated configuration while loaded within the housing 110, and the solenoid valve assembly 174 may control release of the flowable material 212 from the dispenser 100. Other aspects of operation of the system 300, the dispenser 100, and the container 200 will be appreciated from the corresponding drawings and the functional description provided herein.

Figure 3D:
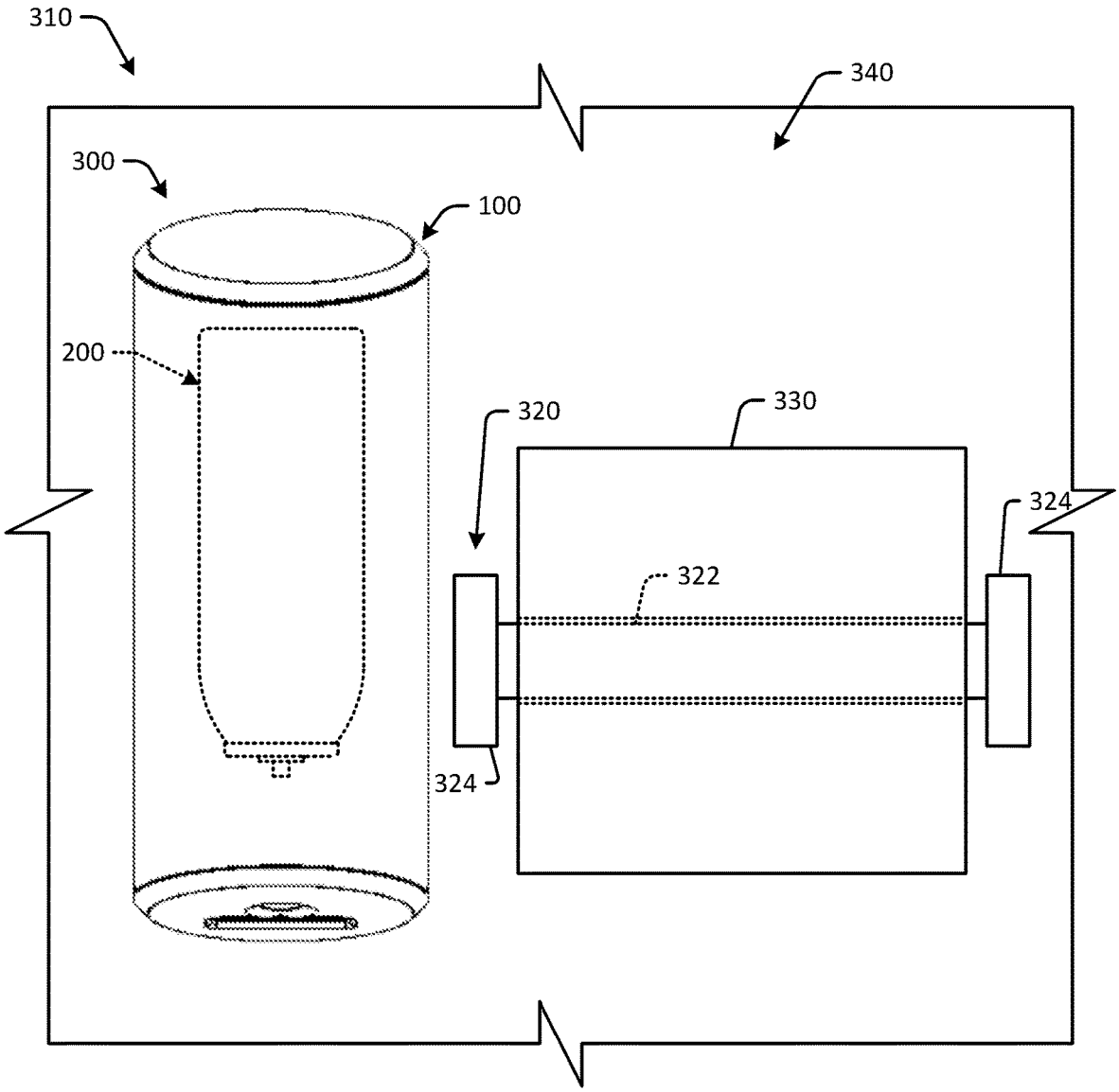
FIG. 3D is a front view of the system of FIG. 3A mounted to a wall adjacent a sheet product holder with a roll of sheet product loaded thereon.

FIG. 3D illustrates a flowable material and sheet product dispensing system 310 (which also may be referred to as a "dispensing system" or a "system") according to one or more embodiments of the disclosure. As shown, the flowable material and sheet product dispensing system 310 may include the automated flowable material dispenser 100 and the flowable material container 200 described above. The dispensing system 310 also may include a sheet product holder 320 and a roll of sheet product 330. As shown, the dispenser 100 and the sheet product holder 320 may be mounted to a support structure 340, such as a vertical wall, adjacent one another. In this manner, a user may dispense a portion of the sheet product 330 from the holder 320 and then dispense a portion of the flowable material 212 onto the sheet product 330 using the dispenser 100.

As shown, the sheet product holder 320 may include a spindle 322 for insertion through a central aperture of the roll of sheet product 330 and one or more support arms 324 for mounting the holder 320 to the support structure 340. As described above, the dispenser 100 may be mounted to the support structure 340 via the sixth housing portion 116 and one or more fasteners.

The flowable material 212 of the container 200 and the sheet product 330 may be specifically configured for use with one another. In certain embodiments, the flowable material 212 may be a liquid cleanser, and the sheet product 330 may be a bath tissue configured to absorb and retain the flowable material 212 for personal cleansing. In certain embodiments, the flowable material 212 may have a pH that is similar to the pH of human skin to reduce irritation to a user during personal cleansing.

The sheet product 330 may be configured to absorb the dispensed volume of the flowable material 212 and remain durable upon absorbing the flowable material. In certain embodiments, the sheet product 330 may have an absorbency of between approximately 350 $gm/m^2$ (grams of water absorbed per square meter) and approximately 550 $gm/m^2$, between approximately 400 $gm/m^2$ and approximately 500 $gm/m^2$, or approximately 450 $gm/m^2$. The sheet product 330 may be relatively strong when wetted with the flowable material 212, while remaining dispersible for disposal of the sheet product 330 after use.

FIGS. 4A-4D illustrate an automated flowable material dispenser 400 (which also may be referred to as a "flowable material dispenser," an "automated dispenser," or a "dispenser") according to one or more embodiments of the disclosure. The automated flowable material dispenser 400 is configured to dispense flowable material from a supply of flowable material supported thereby. In particular, the dispenser 400 may be configured to dispense flowable material from the flowable material container 200. It will be appreciated that the dispenser 400 is substantially similar to the dispenser 100 described above, with similar components and features identified by the same reference numbers. Notably, the dispenser 400 includes a sixth housing portion 416 instead of the sixth housing portion 116 described above.

Figure 4A:
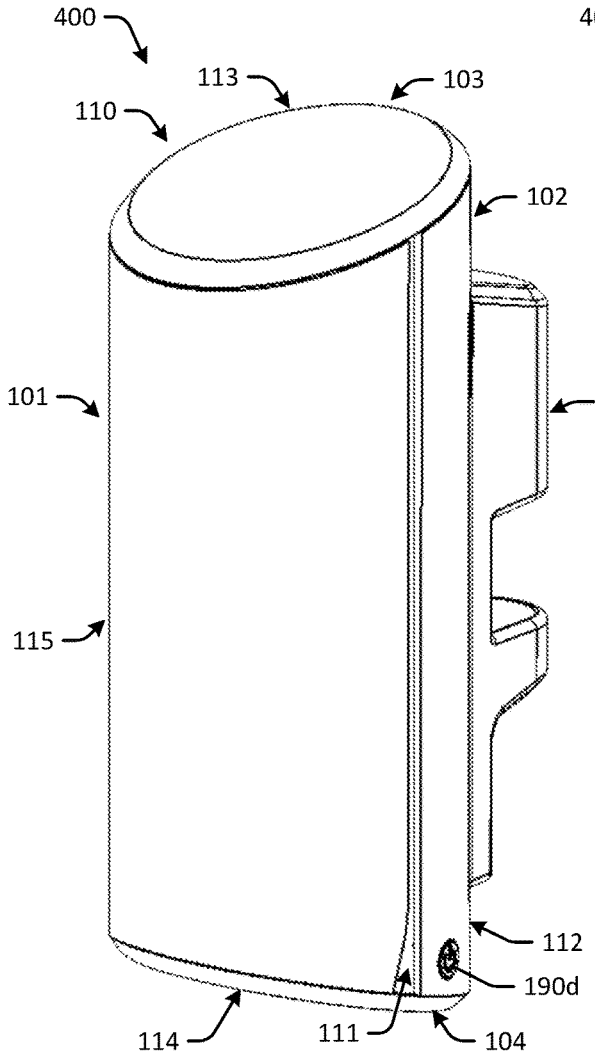
FIG. 4A is a front perspective view of an automated flowable material dispenser in accordance with one or more embodiments of the disclosure, showing a housing of the dispenser.
Figure 4B:
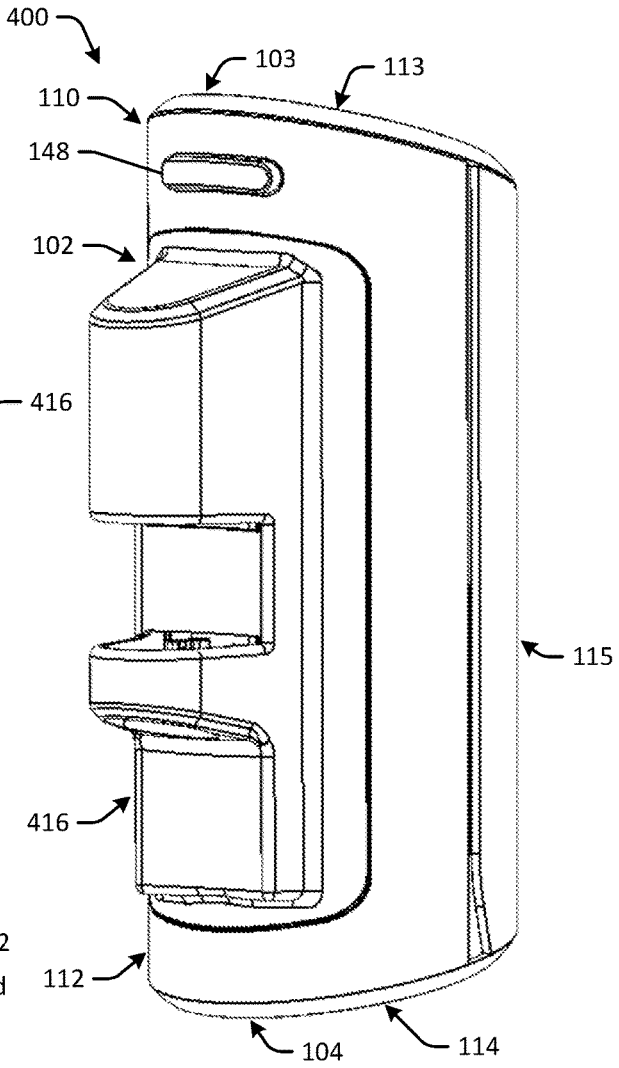
FIG. 4B is a back perspective view of the dispenser of FIG. 4A.
Figure 4C:
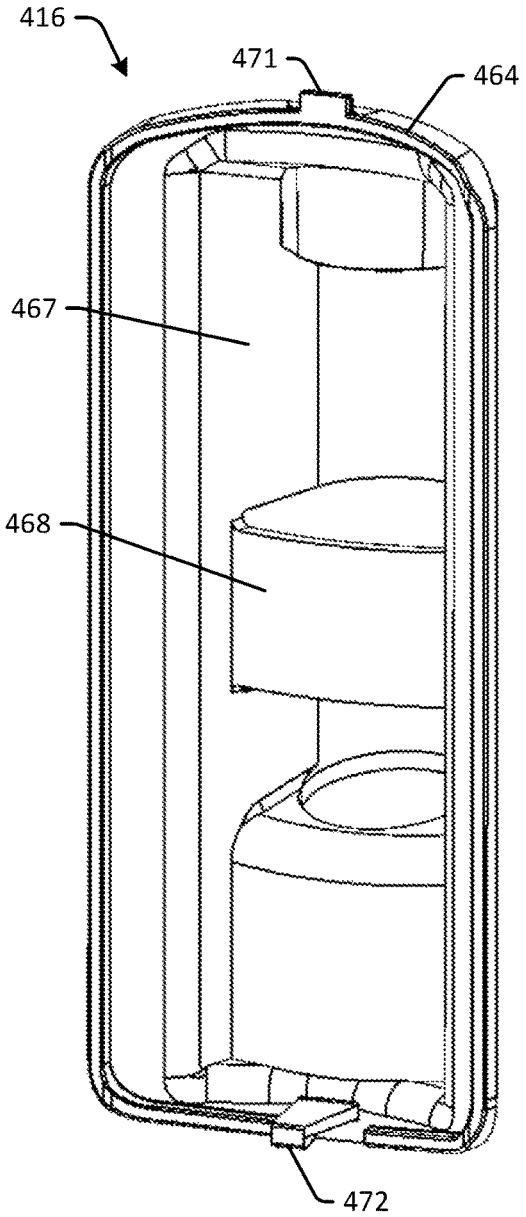
FIG. 4C is a front perspective view of a sixth housing portion of the dispenser of FIG. 4A.
Figure 4D:
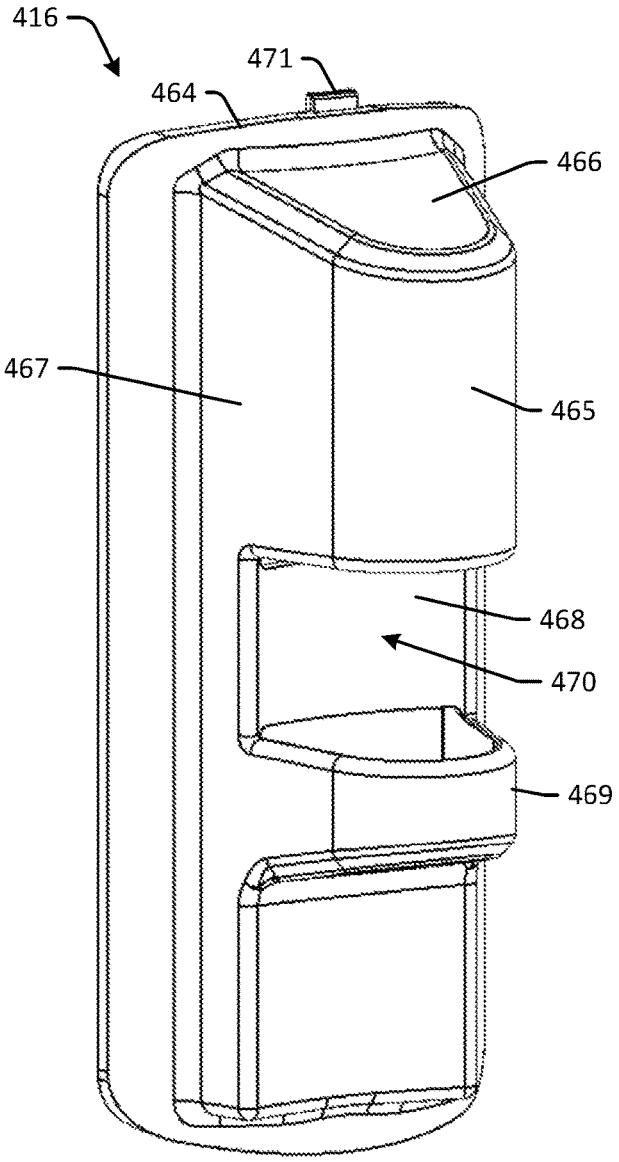
FIG. 4D is a back perspective view of the sixth housing portion of the dispenser of FIG. 4A.
Figure 4E:
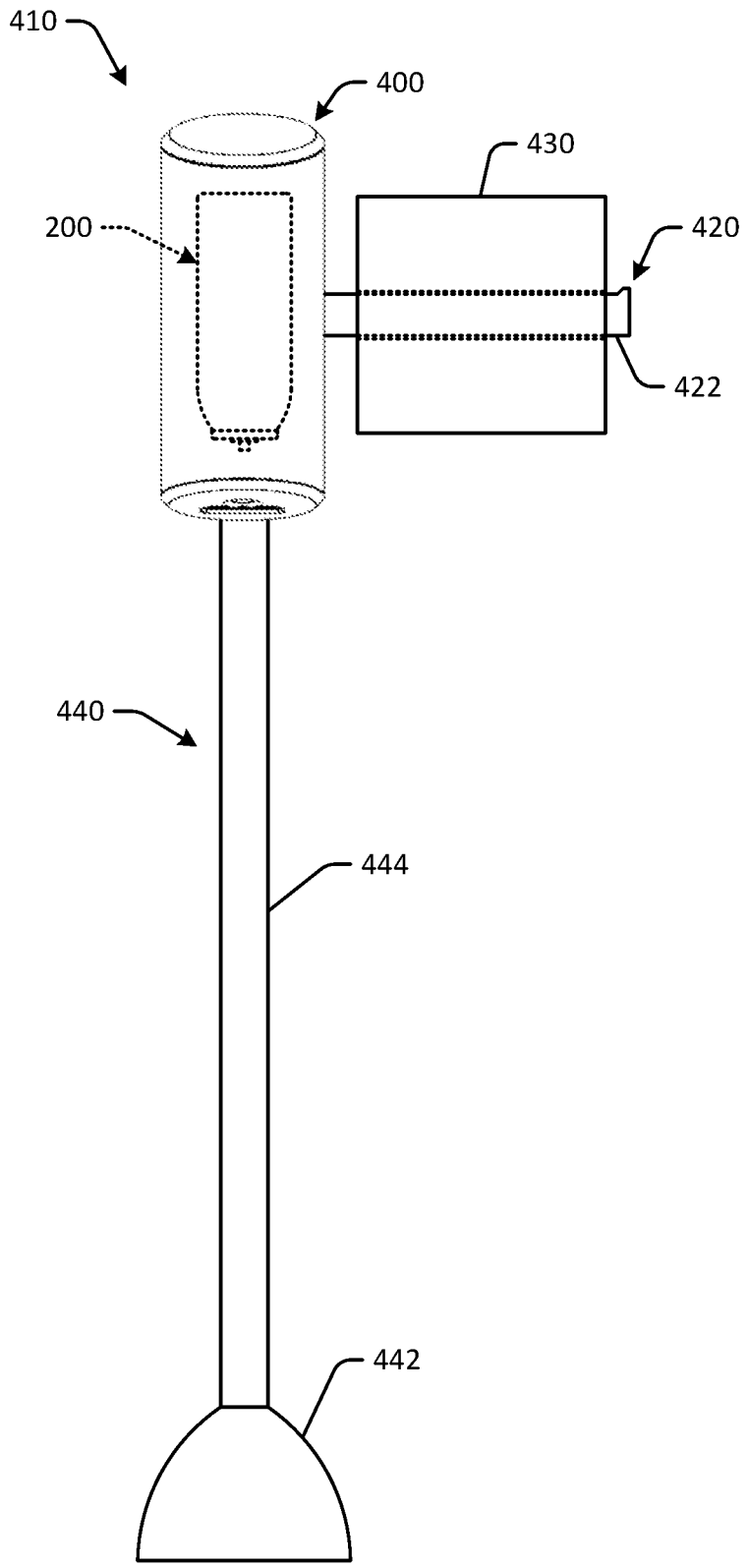
FIG. 4E is a front perspective view of the dispenser of FIG. 4A mounted to a stand adjacent a sheet product holder with a roll of sheet product loaded thereon.

The sixth housing portion 416, as shown in detail in FIGS. 4C and 4D, may be formed as an elongated member including various features for cooperating with the batteries, engaging the second housing portion 112, and mounting the dispenser 400 to a support structure. As shown in FIG. 4E, the dispenser 400 may be mounted to a stand 440 instead of a wall. The sixth housing portion 416 may include a front wall 464, a back wall 465, a top wall 466, and a pair of side walls 467. As shown, the sixth housing portion 416 also may include an intermediate wall 468 configured to engage and support the batteries positioned within the battery receptacle 140 of the second housing portion 112. The sixth housing portion 416 further may include a support ring 469 for receiving a portion of the stand 440, and a recess 470 for receiving a portion of a sheet product holder 420. As shown, the sixth housing portion 416 may be attached to the second housing portion 112. The sixth housing portion 416 may include a first tab 471 extending from the top end of the front wall 464, and a second tab 472 extending from the interior surface of the front wall 464 near the bottom end thereof. The first tab 471 may be configured to engage and be received within the top opening 144 of the second housing portion 112, and the second tab 472 may be configured to engage and be received within the bottom opening 144 of the second housing portion 112. Other features and attributes of the sixth housing portion 416 will be appreciated from the corresponding drawings and the functional description of the sixth housing portion 416 provided herein.

FIG. 4E illustrates a flowable material and sheet product dispensing system 410 (which also may be referred to as a "dispensing system" or a "system") according to one or more embodiments of the disclosure. As shown, the flowable material and sheet product dispensing system 410 may include the automated flowable material dispenser 400 and the flowable material container 200 described above. The dispensing system 410 also may include the stand 440, the sheet product holder 420, and a roll of sheet product 430. As shown, the dispenser 400 and the sheet product holder 420 may be mounted to the stand 440 adjacent one another. In this manner, a user may dispense a portion of the sheet product 430 from the holder 420 and then dispense a portion of the flowable material 212 onto the sheet product 430 using the dispenser 400.

As shown, the stand 440 may include a base 442 and a pole 444 extending upwardly from the base 442. The pole 444 may extend through the support ring 469 of the sixth housing portion 416, and a top end of the pole 444 may be positioned within the sixth housing portion 416, such that the dispenser 400 is securely mounted to the stand 440. As shown, the sheet product holder 420 may include a spindle 422 for insertion through a central aperture of the roll of sheet product 430. The sheet product holder 420 also may include a support ring for positioning over the pole 444 and within the recess 470 of the sixth housing portion 416. In certain embodiments, the dispenser 400 and/or the sheet product holder 420 may be configured to pivot about the pole 444 to adjust a relative position of the dispenser 400 and the sheet product holder 420 for convenient use. Other features and attributes of the dispenser 400 and the stand 440 will be appreciated from the corresponding drawings and the functional description provided herein.

Figure 5A:
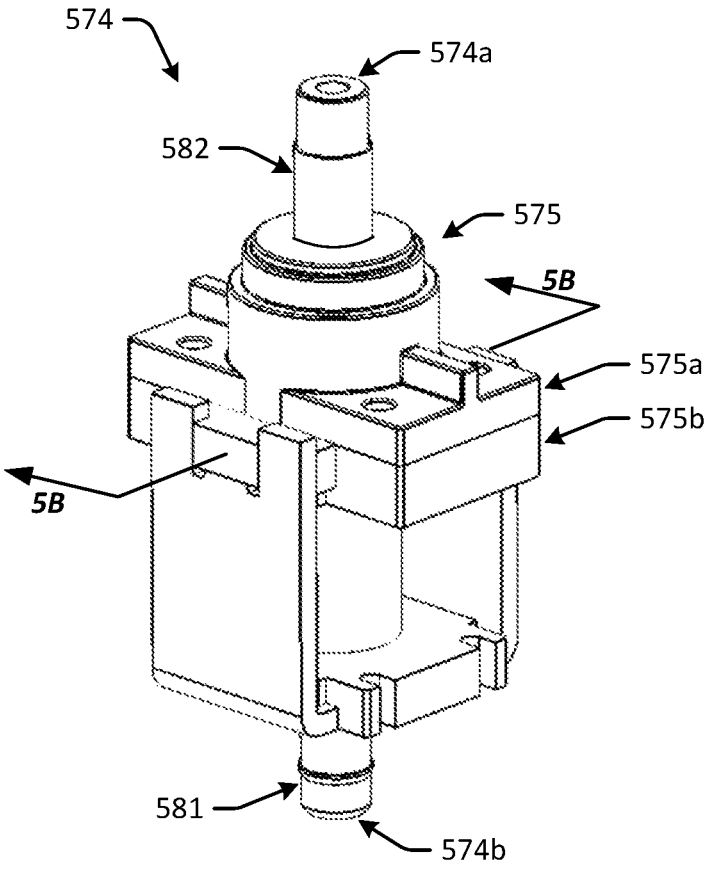
FIG. 5A is a front perspective view of a solenoid valve assembly as may be used with the automated flowable material dispenser of FIG. 1A in accordance with one or more embodiments of the disclosure.
Figure 5B:
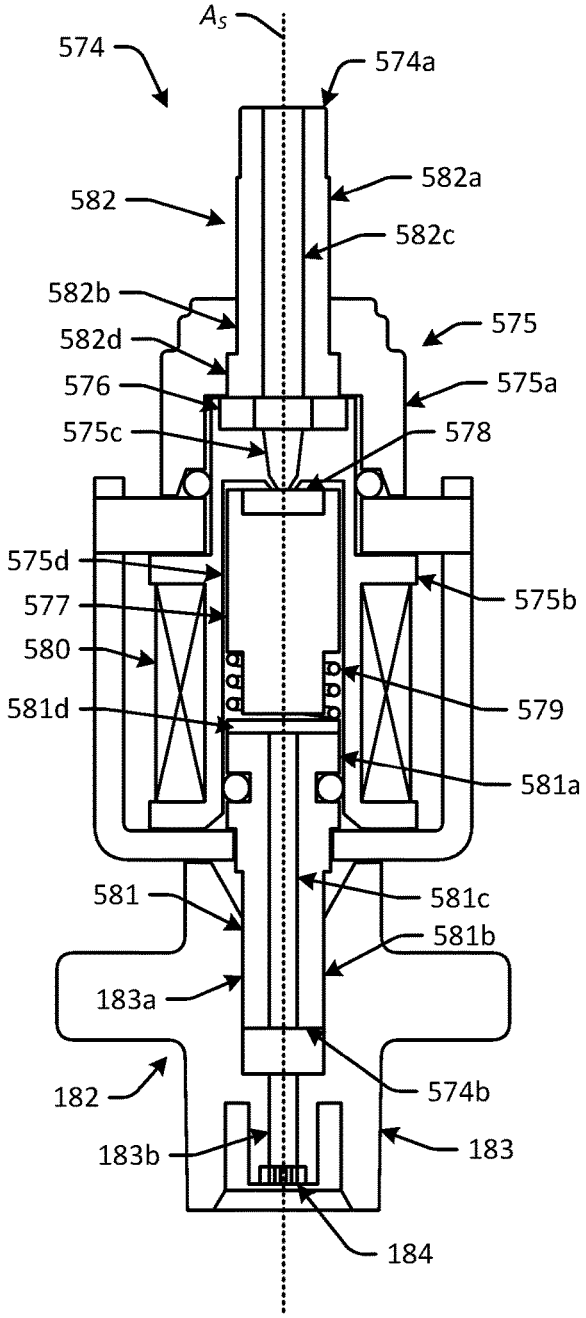
FIG. 5B is a cross-sectional side view of the solenoid valve assembly of FIG. 5A, taken along line 5B-5B of FIG. 5A, showing the solenoid valve assembly in a deactivated configuration and the dispensing nozzle mounted thereto.
Figure 5C:
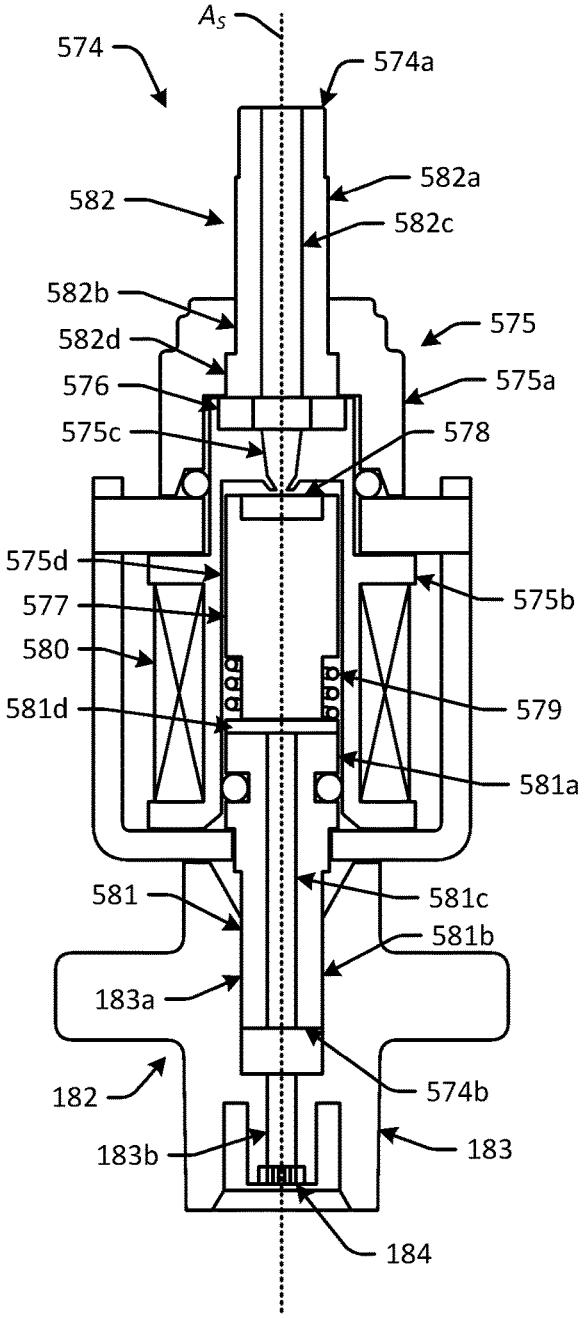
FIG. 5C is a cross-sectional side view of the solenoid valve assembly of FIG. 5A, taken along line 5B-5B of FIG. 5A, showing the solenoid valve assembly in an activated configuration and the dispensing nozzle mounted thereto.

FIGS. 5A-5C illustrate a solenoid valve assembly 574 according to one or more embodiments of the disclosure. In certain embodiments, the solenoid valve assembly 574 may be used as a part of the automated flowable material dispenser 100 or the automated flowable material dispenser 400 instead of the solenoid valve assembly 174. In particular, the solenoid valve assembly 574 may be used as a part of the dispenser 100 or the dispenser 400 when the flowable material container 200 has a female valve configuration. The solenoid valve assembly 574 may be configured to engage the flowable material container 200 and facilitate dispensing of the flowable material 212 therefrom. As described below, the solenoid valve assembly 574 may be configured to move between a deactivated configuration and an activated configuration in order to dispense the flowable material 212 from the dispenser 100 during a dispense cycle. As shown, the solenoid valve assembly 574 may have an elongated shape defining a longitudinal axis $A_S$ extending between a first end 574*a* (which also may be referred to as an "inlet end") and a second end 574*b* (which also may be referred to as an "outlet end"). The solenoid valve assembly 574 may include a solenoid housing 575, an inlet seal 576, a piston 577, a piston seal 578, a biasing member 579, a winding 580, an outlet stem 581, and an inlet stem 582.

As shown, the solenoid housing 575 may include a first portion 575*a* and a second portion 575*b* attached to one another and configured to contain other components of the solenoid valve assembly 574 therein. The first portion 575*a* may be positioned about the first end 574*a* of the solenoid valve assembly 574, and a portion of the inlet stem 582 may be positioned within the first portion 575*a*. The inlet stem 582 may be formed as an elongated tubular member having a first portion 582*a* positioned outside of the solenoid housing 575 and a second portion 582*b* positioned within the solenoid housing 575, in particular the first portion 575*a* thereof. As shown, the inlet stem 582 may include an inlet passage 582*c* extending therethrough. The second portion 582*b* of the inlet stem 582 may include a flange 582*d* configured to facilitate retention of the inlet stem 582 with respect to the solenoid housing 575. The first portion 582*a* of the inlet stem 582 may be configured to engage the valve assembly 208 of the flowable material container 200 when the container 200 is loaded in the dispenser 100. In particular, the first portion 582*a* may be configured to engage the female valve stem 232 to facilitate actuation of the valve assembly 208, as described in detail below. The inlet seal 576 may be positioned within the solenoid housing 575 and retained between the first portion 575*a* and the second portion 575*b*. In certain embodiments, the inlet seal 576 may be a ring-shaped gasket formed of an elastomeric material. As shown, the inlet seal 576 may engage the end of the second portion 582*b* of the inlet stem 582 and form a face seal therewith. When the flowable material container 200 is in the actuated configuration, the flowable material 212 may flow from the valve assembly 208, through the inlet passage 582*c* of the inlet stem 582, through the inlet seal 576, and into an inlet passage 575*c* of the solenoid housing 575.

The piston 577 may be formed as a cylindrical member positioned within a bore 575*d* of the solenoid housing 575. As shown, the piston 577 may be configured to translate within the bore 575*d* between a deactivated position (which also may be referred to as a "closed position"), as shown in FIG. 5B, and an activated position (which also may be referred to as an "open position"), as shown in FIG. 5C. The piston seal 578 may be a disc-shaped member formed of an elastomeric material. As shown, the piston seal 578 may be attached to the piston 577 and configured to close fluid communication between the inlet passage 575*c* and the bore 575*d* when the piston 577 is in the deactivated position. In particular, when the piston 577 is in the deactivated position, the piston seal 578 may engage a portion of the solenoid housing 575 surrounding the inlet passage 575*c* and form a face seal therewith. When the piston 577 is in the activated position, the piston seal 578 may be spaced apart from the inlet passage 575*c*, such that the flowable material 212 may flow from the inlet passage 575*c*, into the bore 575*d*, and around the piston 577. The biasing member 579 may be positioned within the bore 575*d* and retained between the piston 577 and the outlet stem 581. As shown, the biasing member 579 may be configured to bias the piston 577 toward the deactivated position. In certain embodiments, the biasing member 579 may be formed as a helical compression spring. The winding 580 may be wrapped around the solenoid housing 575 and configured to be energized by electrical current provided by the batteries of the dispenser 100. When electrical current is applied to the winding 580, magnetic induction may cause the piston 577 to overcome the biasing force provided by the biasing member 579 and move from the deactivated position to the activated position.

The outlet stem 581 may be formed as an elongated tubular member having a first portion 581*a* positioned within the bore 575*d* of the solenoid housing 575 and a second portion 581*b* positioned outside of the solenoid housing 575. As shown, the outlet stem 581 may include an outlet passage 581*c* extending therethrough. When the piston 577 is in the activated position, the flowable material 212 may flow from the bore 575*d* and through the outlet passage 581*c*. In certain embodiments, when the piston 577 is in the activated position, the bottom end of the piston 577 may engage the top end of the outlet stem 581, as shown in FIG. 5C. In such embodiments, the outlet stem 581 may include a channel 581*d* extending along the top end of the outlet stem 581 and in fluid communication with the outlet passage 581*c*. In this manner, if the piston 577 is maintained in the activated position for an extended period of time, the flowable material 212 still may flow continuously from the bore 575*c* and through the outlet passage 581*c*. In other embodiments, the biasing member 579 may be configured such that the bottom end of the piston 577 may be spaced apart from the top end of the outlet stem 581 when the piston 577 is in the activated position. In this manner, if the piston 577 is maintained in the activated position for an extended period of time, the flowable material 212 still may flow continuously from the bore 575*c* and through the outlet passage 581*c*. As shown in FIGS. 5B and 5C, the dispensing nozzle 182 may be mounted to the outlet stem 581 in the same manner as that described above.

Figure 5D:
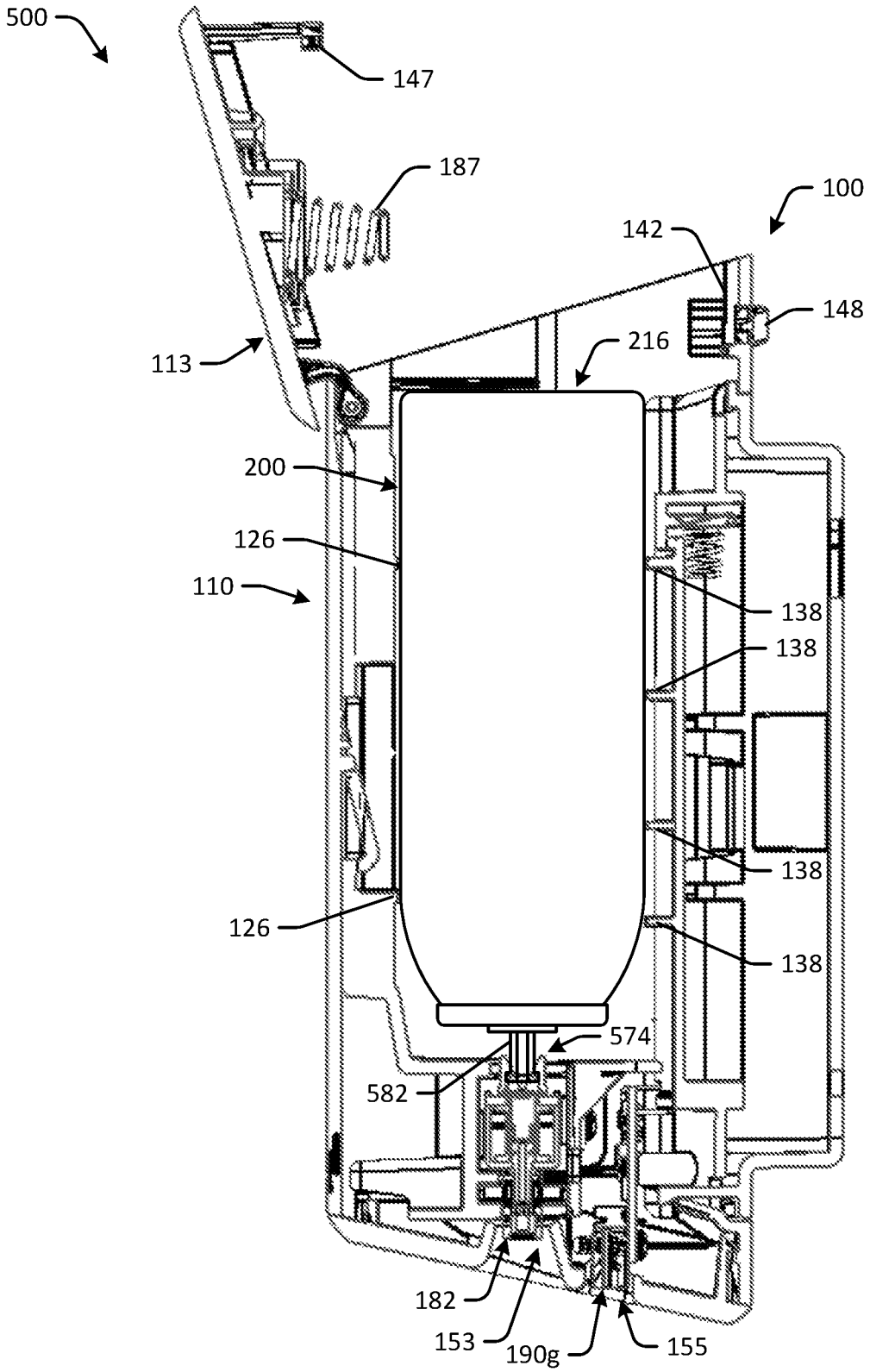
FIG. 5D is a partial cross-sectional side view of an automated flowable material dispenser system in accordance with one or more embodiments of the disclosure, the system including the automated flowable material dispenser of FIG. 1A having the solenoid valve assembly of FIG. 5A and the flowable material container of FIG. 2A having a female valve configuration, showing the housing of the dispenser in an open configuration and the flowable material container in an unactuated configuration within the housing.
Figure 5E:
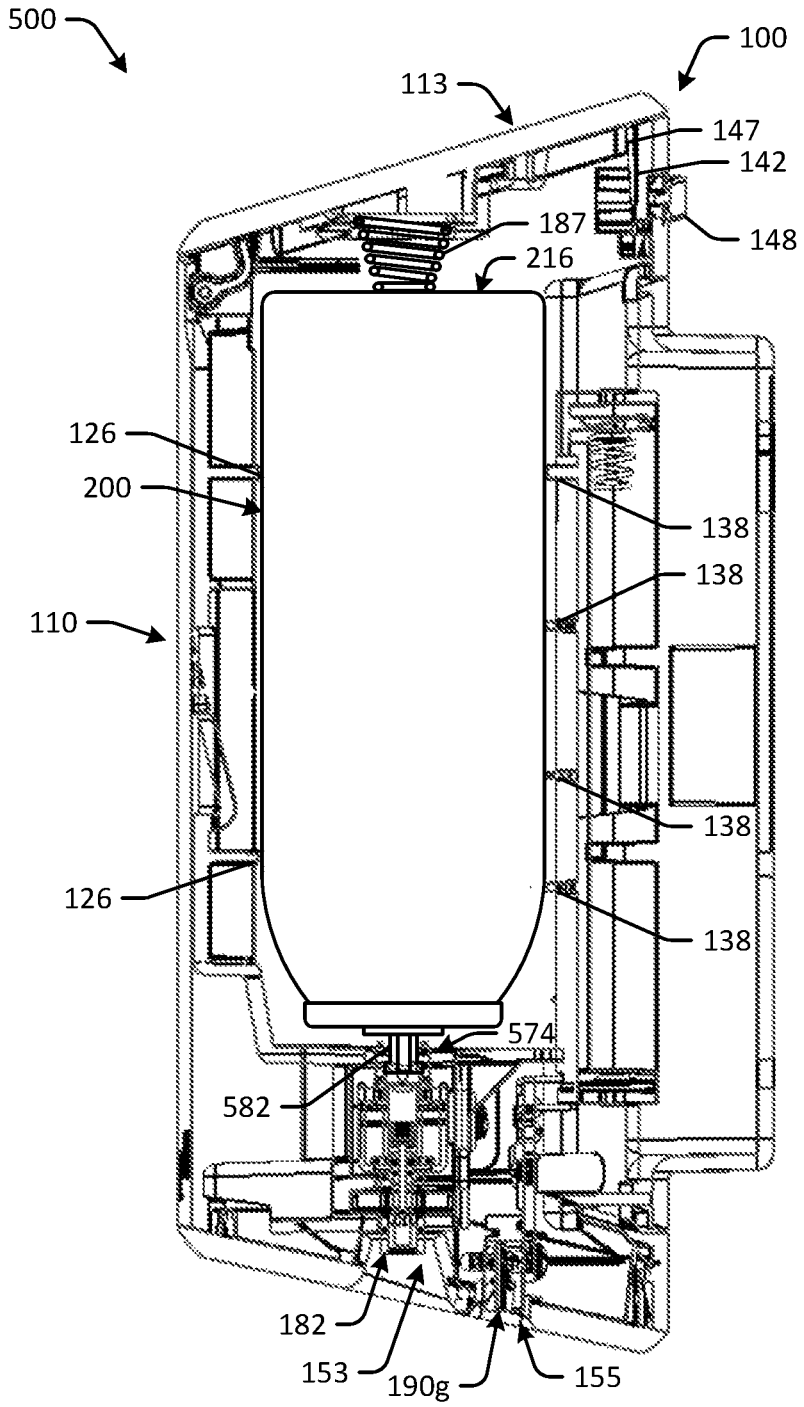
FIG. 5E is a partial cross-sectional side view of the system of FIG. 5D, showing the housing of the dispenser in a closed configuration and the flowable material container in an actuated configuration within the housing.

FIGS. 5D and 5E illustrate an automated flowable material dispenser system 500 (which also may be referred to as a "dispenser system" or a "system") according to one or more embodiments of the disclosure. As shown, the automated flowable material dispenser system 500 may include the automated flowable material dispenser 100 having the solenoid valve assembly 574 and the flowable material container 200 having the female valve configuration described above. The container 200 may be prefilled with the flowable material 212, such as a liquid cleanser or an air freshener, although other types of flowable materials may be used. The container 200 may be loaded into the dispenser 100 by moving the housing 110 from the closed configuration to the open configuration, as shown in FIG. 5D, and inserting the container 200 into the housing 110. As described above, the housing 110 may be moved from the closed configuration to the open configuration by moving the release button 148 from the extended position to the depressed position such that the tab 147 of the third housing portion 113 disengages the second protrusion 142 of the second housing portion 112. If an existing container 200 is present in the housing 110, energy stored by the compressed biasing member 187 may cause the third housing portion 113 to automatically move from its closed position to its open position. The existing container 200 may be removed from the housing 110, and the new container 200 may be inserted into the housing 110 in an inverted orientation, as shown in FIG. 5D. Proper positioning of the container 200 within the housing 110 may be facilitated by the container receptacles 125, 137 of the first and second housing portions 111, 112 and the support ribs 126, 138 thereof. As shown, an end portion of the inlet stem 582 of the solenoid valve assembly 574 may be received within the valve assembly 208 of the container 200, and the end of the inlet stem 582 may engage the female valve stem 232 of the valve assembly 208. However, the container 200 may remain in the unactuated configuration upon insertion of the container 200 into the housing 110, while the housing 110 remains in the open configuration. The housing 110 then may be moved from the open configuration to the closed configuration, as shown in FIG. 5E. As the housing 110 is moved to the closed configuration, the biasing member 187 may engage the second end 216 of the container 200 and bias the container 200 toward the solenoid valve assembly 574. The biasing force provided by the biasing member 187 may move the container 200 from the unactuated configuration to the actuated configuration, as shown. In particular, while the inlet stem 582 remains positioned against the female valve stem 232, the remainder of the container 200 may move downward toward the solenoid valve assembly 574. As a result, the valve assembly 208 may be actuated and the flowable material 212 may flow out of the container 200 and into the solenoid valve assembly 574. The movement of the housing 110 to the closed configuration also may cause the tab 147 of the third housing portion 113 to engage the second protrusion 142 of the second housing portion 112, such that the housing 110 is maintained in the closed configuration.

During operation of the dispenser 100, the solenoid valve assembly 574 may move between the deactivated configuration and the activated configuration to carry out a dispense cycle. When the solenoid valve assembly 574 is in the activated configuration, a portion of the flowable material 212, under pressure by the pressurized gas 210 within the container, may flow through the solenoid valve assembly 574 and into the dispensing nozzle 182, as described above. The dispensing nozzle 182 may direct the portion of the flowable material 212 downward through the dispensing opening 153 of the housing 110 and out of the dispenser 100. As described above, the electronic controller 190*b* may initiate a dispense cycle upon receiving a signal from the IR sensor 190*g* indicating the presence of a user's hand or a substrate held by the user's hand within the detectable range of the IR sensor 190*g*. In this manner, the container 200 may remain in the actuated configuration while loaded within the housing 110, and the solenoid valve assembly 574 may control release of the flowable material 212 from the dispenser 100. Other aspects of operation of the system 500, the dispenser 100, and the container 200 will be appreciated from the corresponding drawings and the functional description provided herein.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific automated product dispenser configurations, it will be appreciated that numerous other automated product dispenser configurations are within the scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments.

I claim:

1. An automated flowable material dispenser for dispensing flowable material from a flowable material container, the dispenser comprising:

a dispenser housing configured to receive the flowable material container therein, the dispenser housing defining a dispensing opening along a bottom end of the dispenser housing, and the dispenser housing configured to move between an open configuration and a closed configuration, wherein the dispenser housing comprises a top cover configured to pivot about a hinge to move the dispenser housing between the open configuration and the closed configuration;

a solenoid valve assembly positioned within the dispenser housing above the dispensing opening and configured to control dispensing of the flowable material from the dispenser; and a biasing member configured to bias the flowable material container toward the solenoid valve assembly and to move the flowable material container from an unactuated configuration to an actuated configuration, wherein the biasing member is attached to the top cover.

2. The automated flowable material dispenser of claim 1, wherein the biasing member is configured to bias the flowable material container toward the solenoid valve assembly when the dispenser housing is in the closed configuration, and wherein the biasing member is configured to move the flowable material container from the unactuated configuration to the actuated configuration when the dispenser housing is moved from the open configuration to the closed configuration.

3. The automated flowable material dispenser of claim 1, wherein the biasing member comprises a compressible member.

4. The automated flowable material dispenser of claim 1, further comprising a button releasably engaging the top cover and positioned above the hinge, the button configured to move from an extended position to a depressed position for allowing the top cover to pivot about the hinge.

5. The automated flowable material dispenser of claim 1, wherein the solenoid valve assembly comprises:

a solenoid housing configured to receive a portion of the flowable material container therein;

a seal positioned within the solenoid housing and configured to engage the portion of the flowable material container; and a piston positioned within the solenoid housing and configured to translate between a deactivated position and an activated position; and wherein the biasing member is configured to bias the portion of the flowable material container against the seal.

6. The automated flowable material dispenser of claim 1, wherein the solenoid valve assembly comprises:

a solenoid housing;

an inlet stem extending from the solenoid housing and configured to be received within a portion of the flowable material container; and a piston positioned within the solenoid housing and configured to translate between a deactivated position and an activated position; and wherein the biasing member is configured to bias the portion of the flowable material container against the inlet stem.

7. The automated flowable material dispenser of claim 1, further comprising a dispensing nozzle attached to an outlet end of the solenoid valve assembly and positioned at least partially within the dispensing opening, the dispensing nozzle configured to receive the flowable material from the solenoid valve assembly and direct the flowable material out of the dispenser.

8. The automated flowable material dispenser of claim 1, wherein the dispenser housing is configured to receive the flowable material container in an inverted orientation such that an outlet end of the flowable material container faces toward the solenoid valve assembly.

9. The automated flowable material dispenser of claim 1, wherein the flowable material container comprises:

a container body;

a container reservoir positioned within the container body and containing the flowable material therein;

a pressurized gas contained within the container body outside of the container reservoir; and a container valve assembly in fluid communication with the container reservoir and configured to engage the solenoid valve assembly.

10. A dispensing system comprising:

a roll of sheet product;

a sheet product holder comprising a spindle configured to support the roll of sheet product thereon;

a pressurized flowable material container comprising a flowable material contained therein; and an automated flowable material dispenser for dispensing the flowable material from the pressurized flowable material container, the dispenser comprising:

a dispenser housing configured to receive the pressurized flowable material container therein, the dispenser housing defining a dispensing opening along a bottom end of the dispenser housing;

a solenoid valve assembly positioned within the dispenser housing and configured to control dispensing of the flowable material from the pressurized flowable material container; and a biasing member configured to bias the pressurized flowable material container toward the solenoid valve assembly and to move the pressurized flowable material container from an unactuated configuration to an actuated configuration.

11. The dispensing system of claim 10, wherein the solenoid valve assembly comprises:

a solenoid housing configured to receive a portion of the pressurized flowable material container therein;

a seal positioned within the solenoid housing and configured to engage the portion of the pressurized flowable material container; and a piston positioned within the solenoid housing and configured to translate between a deactivated position and an activated position; and wherein the biasing member is configured to bias the portion of the pressurized flowable material container against the seal.

12. The dispensing system of claim 10, wherein the solenoid valve assembly comprises:

a solenoid housing;

an inlet stem extending from the solenoid housing and configured to be received within a portion of the pressurized flowable material container; and a piston positioned within the solenoid housing and configured to translate between a deactivated position and an activated position; and wherein the biasing member is configured to bias the portion of the pressurized flowable material container against the inlet stem.

13. The dispensing system of claim 10, further comprising a dispensing nozzle attached to an outlet end of the solenoid valve assembly and positioned at least partially within the dispensing opening, the dispensing nozzle configured to receive the flowable material from the solenoid valve assembly and direct the flowable material out of the dispenser.

14. The dispensing system of claim 10, wherein the dispenser housing is configured to receive the pressurized flowable material container in an inverted orientation such that an outlet end of the flowable material container faces toward the solenoid valve assembly.

15. An automated flowable material dispensing system for dispensing flowable material, the system comprising:

an automated flowable material dispenser comprising:

a dispenser housing defining a dispensing opening along a bottom end of the dispenser housing, the dispenser housing configured to move between an open configuration and a closed configuration, wherein the dispenser housing comprises a top cover configured to pivot about a hinge to move the dispenser housing between the open configuration and the closed configuration;

a solenoid valve assembly positioned within the dispenser housing above the dispensing opening; and a biasing member; and a flowable material container removably positioned within the dispenser housing and containing the flowable material therein;

wherein the biasing member is configured to bias the flowable material container toward the solenoid valve assembly and to move the flowable material container from an unactuated configuration to an actuated configuration, wherein the biasing member is attached to the top cover; and wherein the solenoid valve assembly is configured to control dispensing of the flowable material from the dispenser.

16. The automated flowable material dispensing system of claim 15, wherein the biasing member is configured to bias the flowable material container toward the solenoid valve assembly when the dispenser housing is in the closed configuration, and wherein the biasing member is configured to move the flowable material container from the unactuated configuration to the actuated configuration when the dispenser housing is moved from the open configuration to the closed configuration.

17. The automated flowable material dispensing system of claim 15, wherein the biasing member comprises a compressible member.

18. The automated flowable material dispensing system of claim 15, wherein the automated flowable material dispenser further comprises a button releasably engaging the top cover and positioned above the hinge, the button configured to move from an extended position to a depressed position for allowing the top cover to pivot about the hinge.

19. The automated flowable material dispensing system of claim 15, wherein the flowable material container is positioned within the dispenser housing in an inverted orientation such that an outlet end of the flowable material container faces toward the solenoid valve assembly.

20. The automated flowable material dispensing system of claim 15, wherein the flowable material container comprises:

a container body;

a container reservoir positioned within the container body and containing the flowable material therein;

a pressurized gas contained within the container body outside of the container reservoir; and a container valve assembly in fluid communication with the container reservoir and configured to engage the solenoid valve assembly.

* * * * *